US012501934B2

(12) United States Patent
Johnson

(10) Patent No.: US 12,501,934 B2
(45) Date of Patent: Dec. 23, 2025

(54) CARTRIDGE FOR VAPORIZER DEVICE

(71) Applicant: JUUL Labs, Inc., San Francisco, CA (US)

(72) Inventor: Eric Joseph Johnson, San Francisco, CA (US)

(73) Assignee: JUUL Labs, Inc., Washington, DC (US)

( * ) Notice: Subject to any disclaimer, the term of this patent is extended or adjusted under 35 U.S.C. 154(b) by 247 days.

(21) Appl. No.: 17/965,966

(22) Filed: Oct. 14, 2022

(65) Prior Publication Data

US 2023/0108827 A1 Apr. 6, 2023

Related U.S. Application Data

(63) Continuation of application No. PCT/US2021/027402, filed on Apr. 15, 2021.
(Continued)

(51) Int. Cl.
*A24F 40/10* (2020.01)
*A24F 40/42* (2020.01)
(Continued)

(52) U.S. Cl.
CPC ..... *A24F 40/42* (2020.01); *A24F 40/44* (2020.01); *A24F 40/46* (2020.01); *A24F 40/485* (2020.01); *A24F 40/10* (2020.01)

(58) Field of Classification Search
CPC ..... A24F 40/42; A24F 40/44; A24F 40/46; A24F 40/485; A24F 40/10; A24F 40/48
See application file for complete search history.

(56) References Cited

U.S. PATENT DOCUMENTS 6,084,616 A 7/2000 Nakata et al.
6,155,268 A 12/2000 Takeuchi
(Continued)

FOREIGN PATENT DOCUMENTS

CN 101968131 A 2/2011
CN 202873795 U 4/2013
(Continued)

OTHER PUBLICATIONS (Aug. 2019) Open-Channel Microfluidics: Fundamentals and applications, Chapter 1: D6 Capillarity theoretical basis.
(Continued)

*Primary Examiner* — Philip Y Louie
*Assistant Examiner* — Oluwatosin O Diyan
(74) *Attorney, Agent, or Firm* — Mintz, Levin, Cohn, Ferris, Glovsky and Popeo, P.C.

(57) ABSTRACT

A cartridge may include a cartridge, a reservoir, a heating element, and a wicking element. The housing may include a first housing segment coupled with a second housing segment. A portion of the cartridge housing may form a wick housing. The reservoir may include a collector having an overflow channel with microfluidic features configured to provide a constriction point at which a meniscus forms to prevent air entering the reservoir from passing the vaporizable material in the overflow channel. The heating element may include a heating portion disposed inside the wick housing and a contact portion extending outside of the wick housing. The wicking element may be disposed inside the wick housing and proximate to the heating portion of the heating element. The wicking element may be in fluid communication with the reservoir and configured to draw the vaporizable material from the reservoir for vaporization by the heating element.

22 Claims, 50 Drawing Sheets

Related U.S. Application Data

(60) Provisional application No. 63/010,571, filed on Apr. 15, 2020.

(51) Int. Cl.
*A24F 40/44* (2020.01)
*A24F 40/46* (2020.01)
*A24F 40/485* (2020.01)

(56) References Cited

U.S. PATENT DOCUMENTS

| | | | |
|---|---|---|---|
| 8,528,569 | B1 | 9/2013 | Newton |
| 9,146,246 | B2 | 9/2015 | Battrell et al. |
| 9,549,573 | B2 | 1/2017 | Monsees et al. |
| 9,986,761 | B2 | 6/2018 | Thorens et al. |
| 9,986,762 | B2 | 6/2018 | Alarcon et al. |
| 10,045,568 | B2 | 8/2018 | Monsees et al. |
| 10,058,129 | B2 | 8/2018 | Monsees et al. |
| 10,085,481 | B2 | 10/2018 | Verleur et al. |
| 10,104,915 | B2 | 10/2018 | Bowen et al. |
| 10,130,123 | B2 | 11/2018 | Hatton et al. |
| 10,159,282 | B2 | 12/2018 | Monsees et al. |
| 10,258,085 | B2 | 4/2019 | Xu |
| 10,905,835 | B2 | 2/2021 | Atkins et al. |
| 11,241,043 | B2 | 2/2022 | Leadley et al. |
| 2002/0186283 | A1 | 12/2002 | Smith et al. |
| 2003/0215335 | A1 | 11/2003 | Crivelli |
| 2004/0060997 | A1 | 4/2004 | Jones |
| 2009/0047440 | A1 | 2/2009 | Giri et al. |
| 2011/0155153 | A1 | 6/2011 | Thorens et al. |
| 2011/0226236 | A1 | 9/2011 | Buchberger |
| 2013/0019862 | A1 | 1/2013 | Yamada et al. |
| 2013/0042865 | A1 | 2/2013 | Monsees et al. |
| 2013/0104916 | A1 | 5/2013 | Bellinger et al. |
| 2013/0192615 | A1 | 8/2013 | Tucker et al. |
| 2013/0199528 | A1 | 8/2013 | Goodman et al. |
| 2013/0306064 | A1 | 11/2013 | Thorens et al. |
| 2014/0190496 | A1 | 7/2014 | Wensley et al. |
| 2014/0224244 | A1 | 8/2014 | Liu |
| 2014/0366898 | A1 | 12/2014 | Monsees et al. |
| 2015/0027470 | A1 | 1/2015 | Kane et al. |
| 2015/0181944 | A1 | 7/2015 | Li et al. |
| 2015/0208729 | A1 | 7/2015 | Monsees et al. |
| 2015/0264979 | A1 | 9/2015 | Thorens et al. |
| 2015/0305408 | A1 | 10/2015 | Liu |
| 2015/0327596 | A1 | 11/2015 | Alarcon et al. |
| 2016/0057811 | A1 | 2/2016 | Alarcon et al. |
| 2016/0183596 | A1 | 6/2016 | Rado |
| 2016/0219938 | A1 | 8/2016 | Mamoun et al. |
| 2016/0262454 | A1 | 9/2016 | Sears et al. |
| 2016/0309786 | A1 | 10/2016 | Holtz et al. |
| 2016/0331035 | A1 | 11/2016 | Cameron |
| 2016/0341419 | A1 | 11/2016 | Fluhrer |
| 2017/0043106 | A1 | 2/2017 | Hyland et al. |
| 2017/0043910 | A1 | 2/2017 | Hopps et al. |
| 2017/0056883 | A1 | 3/2017 | Aarts et al. |
| 2017/0108210 | A1* | 4/2017 | Meinhart ..... B05B 7/1686 |
| 2017/0135399 | A1 | 5/2017 | Gavrielov et al. |
| 2017/0163046 | A1 | 6/2017 | Patil et al. |
| 2017/0224021 | A1 | 8/2017 | Xiang |
| 2017/0231276 | A1 | 8/2017 | Mironov et al. |
| 2017/0258134 | A1 | 9/2017 | Kane |
| 2017/0259170 | A1 | 9/2017 | Bowen et al. |
| 2017/0360092 | A1 | 12/2017 | Althorpe et al. |
| 2017/0367402 | A1 | 12/2017 | Lau et al. |
| 2017/0367407 | A1 | 12/2017 | Althorpe et al. |
| 2018/0020736 | A1 | 1/2018 | Silvestrini et al. |
| 2018/0027877 | A1 | 2/2018 | Tucker et al. |
| 2018/0027879 | A1 | 2/2018 | Gavrielov et al. |
| 2018/0070647 | A1 | 3/2018 | Monsees et al. |
| 2018/0077967 | A1 | 3/2018 | Hatton et al. |
| 2018/0116292 | A1 | 5/2018 | Ariel et al. |
| 2018/0125120 | A1 | 5/2018 | Gavrielov et al. |
| 2018/0132532 | A1 | 5/2018 | Batista |
| 2018/0132536 | A1 | 5/2018 | Henry, Jr. |
| 2018/0146711 | A1 | 5/2018 | Mazur et al. |
| 2018/0153218 | A1 | 6/2018 | Verleur et al. |
| 2018/0199627 | A1 | 7/2018 | Bowen et al. |
| 2018/0220707 | A1 | 8/2018 | Biel et al. |
| 2018/0249763 | A1 | 9/2018 | Schmidt et al. |
| 2018/0279682 | A1 | 10/2018 | Guo et al. |
| 2018/0297047 | A1 | 10/2018 | Tong |
| 2018/0317557 | A1* | 11/2018 | Monsees ..... A61M 11/042 |
| 2019/0104764 | A1 | 4/2019 | Tucker et al. |
| 2019/0246693 | A1 | 8/2019 | Nettenstrom et al. |
| 2019/0373953 | A1 | 12/2019 | Atkins et al. |
| 2020/0008483 | A1* | 1/2020 | Memari ..... B65B 3/04 |
| 2020/0022417 | A1 | 1/2020 | Atkins et al. |
| 2020/0107585 | A1 | 4/2020 | Atkins et al. |
| 2020/0114094 | A1 | 4/2020 | Atkins et al. |
| 2020/0128874 | A1 | 4/2020 | Atkins et al. |
| 2020/0205474 | A1 | 7/2020 | Tong |
| 2021/0145053 | A1 | 5/2021 | Tasselli et al. |
| 2022/0125107 | A1 | 4/2022 | Moloney |

FOREIGN PATENT DOCUMENTS

| | | | |
|---|---|---|---|
| CN | 102264420 | B | 3/2014 |
| CN | 103859604 | A | 6/2014 |
| CN | 204147375 | U | 2/2015 |
| CN | 104540406 | A | 4/2015 |
| CN | 102753047 | B | 8/2015 |
| CN | 105142444 | A | 12/2015 |
| CN | 105307520 | A | 2/2016 |
| CN | 105768224 | A | 7/2016 |
| CN | 105919164 | A | 9/2016 |
| CN | 105939625 | A | 9/2016 |
| CN | 205624481 | U | 10/2016 |
| CN | 106998812 | A | 8/2017 |
| CN | 107580460 | A | 1/2018 |
| CN | 207011686 | U | 2/2018 |
| CN | 108158039 | A | 6/2018 |
| CN | 108158044 | A | 6/2018 |
| CN | 108308711 | A | 7/2018 |
| CN | 207713732 | U | 8/2018 |
| CN | 109259313 | A | 1/2019 |
| CN | 109259328 | A | 1/2019 |
| CN | 109781337 | A | 5/2019 |
| CN | 110089780 | A | 8/2019 |
| CN | 110250576 | A | 9/2019 |
| CN | 110367607 | A | 10/2019 |
| CN | 212629857 | U | 3/2021 |
| CN | 215455405 | U | 1/2022 |
| CN | 216906817 | U | 7/2022 |
| CN | 220326832 | U | 1/2024 |
| CN | 222171324 | U | 12/2024 |
| EP | 2404515 | A1 | 1/2012 |
| EP | 3127441 | A1 | 2/2017 |
| EP | 3220987 | A1 | 9/2017 |
| EP | 3337341 | A1 | 6/2018 |
| EP | 3358972 | A1 | 8/2018 |
| EP | 3177351 | B1 | 10/2018 |
| EP | 3692830 | A1 | 8/2020 |
| EP | 3694357 | A1 | 8/2020 |
| EP | 3747286 | A1 | 12/2020 |
| EP | 3863436 | A1 | 8/2021 |
| EP | 3664630 | B1 | 2/2022 |
| EP | 3984390 | A1 | 4/2022 |
| EP | 4044842 | A2 | 8/2022 |
| GB | 314389 | A | 4/1930 |
| GB | 2548647 | A | 9/2017 |
| JP | H1133097 | A | 2/1999 |
| JP | H1189551 | A | 4/1999 |
| JP | 2012517229 | A | 8/2012 |
| JP | 2015198985 | A | 11/2015 |
| JP | 2018509158 | A | 4/2018 |
| JP | 2018523976 | A | 8/2018 |
| JP | 4171054 | B2 | 10/2018 |
| JP | 2019521672 | A | 8/2019 |
| KR | 10-2012-0101118 | A | 9/2012 |
| KR | 10-2018-0044409 | A | 5/2018 |
| KR | 10-2018-0088806 | A | 8/2018 |
| RU | 2527351 | C2 | 8/2014 |
| RU | 2611487 | C2 | 2/2017 |

(56) References Cited

FOREIGN PATENT DOCUMENTS

| | | | |
|---|---|---|---|
| RU | 2656089 | C2 | 5/2018 |
| RU | 2664376 | C1 | 8/2018 |
| TW | 201806502 | A | 3/2018 |
| UZ | 2238 | C | 12/2002 |
| WO | 99/30833 | A1 | 6/1999 |
| WO | WO-2013113173 | A1 | 8/2013 |
| WO | WO-2014150979 | A2 | 9/2014 |
| WO | WO-2015077645 | A1 | 5/2015 |
| WO | WO-2015100361 | A1 | 7/2015 |
| WO | WO-2015117702 | A1 | 8/2015 |
| WO | WO-2016033242 | A1 | 3/2016 |
| WO | WO-2016079155 | A1 | 5/2016 |
| WO | WO-2016092261 | A1 | 6/2016 |
| WO | WO-2016123763 | A1 | 8/2016 |
| WO | WO-2016145072 | A1 | 9/2016 |
| WO | WO-2017028295 | A1 | 2/2017 |
| WO | WO-2017059571 | A1 | 4/2017 |
| WO | WO-2017093535 | A1 | 6/2017 |
| WO | WO-2017139595 | A1 | 8/2017 |
| WO | WO-2017163045 | A1 | 9/2017 |
| WO | WO-2017163046 | A1 | 9/2017 |
| WO | WO-2017163050 | A1 | 9/2017 |
| WO | WO-2017163052 | A1 | 9/2017 |
| WO | WO-2017191176 | A1 | 11/2017 |
| WO | WO-2017220340 | A1 | 12/2017 |
| WO | WO-2018024742 | A1 | 2/2018 |
| WO | WO-2018114163 | A1 | 6/2018 |
| WO | WO-2018122380 | A1 | 7/2018 |
| WO | WO-2018158566 | A1 | 7/2018 |
| WO | WO-2018153608 | A1 | 8/2018 |
| WO | WO-2018172765 | A1 | 9/2018 |
| WO | WO-2019073010 | A1 | 4/2019 |
| WO | WO-2020025644 | A1 | 2/2020 |
| WO | WO-2020081849 | A2 | 4/2020 |
| WO | WO-2020252647 | A1 | 12/2020 |
| WO | WO-2021076657 | A3 | 8/2021 |
| WO | WO-2022161259 | A1 | 8/2022 |

OTHER PUBLICATIONS

Capillary Action—Wikipedia—Archive.org snapshot dated Sep. 19, 2018, retrieved via "https://web.archive.org/web/20180919170621/https://en. wikipedia. org/wiki/Capillary_ action" on Sep. 23, 2022.
Capillary Action—Archive.org snapshot dated Sep. 27, 2018, retrieved via "https://web.archive.org/web/20180927172339/http:l /science. jrank. org/pages/1182/Capillarv-Action.html" on Sep. 23, 2022.
Capillary Pressure—Wikipedia—Archive.org snapshot dated Mar. 12, 2017, retrieved via https://web.archive.org/web/20170312101259/https://en. wikipedia. org/wiki/Capillarv pressure on Sep. 23, 2022.
(2009)Capillarity, A. Ch. Mitropoulos, Journal of Engineering Science and Technoloqy Review 2 (1) (2009) 28-32.

* cited by examiner

CARTRIDGE FOR VAPORIZER DEVICE

CROSS REFERENCE TO RELATED APPLICATION

This application is a bypass continuation and claims priority to PCT/US21/27402, filed on Apr. 15, 2021 and entitled "CARTRIDGE FOR VAPORIZER DEVICE" which claims priority to U.S. Provisional Application No. 63/010,571, filed on Apr. 15, 2020 and entitled "CARTRIDGE FOR VAPORIZER DEVICE," the disclosures of which are incorporated herein by reference in their entirety.

TECHNICAL FIELD

The subject matter described herein relates generally to vaporizer devices and more specifically to a vaporizer cartridge configured to couple with a vaporizer device.

BACKGROUND

Vaporizer devices, which can also be referred to as vaporizers, electronic vaporizer devices or e-vaporizer devices, can be used for delivery of an aerosol (or "vapor") containing one or more active ingredients by inhalation of the aerosol by a user of the vaporizing device. For example, electronic cigarettes, which may also be referred to as e-cigarettes, are a class of vaporizer devices that are typically battery powered and that may be used to simulate the experience of cigarette smoking, but without burning of tobacco or other substances.

In use of a vaporizer device, the user inhales an aerosol, commonly called vapor, which may be generated by a heating element that vaporizes (which generally refers to causing a liquid or solid to at least partially transition to the gas phase) a vaporizable material, which may be liquid, a solution, a solid, a wax, or any other form as may be compatible with use of a specific vaporizer device. The vaporizable material used with a vaporizer can be provided within a cartridge (e.g., a part of the vaporizer that contains the vaporizable material in a reservoir) that includes a mouthpiece (e.g., for inhalation by a user).

To receive the inhalable aerosol generated by a vaporizer device, a user may, in certain examples, activate the vaporizer device by taking a puff, by pressing a button, or by some other approach. A puff, as the term is generally used (and also used herein), refers to inhalation by the user in a manner that causes a volume of air to be drawn into the vaporizer device such that the inhalable aerosol is generated by a combination of vaporized vaporizable material with the air.

A typical approach by which a vaporizer device generates an inhalable aerosol from a vaporizable material involves heating the vaporizable material in a vaporization chamber (or a heater chamber) to cause the vaporizable material to be converted to the gas (or vapor) phase. A vaporization chamber generally refers to an area or volume in the vaporizer device within which a heat source (e.g., conductive, convective, and/or radiative) causes heating of a vaporizable material to produce a mixture of air and vaporized vaporizable material to form a vapor for inhalation by a user of the vaporization device.

In some vaporizer device embodiments, the vaporizable material can be drawn out of a reservoir and into the vaporization chamber via a wicking element (a wick). Such drawing of the vaporizable material into the vaporization chamber can be due, at least in part, to capillary action provided by the wick, which pulls the vaporizable material along the wick in the direction of the vaporization chamber. However, as vaporizable material is drawn out of the reservoir, the pressure inside the reservoir is reduced, thereby creating a vacuum and acting against the capillary action. This can reduce the effectiveness of the wick to draw the vaporizable material into the vaporization chamber, thereby reducing the effectiveness of the vaporization device to vaporize a desired amount of vaporizable material, such as when a user takes a puff on the vaporizer device. Furthermore, the vacuum created in the reservoir can ultimately result in the inability to draw all of the vaporizable material into the vaporization chamber, thereby wasting vaporizable material. As such, improved vaporization devices and/or vaporization cartridges that improve upon or overcome these issues is desired.

The term vaporizer device, as used herein consistent with the current subject matter, generally refers to portable, self-contained, devices that are convenient for personal use. Typically, such devices are controlled by one or more switches, buttons, touch sensitive devices, or other user input functionality or the like (which can be referred to generally as controls) on the vaporizer, although a number of devices that may wirelessly communicate with an external controller (e.g., a smartphone, a smart watch, other wearable electronic devices, etc.) have recently become available. Control, in this context, refers generally to an ability to influence one or more of a variety of operating parameters, which may include without limitation any of causing the heater to be turned on and/or off, adjusting a minimum and/or maximum temperature to which the heater is heated during operation, various games or other interactive features that a user might access on a device, and/or other operations.

Various vaporizable materials having a variety of contents and proportions of such contents can be contained in the cartridge. Some vaporizable materials, for example, may have a smaller percentage of active ingredients per total volume of vaporizable material, such as due to regulations requiring certain active ingredient percentages. As such, a user may need to vaporize a large amount of vaporizable material (e.g., compared to the overall volume of vaporizable material that can be stored in a cartridge) to achieve a desired effect.

SUMMARY

In certain aspects of the current subject matter, challenges associated with the presence of liquid vaporizable materials in or near certain susceptible components of an electronic vaporizer device may be addressed by inclusion of one or more of the features described herein or comparable/equivalent approaches as would be understood by one of ordinary skill in the art.

In one aspect, there is provided a vaporizer cartridge having a cartridge housing, a reservoir, a heating element, and wicking element. The cartridge housing may include a first housing segment coupled with a second housing segment. At least a portion of the cartridge housing may form a wick housing. The reservoir may be disposed within the cartridge housing. The reservoir may include a storage chamber and a collector. The collector may include an overflow channel configured to retain a volume of a vaporizable material in fluid contact with the storage chamber. The overflow channel may include one or more microfluidic features configured to provide a constriction point at which a meniscus forms. The meniscus may create a pressure differential between the reservoir and ambient pressure. The meniscus may further regulate an exchange of air and the vaporizable material into and out of the reservoir. The heating element may include a heating portion disposed at least partially inside the wick housing and a contact portion extending at least partially outside of the wick housing. The contact portion may include one or more cartridge contacts configured to form an electric coupling with one or more contacts in the vaporizer device. The wicking element may be disposed at least partially inside the wick housing and proximate to the heating portion of the heating element. The wicking element may be in fluid communication with the reservoir. The wicking element may be configured to draw the vaporizable material from the reservoir for vaporization by the heating element.

In some variations, one or more features disclosed herein including the following features can optionally be included in any feasible combination. The collector may be disposed between the first housing segment and the second housing segment.

In some variations, the first housing segment may include a first portion of the collector. The second housing segments may include a second portion of the collector.

In some variations, the first housing segment and the second housing segment may be joined by one or more of an adhesive, ultrasonic welding, electron beam welding, and laser beam welding.

In some variations, the first housing segment and the second housing segment may be joined by a laser beam forming a laser weld between the first housing segment and the second housing segment.

In some variations, the first housing segment may be formed from a first material that is transparent to the laser beam. The second housing segment may be formed from a second material that is opaque to the laser beam. The laser beam may penetrate the first housing segment to form the laser weld by melting the second housing segment.

In some variations, the first housing segment and the second housing segment may be formed from a first material that is transparent to the laser beam. A film of a second material that is opaque to the laser beam may be disposed between the first housing segment and the second housing segment. The laser beam may penetrate the first housing segment or the second housing segment to form the laser weld by melting the film disposed between the first housing segment and the second housing segment.

In some variations, a portion of the cartridge may be a male connector configured to be disposed at least partially inside a receptacle in a body of the vaporizer device.

In some variations, the male connector may include at least a portion of the wick housing.

In some variations, the cartridge may include a sleeve extending at least partially over and/or around the male connector. The sleeve may extend below an open top of the receptacle to at least partially enclose the receptacle when the cartridge is coupled with the body of the vaporizer device.

In some variations, a recessed area may be formed between the sleeve and the body of the vaporizer device when the cartridge is coupled with the body of the vaporizer device. The receptacle may include one or more air inlets configured to provide airflow to the cartridge coupled with the body of the vaporizer device. The one or more air inlets in the receptacle may be disposed within the recessed area when the cartridge is coupled with the body of the vaporizer device.

In some variations, a portion of the cartridge may be a female connector configured to couple with a protrusion in a body of the vaporizer device.

In some variations, the contact portion may be further configured to form a mechanical coupling with a receptacle of the vaporizer device. The mechanical coupling may secure the cartridge to the receptacle of the vaporizer device.

In some variations, the wick housing may include one or more vents configured to provide airflow to the wicking element.

In some variations, the cartridge may include an airflow passageway connecting the wick housing to an orifice in the cartridge that provides an outlet for an aerosol that is formed by the heating element vaporizing the vaporizable material.

In some variations, an interior surface of the airflow passageway may include one or more features configured to collect a condensate formed by the aerosol and direct at least a portion the collected condensate towards the wicking element.

In some variations, the airflow passageway may include one or more impact plates configured to collect a condensate formed by the aerosol.

In some variations, the airflow passageway may further include a fluid return formed from a porous material. The fluid return may be configured to absorb the condensate collected by the one or more impact plates and direct the condensate to the reservoir.

In some variations, the cartridge may further include a sponge disposed proximate to an interface between the airflow passageway and the orifice. The sponge may be configured to filter a condensate formed by the aerosol.

In some variations, the cartridge may further include an intake slot through which air enters the airflow passageway in response to air being drawn into the cartridge.

In some variations, the cartridge may further include an air intake flap configured to admit the air into the airflow passageway while preventing an egress of the vaporizable material from the intake slot.

In some variations, the air intake flap in an undeflected state may cover the intake slot to prevent the egress of the vaporizable material from the intake slot. The air intake flap may be configured to deflect in response to the air being drawn into the cartridge through the intake slot. The intake slot may be at least partially uncovered while the air intake flap is in a deflected state to admit air into the airflow passageway.

In some variations, the one or more microfluidic features may include one or more bumps, raised edges, and/or protrusions extending from an interior surface of the overflow channel.

In some variations, the one or more microfluidic features may include one or more spirals, curves, bends, tapers, slopes, and/or turns along a length of the overflow channel.

In some variations, the heating element may include a substrate material that is cut and folded to form the heating portion of the heating element and the contact portion of the heating element. The heating portion of the heating element may be configured to receive at least a portion of the wicking element.

In some variations, an interior surface of the wicking housing may include at least one channel extending from the storage chamber to the wick housing. The at least one channel may be configured to route the vaporizable material in the storage chamber to the wicking element.

In some variations, the at least one channel may be configured to route the vaporizable material to one or more portions of the wicking element disposed proximate to the heating portion of the heating element.

In some variations, the vaporizable material may enter the overflow channel through a first opening at a first end of the overflow channel. Air may enter the overflow channel through a second opening at a second end of the overflow channel.

In some variations, the first opening may be disposed proximate to the wick element to at least minimize a hydrostatic head between the wicking element and the storage chamber.

In some variations, a lip may be disposed at least partially around perimeter of the wick housing. The lip may provide a capillary break preventing a contact between the vaporizable material and a body of the vaporizer device by at least forming a gap between the wick housing and the body of the vaporizer device when the cartridge is coupled with the body of the vaporizer device.

In another aspect, there is provided a vaporizer cartridge having a cartridge housing, a reservoir, a heating element, a wicking element, and a diaphragm. The cartridge housing may include a first housing segment coupled with a second housing segment. The reservoir may be configured to store a vaporizable material. The wicking element may be disposed proximate to the heating element. The wicking element may be in fluid communication with the reservoir. The wicking element may be configured to draw the vaporizable material from the reservoir for vaporization by the heating element. The diaphragm may be coupled to the first housing segment and have a first side defining a wall of the reservoir. The diaphragm may be configured to prevent the vaporizable material from leaking through the wicking element by at least exerting a pulling force against the vaporizable material in the reservoir.

In some variations, one or more features disclosed herein including the following features can optionally be included in any feasible combination. The diaphragm may be configured to distend in response to the vaporizable material being drawn from the reservoir and air entering a pocket between a second side of the diaphragm and the first housing segment through an air inlet in the first housing segment. The diaphragm may distend in order to maintain pulling force exerted against with the vaporizable material remaining in the reservoir.

In some variations, the air inlet may include an aperture in the first housing segment.

In some variations, the air inlet may include a channel configured to enable airflow while minimizing a transmission of vapor.

In some variations, the channel may include a groove in the first housing segment that is covered by a barrier coupled to the first housing.

In some variations, the barrier may include a metallized film that is coupled to the first housing segment by heating staking and/or laser welding.

In some variations, the diaphragm may be formed from an elastic material comprising a natural rubber, a synthetic rubber, a nitrile rubber, a silicone rubber, a urethane rubber, a chloroprene rubber, and/or an ethylene vinyl acetate (EVA) rubber.

In some variations, the diaphragm may be coupled to the first housing segment by a fluid tight seal.

In some variations, the fluid tight seal may include a laser weld formed around a perimeter of the diaphragm.

In some variations, the diaphragm may maintain a pressure within the reservoir below an ambient pressure.

In some variations, the cartridge may further include a controlled orifice configured to admit air into the reservoir when a pressure within the reservoir is a threshold quantity below an ambient pressure.

In some variations, the diaphragm may be in an undistended state or a minimally distended state while an initial volume of the vaporizable material is included in the reservoir.

In some variations, the diaphragm may be preset to prevent the diaphragm from distending without the vaporizable material being drawn from the reservoir.

In some variations, the diaphragm may be preset by removing a portion of the initial volume of the vaporizable material to cause the diaphragm to transition from the undistended state or the minimally distended state to a distended state.

In some variations, the cartridge may further include a preload configured to impose one or more limits on a position of the diaphragm within the cartridge housing.

In some variations, the preload may include a spring exerting a pressure against the diaphragm. The pressure may preset the diaphragm to a minimally distended position.

In some variations, the preload may include a backstop protruding from the second housing segment. The backstop may be configured to prevent the diaphragm from distending beyond a maximally distended position.

In some variations, the preload may include one or more projections on a surface of the diaphragm. The one or more projections may be configured to prevent the diaphragm from distending beyond a maximally distended position.

The details of one or more variations of the subject matter described herein are set forth in the accompanying drawings and the description below. Other features and advantages of the subject matter described herein will be apparent from the description and drawings, and from the claims.

BRIEF DESCRIPTION OF THE DRAWINGS

The accompanying drawings, which are incorporated in and constitute a part of this specification, show certain aspects of the subject matter disclosed herein and, together with the description, help explain some of the principles associated with the disclosed implementations. In the drawings.

When practical, similar reference numbers denote similar structures, features, or elements.

DETAILED DESCRIPTION

Figure 1:
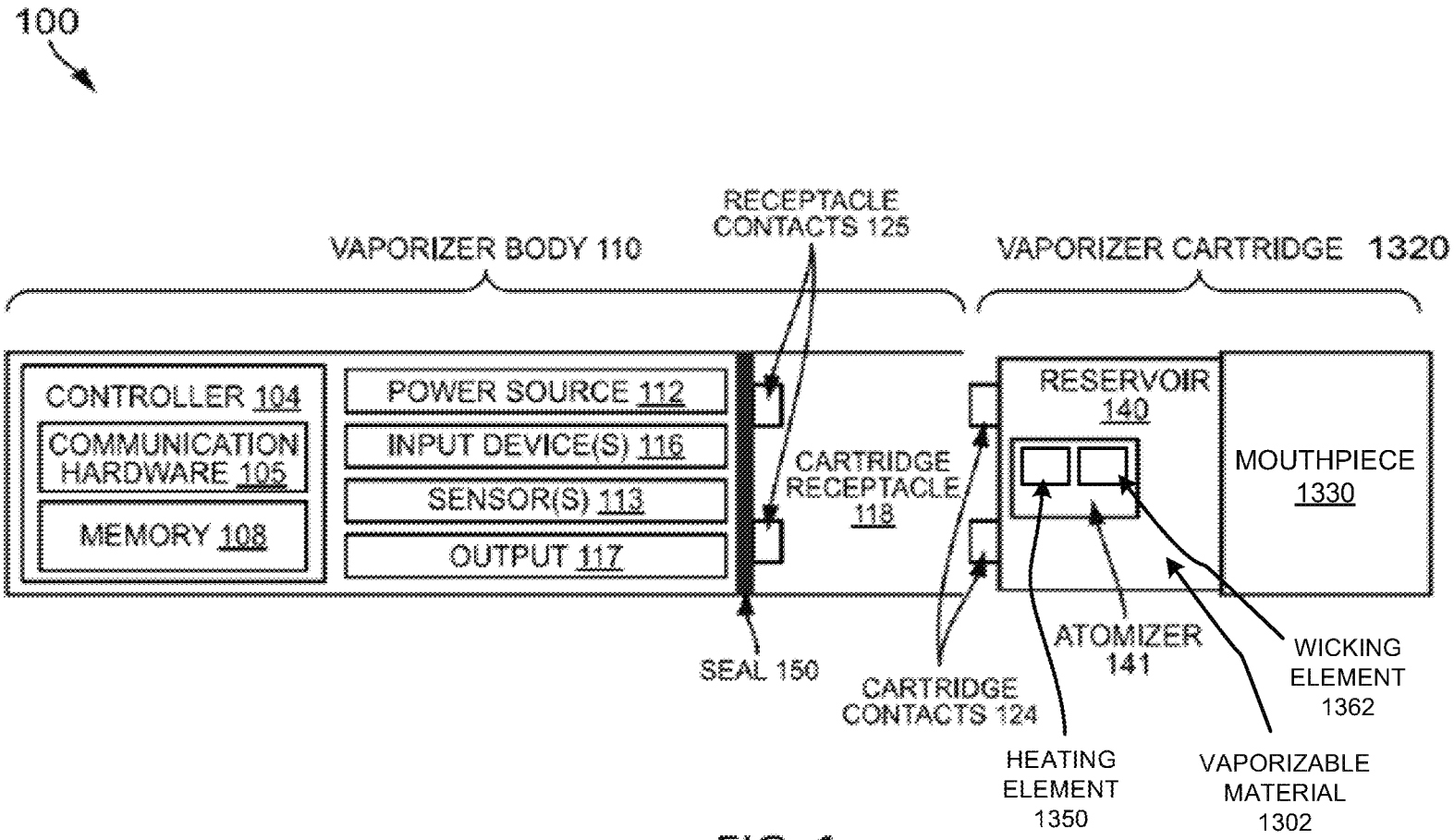
FIG. 1 depicts a block diagram illustrating an example of a vaporizer device consistent with implementations of the current subject matter.

Implementations of the current subject matter include devices relating to vaporizing of one or more vaporizable materials for inhalation by a user. Examples of vaporizer devices consistent with implementations of the current subject matter include electronic vaporizers, electronic cigarettes, e-cigarettes, or the like. The vaporizable material used with a vaporizer may optionally be provided within a cartridge (e.g., a part of the vaporizer that contains the vaporizable material in a reservoir or other container and that can be refillable when empty or disposable in favor of a new cartridge containing additional vaporizable material of a same or different type). A vaporizer device may be a cartridge-using vaporizer device, a cartridge-less vaporizer device, or a multi-use vaporizer device capable of use with or without a cartridge. For example, a multi-use vaporizer may include a heating chamber (e.g., an oven) configured to receive a vaporizable material directly in the heating chamber and also to receive a cartridge or other replaceable device having a reservoir, a volume, or the like for at least partially containing a usable amount of vaporizable material.

In various implementations, a vaporizer device may be configured for use with liquid vaporizable material (e.g., a carrier solution in which an active and/or inactive ingredient (s) are suspended or held in solution or a neat liquid form of the vaporizable material itself) or a solid vaporizable material. A solid vaporizable material may include a plant material that emits some part of the plant material as the vaporizable material (e.g., such that some part of the plant material remains as waste after the vaporizable material is emitted for inhalation by a user) or optionally can be a solid form of the vaporizable material itself (e.g., a "wax") such that all of the solid material can eventually be vaporized for inhalation. A liquid vaporizable material can likewise be capable of being completely vaporized or can include some part of the liquid material that remains after all of the material suitable for inhalation has been consumed.

In some aspects, leakage of liquid vaporizable material out of the vaporizer cartridge and/or other part of a vaporizer may occur. Additionally, consistency of manufacturing quality of a heating element of the vaporizer may be especially important during scaled and/or automated manufacturing processes. Further, vaporizer use may operate with particular power requirements that may result in shorter battery run time, can result in shorter run time at lower temperatures, can result in faster battery aging, and may affect battery performance.

Implementations of the current subject matter may also provide advantages and benefits in regard to these issues. For example, various features are described herein for controlling airflow as well as flow of the vaporizable material, which may provide advantages and improvements relative to existing approaches, while also introducing additional benefits as described herein. Examples of the vaporizer device and/or vaporizer cartridge described herein include one or more features that control and improve airflow in the vaporization device and/or vaporizer cartridge. Moreover, the vaporizer device and/or vaporizer cartridge described herein can include one or more features for preventing the leakage of the vaporizable material and the accumulation of condensate, for example, along the internal channels and outlets of the vaporizer device and/or vaporizer cartridge. These features may improve the efficiency and effectiveness of the vaporizer device in vaporizing the vaporizable material included in the vaporizer cartridge.

FIG. 1 depicts a block diagram illustrating an example of a vaporizer device 100 consistent with implementations of the current subject matter. Referring to FIG. 1, the vaporizer device 100 may include a power source 112 (e.g., a non-rechargeable primary battery, a rechargeable secondary battery, a fuel cell, and/or the like) and a controller 104 (e.g., a processor, circuitry, etc. capable of executing logic). The controller 104 may be configured to control the delivery of heat to an atomizer 141 to cause at least a portion of a vaporizable material 1302 included in the reservoir 140 to be converted from a condensed form (e.g., a solid, a liquid, a solution, a suspension, a part of an at least partially unprocessed plant material, etc.) to a gas phase. For example, the controller 104 may control the delivery of heat to the atomizer 141 by at least controlling a discharge of current from the power source 112 to the atomizer 141. The controller 104 may be part of one or more printed circuit boards (PCBs) consistent with certain implementations of the current subject matter.

After conversion of the vaporizable material 1302 to the gas phase, and depending on the type of vaporizer, the physical and chemical properties of the vaporizable material 1302, and/or other factors, at least some of the gas-phase vaporizable material 1302 may condense to form particulate matter in at least a partial local equilibrium with the gas phase as part of an aerosol. The vaporizable material 1302 in the condensed phase (e.g., the particulate matter) in at least partial local equilibrium with the vaporizable material 1302 in the gas phase may form some or all of an inhalable dose provided by the vaporizer device 100 for a given puff or draw on the vaporizer device 100. It will be understood that the interplay between the vaporizable material 1302 in the gas phase and in the condensed phase in an aerosol generated by the vaporizer device 100 can be complex and dynamic, as factors such as ambient temperature, relative humidity, chemistry, flow conditions in airflow paths (both inside the vaporizer and in the airways of a human or other animal), mixing of the gas-phase or aerosol-phase vaporizable material 1302 with other air streams, etc. may affect one or more physical parameters of an aerosol. In instances where the vaporizable material 1302 is volatile, the inhalable dose may exist predominantly in the gas phase (i.e., formation of condensed phase particles may be very limited).

To enable the vaporizer device 100 to be used with liquid formulations of the vaporizable material 1302 (e.g., neat liquids, suspensions, solutions, mixtures, etc.), the atomizer 141 may include a heating element 1350 as well as a wicking element 1362 (also referred to herein as a wick) formed from one or more materials capable of causing fluid motion by capillary pressure. The wicking element 1362 may convey a quantity of the liquid vaporizable material 1302 to a part of the atomizer 141 that includes the heating element 1350. The wicking element 1362 is generally configured to draw the liquid vaporizable material 1302 from the reservoir 140 containing the liquid vaporizable material 1302 such that the liquid vaporizable material 1302 may be vaporized by heat generated by the heating element 1350. Air may enter the reservoir 140 to replace the volume of liquid vaporizable material 1302 drawn out of the reservoir 140, for example, by the wicking element 1362. In other words, capillary action may pull liquid vaporizable material 1302 into the wicking element 1362 for vaporization by heat generated by the heating element 1350, and air may, in some implementations of the current subject matter, return to the reservoir 140 to at least partially equalize pressure in the reservoir 140. Various approaches for allowing air to enter the reservoir 140 to equalize pressure are within the scope of the current subject matter as discussed in greater detail below.

The heating element 1350 can be or include one or more of a conductive heater, a radiative heater, and a convective heater. One example of the heating element 1350 is a resistive heating element, which can be constructed of or at least include a material (e.g., a metal or alloy, for example a nickel-chromium alloy, or a non-metallic resistor) configured to dissipate electrical power in the form of heat when electrical current is passed through one or more resistive segments of the heating element 1350. In some implementations of the current subject matter, the heating element 1350 can configured to deliver heat to the wicking element 1362, for example, by being wrapped at least partially around, positioned at least partially within, at least partially integrated into a bulk shape of, and/or positioned in at least partial thermal contact with the wicking element 1362. Heat delivered to the wicking element 1362 may cause at least a portion of the liquid vaporizable material 1302 drawn into the wicking element 1362 from the reservoir 140 to be vaporized for subsequent inhalation by a user in a gas phase and/or a condensed (e.g., aerosol particles or droplets) phase. As discussed further below, the wicking element 1362 and the heating element 1350 may be configured in various manners in order to form the atomizer 141.

Alternatively and/or additionally, the vaporizer device 100 may also be configured to heat a non-liquid formulation of the vaporizable material 1302 to generate an inhalable dose of the vaporizable material 1302 in a gas-phase and/or an aerosol-phase. Examples of non-liquid formulations of the vaporizable material 1302 include a solid-phase vaporizable material (e.g., a wax or the like) or a plant material (e.g., tobacco leaves and/or parts of tobacco leaves). Accordingly, the heating element 1350 may be part of or otherwise incorporated into or in thermal contact with the walls of a heating chamber (e.g., an oven and/or the like) into which the non-liquid vaporizable material 1302 is placed. Alternatively, the heating element 1350 may be used to heat air passing through or past the non-liquid vaporizable material 1302 to cause convective heating of the non-liquid vaporizable material 1302. In still other examples, the heating element 1350 may be a resistive heating element disposed in intimate contact with non-liquid vaporizable material 1302 such that direct conductive heating of the non-liquid vaporizable material 1302 occurs from within a mass of the non-liquid vaporizable material 1302 (e.g., as opposed to by conduction inward from the walls of a heating chamber).

To vaporize the vaporizable material 1302, the vaporizer device 100 may deliver, to the heating element 1350, electrical power from the power source 112 (e.g., a battery and/or the like). The delivery of electrical power to the heating element 1350 may be controlled by the controller 104. For example, electrical power may be delivered to the heating element 1350 by discharging a current from the power source 112 through a circuit including the heating element 1350. The controller 104 may activate the heating element 1350, for example, by causing the power source 112 to deliver electrical power (e.g., discharge current) to the heating element 1350, in response to a user puffing (e.g., drawing, inhaling, and/or the like) on a mouthpiece 1330 of the vaporizer device 100. The user puffing on the mouthpiece of the vaporizer device 100 may cause air to flow from an air inlet, along an airflow path that traverses the atomizer 141 including the heating element 1350 and the wicking element 1362, and optionally through one or more condensation areas or chambers, to an air outlet in the mouthpiece 1330. Incoming air passing along the airflow path may pass over or through the atomizer 141, where the vaporizable material 1302 in the gas phase may be entrained into the air. As noted above, the entrained gas-phase vaporizable material 1302 may condense as it passes through the remainder of the airflow path such that an inhalable dose of the vaporizable material 1302 in an aerosol form can be delivered from the air outlet disposed in the mouthpiece 1330 for inhalation by a user.

The heating element 1350 can be activated in response to a user puffing (i.e., drawing, inhaling, etc.) on a mouthpiece 1330 of the vaporizer device 100 to cause air to flow from an air inlet, along an airflow path that passes the atomizer 141 including the wicking element 1362 and the heating element 1350. Optionally, air can flow from an air inlet through one or more condensation areas or chambers, to an air outlet in the mouthpiece 1330. Incoming air moving along the airflow path moves over or through the atomizer 141, where the vaporizable material 1302 in the gas phase is entrained into the air. The heating element 1350 can be activated via the controller 104, which can optionally be a part of a vaporizer body 110 as discussed herein, causing current to pass from the power source 112 through a circuit including the heating element 1350. Although shown as a part of a vaporizer cartridge 1320, it should be appreciated that the at least a portion of the atomizer 141 including the heating element 1350 may also be disposed in the vaporizer body 110. As noted herein, the entrained vaporizable material 1302 in the gas phase can condense as it passes through the remainder of the airflow path such that an inhalable dose of the vaporizable material 1302 in an aerosol form can be delivered from the air outlet (for example, the mouthpiece 1330) for inhalation by a user.

The heating element 1350 may be activated by the controller 104 in response to the controller detecting an occurrence (or an imminent occurrence) of a puff based on one or more signals received from the sensors 113. The sensors 113 can include one or more of a pressure sensor configured to detect pressure along the airflow path and/or an ambient pressure, a motion sensor (e.g., an accelerometer) configured to detect a movement of the vaporizer device 100, a flow sensor, a capacitive sensor configured to detect interaction between a user and the vaporizer device 100, and/or the like. Alternatively and/or additionally, the occurrence of a puff and/or the imminent occurrence of a puff may be detected based on a user interaction with one or more input devices 116 (e.g., buttons or other tactile control devices of the vaporizer device 100), one or more signals from a computing device in communication with the vaporizer device 100, and/or the like.

In some implementations of the current subject matter, the vaporizer device 100 may be configured to connect (e.g., wirelessly or via a wired connection) to a computing device (or optionally two or more devices) in communication with the vaporizer. To this end, the controller 104 may include communication hardware 105. The controller 104 may also include a memory 108. A computing device can be a component of a vaporizer system that also includes the vaporizer device 100, and can include its own communication hardware, which can establish a wireless communication channel with the communication hardware 105 of the vaporizer device 100. For example, a computing device used as part of a vaporizer system may include a general purpose computing device (e.g., a smartphone, a tablet, a personal computer, some other portable device such as a smartwatch, or the like) that executes software to produce a user interface for enabling a user of the device to interact with a vaporizer. In other implementations of the current subject matter, such a device used as part of a vaporizer system can be a dedicated piece of hardware such as a remote control or other wireless or wired device having one or more physical or soft (e.g., configurable on a screen or other display device and selectable via user interaction with a touch-sensitive screen or some other input device like a mouse, pointer, trackball, cursor buttons, or the like) interface controls. As shown in FIG. 1, the vaporizer device 100 can also include one or more output 117 features or devices for providing information to the user.

A computing device that is part of a vaporizer system as defined above can be used for any of one or more functions, such as controlling dosing (e.g., dose monitoring, dose setting, dose limiting, user tracking, etc.), controlling sessioning (e.g., session monitoring, session setting, session limiting, user tracking, etc.), controlling nicotine delivery (e.g., switching between nicotine and non-nicotine vaporizable material, adjusting an amount of nicotine delivered, etc.), obtaining locational information (e.g., location of other users, retailer/commercial venue locations, vaping locations, relative or absolute location of the vaporizer itself, etc.), vaporizer personalization (e.g., naming the vaporizer, locking/password protecting the vaporizer, adjusting one or more parental controls, associating the vaporizer with a user group, registering the vaporizer with a manufacturer or warranty maintenance organization, etc.), engaging in social activities (e.g., games, social media communications, interacting with one or more groups, etc.) with other users, or the like. The terms "sessioning", "session", "vaporizer session," or "vapor session," are used generically to refer to a period devoted to the use of the vaporizer. The period can include a time period, a number of doses, an amount of vaporizable material, and/or the like.

In the example in which a computing device provides signals related to activation of the heating element 1350, or in other examples of coupling of a computing device with the vaporizer device 100 for implementation of various control or other functions, the computing device may execute one or more computer instructions sets to provide a user interface and underlying data handling. In one example, detection by the computing device of user interaction with one or more user interface elements can cause the computing device to signal the vaporizer device 100 to activate the heating element 1350, either to a full operating temperature for creation of an inhalable dose of vapor/aerosol. Other functions of the vaporizer may be controlled by interaction of a user with a user interface on a computing device in communication with the vaporizer device 100.

The temperature of the heating element 1350 of the vaporizer device may depend on a number of factors, including an output voltage of the power source 112, a duty cycle at which the electrical power is delivered, conductive heat transfer to other parts of the electronic vaporizer and/or to the environment, latent heat losses due to vaporization of the vaporizable material 1302 from the wicking element 1362 and/or the atomizer 141 as a whole, and convective heat losses due to airflow (e.g., air moving across the heating element 1350 or the atomizer 141 as a whole when a user inhales on the electronic vaporizer). As noted above, to reliably activate the heating element 1350 or heat the heating element 1350 to a desired temperature, the controller 104 may use signals from the one or more sensors 113 that indicate a pressure in the airflow path, an ambient pressure, and/or the like. In order to determine the pressure in the airflow path, the one or more sensors 113 may include at least one pressure sensor disposed along in the airflow path. Alternatively and/or additionally, the at least one pressure sensor may also be connected (e.g., by a passageway or other path) to the airflow path connecting an inlet for air to enter the vaporizer device 100 and an outlet via which the user inhales the resulting vapor and/or aerosol such that the pressure sensor is able to detect pressure changes concurrently with air passing through the vaporizer device 100 from the air inlet to the air outlet. In some implementations of the current subject matter, the controller 104 may activate the heating element 1350 in response to one or more signals from the pressure sensor indicating a pressure change in the airflow path and/or a greater than threshold difference between a pressure in the airflow path and an ambient pressure.

Typically, the sensors 113 (e.g., the pressure sensor, the motion sensor, the capacitive sensor, and/or the like) be positioned on or coupled (e.g., electrically or electronically connected, either physically or via a wireless connection) to the controller 104 (e.g., a printed circuit board assembly or other type of circuit board). To take measurements accurately and maintain durability of the vaporizer device 100, a resilient seal 150 may optionally separate an airflow path from other parts of the vaporizer device 100. The seal 150, which can be a gasket, may be configured to at least partially surround the pressure sensor such that connections of the pressure sensor to internal circuitry of the vaporizer device 100 are separated from a part of the pressure sensor exposed to the airflow path. In instances where the vaporizer device 100 is configured to couple to a vaporizer cartridge 1320, the seal 150 may also separate parts of one or more electrical connections between a vaporizer body 110 and the vaporizer cartridge 1320 from one or more other parts of the vaporizer body 110. Such arrangements of the seal 150 in the vaporizer device 100 can be helpful in mitigating against potentially disruptive impacts on vaporizer components resulting from interactions with environmental factors such as water in the vapor or liquid phases, other fluids such as the vaporizable material 1302, etc. and/or to reduce escape of air from the designed airflow path in the vaporizer device 100. Unwanted air, liquid or other fluid passing and/or contacting circuitry of the vaporizer device 100 can cause various unwanted effects, such as alter pressure readings, and/or can result in the buildup of unwanted material, such as moisture, the vaporizable material 1302, etc. in parts of the vaporizer where they may result in poor pressure signal, degradation of the pressure sensor or other components, and/or a shorter life of the vaporizer device 100. Leaks in the seal 150 can also result in a user inhaling air that has passed over parts of the vaporizer device 100 containing or constructed of materials that may not be desirable to be inhaled.

The vaporizer device 100 may be, as noted, a cartridge-based vaporizer configured to couple with, for example, the vaporizer cartridge 1320. Accordingly, in addition to the controller 104, the power source 112 (e.g., battery), the one more sensors 113, one or more cartridge contacts 124, and the seal 150, FIG. 1 show the vaporizer body 110 of the vaporizer device 100 as including a cartridge receptacle 118 configured to receive at least part of the vaporizer cartridge 1320 for coupling with the vaporizer body 110 through one or more of a variety of attachment structures. As noted, the vaporizer cartridge 1320 may include the reservoir 140 for containing the vaporizable material 1302 and the mouthpiece 1330 for delivering an inhalable dose to a user. The atomizer 141 including, for example, the wicking element 1362 and the heating element 1350, may be disposed at least partially within the vaporizer cartridge 1320. Optionally, the heating element 1350 and/or the wicking element 1362 can be disposed within the vaporizer cartridge 1320 such that walls enclosing the cartridge receptacle 118 surround all or at least part of the heating element 1350 and/or the wicking element 1362 when the vaporizer cartridge 1320 is fully connected to the vaporizer body 110.

In some implementations of the current subject matter, the portion of the vaporizer cartridge 1320 that inserts into the cartridge receptacle 118 of the vaporizer body 110 may be positioned internal to another part of the vaporizer cartridge 1320. For example, the insertable part of the vaporizer cartridge 1320 may be at least partially surrounded by some other part, such as for example a housing and/or an outer shell, of the vaporizer cartridge 1320.

Alternatively, at least a portion of the atomizer 141 (e.g., one or both of the wicking element 1362 and the heating element 1350) may be disposed in the vaporizer body 110 of the vaporizer device 100. In implementations in which a portion of the atomizer 141 (e.g., the heating element 1350 and/or the wicking element 1362) is part of the vaporizer body 110, the vaporizer device 100 can be configured to deliver at least the vaporizer material 1302 from the reservoir 140 in the vaporizer cartridge 1320 to the portions of the atomizer 141 included in the vaporizer body 110.

As mentioned above, removal of the vaporizable material 1302 from the reservoir 140 (e.g., via capillary draw by the wicking element 1362) can create, in the reservoir 140, at least a partial vacuum (e.g., a reduced pressure created in a part of the reservoir 140 that has been emptied by consumption of the vaporizable material 1302) relative to ambient air pressure, and such a vacuum may interfere with the capillary action provided by the wicking element 1362. This reduced pressure may, in some examples, be sufficiently large in magnitude to reduce the effectiveness of the wicking element 1362 for drawing liquid vaporizable material 1302, thereby reducing the effectiveness of the vaporizer device 100 to vaporize a desired amount of vaporizable material 1302, such as when a user takes a puff on the vaporizer device 100. In extreme cases, the vacuum created in the reservoir 140 could result in the inability to draw all of the vaporizable material 1302 from the reservoir 140, thereby leading to incomplete usage and waste of the vaporizable material 1302. To prevent the formation of a vacuum, the reservoir 140 may include one or more venting features (regardless of positioning of the reservoir 140 in the vaporizer cartridge 1320 or elsewhere in the vaporizer device 100) to enable at least partial equalizing (optionally completely equalizing) of pressure in the reservoir 140 with ambient pressure (e.g., pressure in ambient air outside of the reservoir 140) to alleviate this issue.

In some cases, while allowing pressure equalization within the reservoir 140 improves efficiency of delivery of the liquid vaporizable material to the atomizer 141, it may do so by causing the otherwise empty void volume (e.g., space emptied by use of the liquid vaporizable material 1302) within the reservoir 140 to be filled with air. As discussed in further detail below, this air-filled void volume may subsequently experience pressure changes relative to ambient air. This pressure change may, under certain conditions, result in the vaporizable material 1302 leaking out of the reservoir 140 and ultimately out of the vaporizer cartridge 1320 and/or other part of the vaporizer device 100 including the reservoir 140. For example, a negative pressure event in which the pressure inside the vaporizer cartridge 1320 is sufficiently high to displace at least a portion of the vaporizable material 1302 in the reservoir 140 may be triggered by various environmental factors such as, for example, a change in ambient temperature, altitude, volume of the vaporizer cartridge 1320 (e.g., the reservoir 140), and/or the like. Implementations of the current subject matter may minimize and/or eliminate the leakage of the vaporizable material 1302 while still providing one or more mechanisms for preventing the formation of a vacuum (or partial vacuum) within the reservoir 140.

Figure 2A:
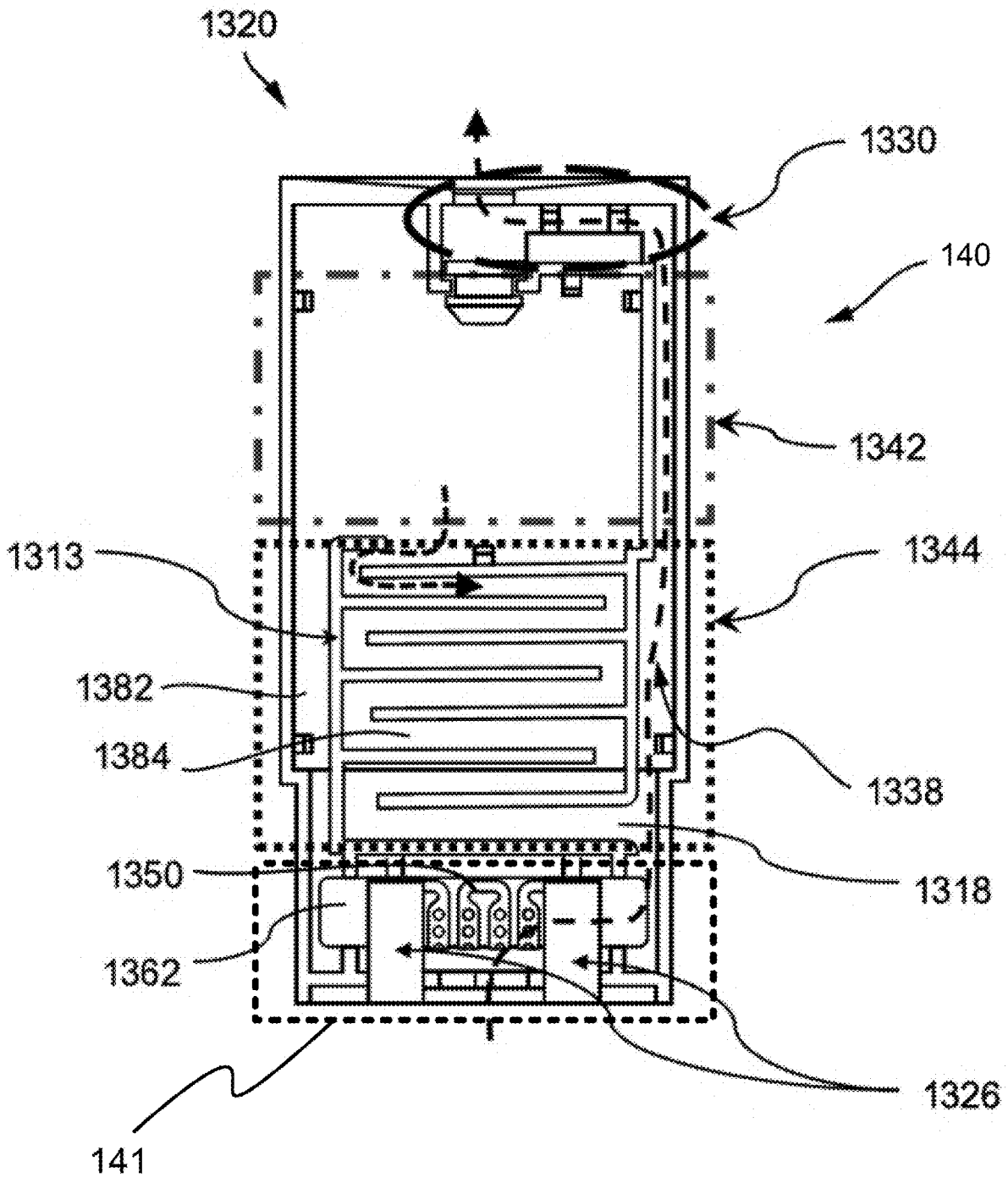
FIG. 2A depicts a planar cross-sectional view of an example of a vaporizer cartridge having a storage chamber and an overflow volume consistent with implementations of the current subject matter.
Figure 2B:
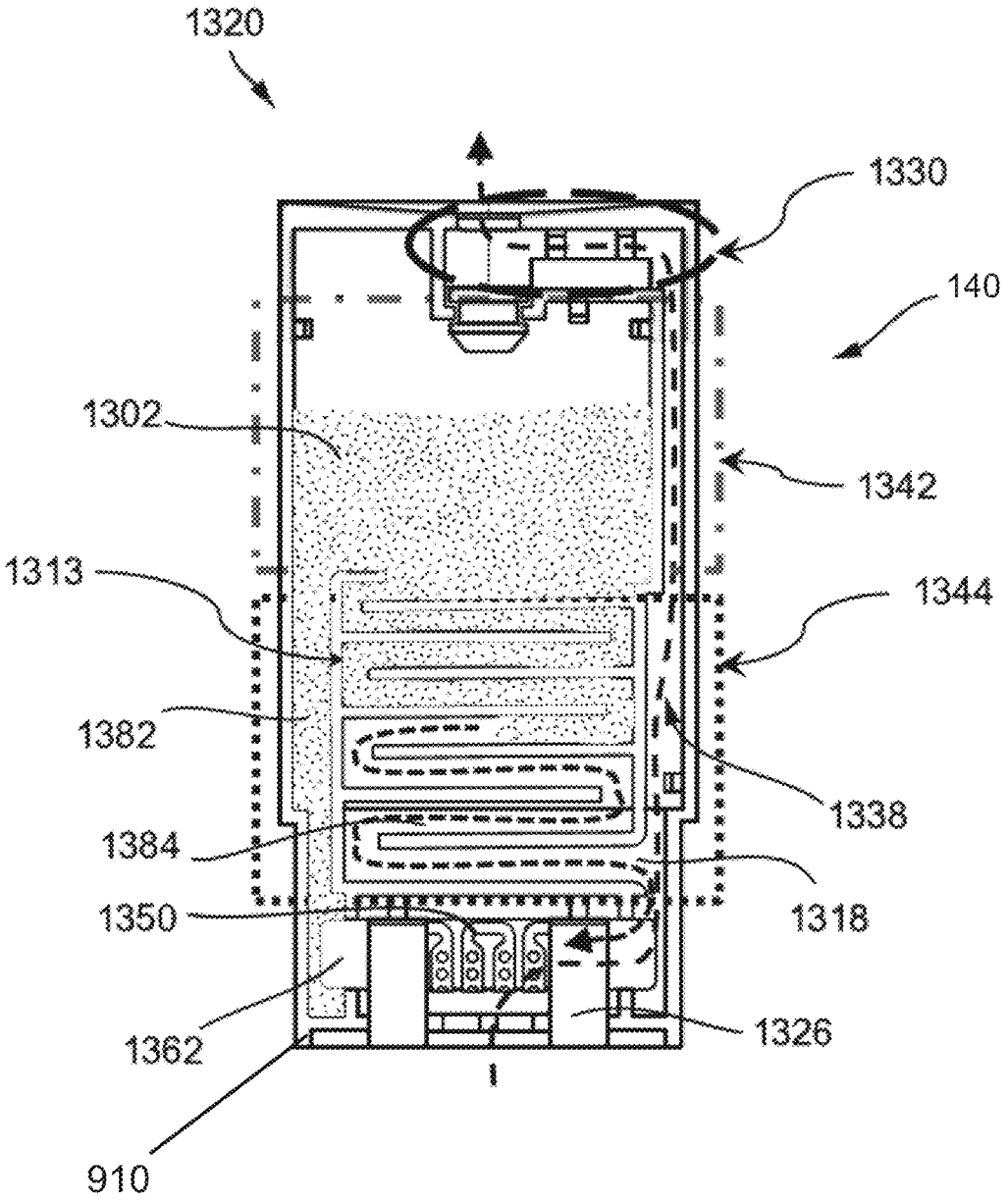
FIG. 2B depicts a planar cross-sectional view of an example of a vaporizer cartridge having a storage chamber and an overflow volume consistent with implementations of the current subject matter.
Figure 2C:
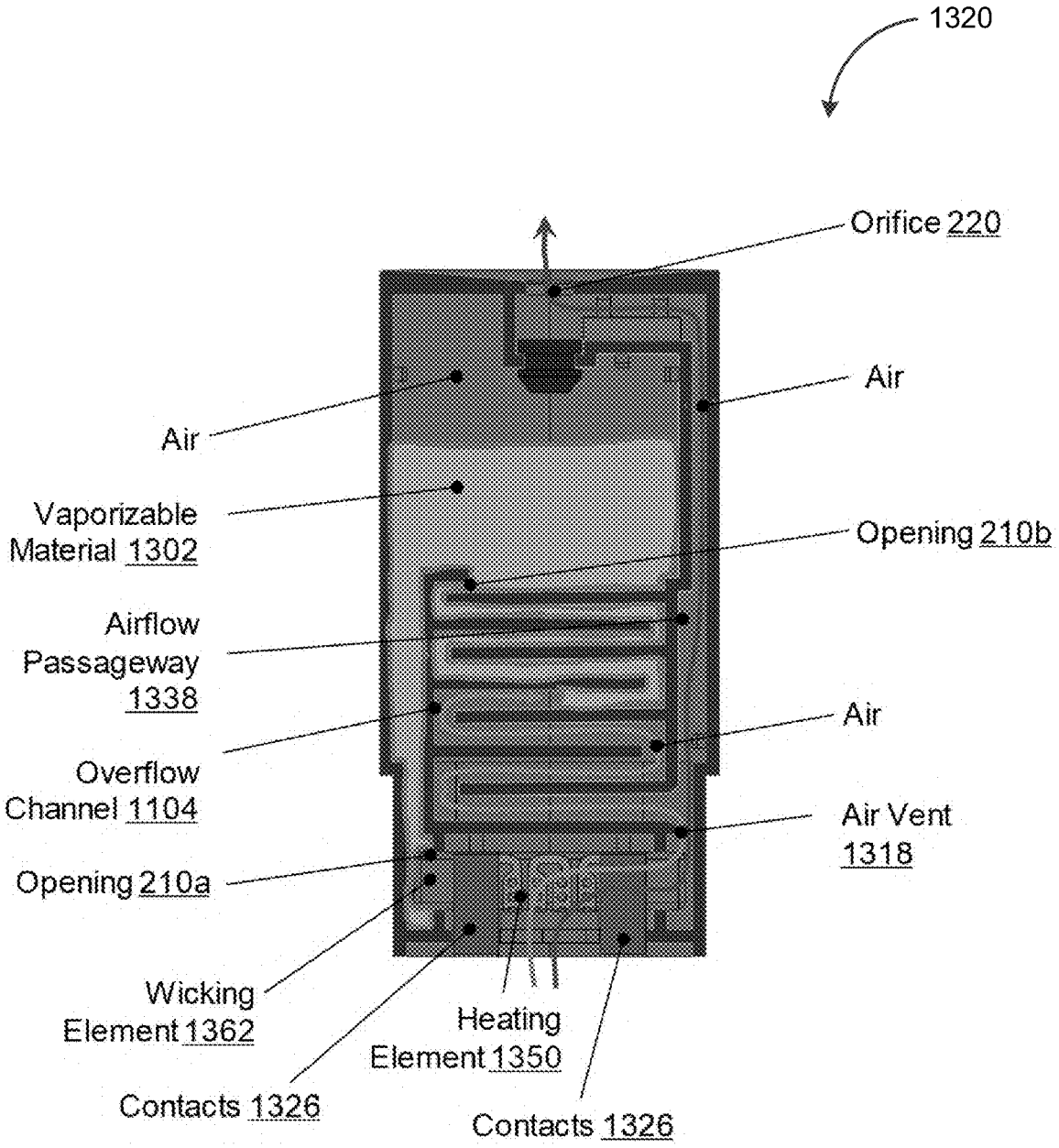
FIG. 2C depicts a planar cross-sectional view of an example of a vaporizer cartridge having a storage chamber and an overflow volume consistent with implementations of the current subject matter.

FIGS. 2A-C depict planar cross-sectional views of an example of the vaporizer cartridge 1320 consistent with implementations of the current subject matter. As shown in FIGS. 2A-C, the vaporizer cartridge 1320 may include the mouthpiece 1330, the reservoir 140 containing the vaporizable material 1302, and the atomizer 141. The atomizer 141 may, as noted, include the heating element 1350 and the wicking element 1362, together or separately, depending on implementation, such that the wicking element 1362 is thermally or thermodynamically coupled to the heating element 1350 for the purpose of vaporizing the vaporizable material 1302 drawn into or stored in the wicking element 1362.

The vaporizer cartridge 1320 may include one or more contacts 1326 configured to provide for an electrical connection between the heating element 1350 and a power source (e.g., the power source 112 shown in FIG. 1). For example, in some implementations of the current subject matter, the one or more contacts 1326 may be formed from a portion of the heating element 1350 that is folded such that the one or more contacts 1326 may be in electrical contact with the receptacle contacts 125 in the vaporizer body 110. The one or more contacts 1326 may also be configured to form a mechanical coupling with the cartridge receptacle 118. An airflow passageway 1338, defined through or on a side of the reservoir 140, may connect an area in the vaporizer cartridge 1320 that houses the wicking element 1362 (e.g., a wick housing 910 and/or the like) to an orifice 220 in the mouthpiece 1330 to provide a route for the vaporized vaporizable material 1302 to travel from the heating element 1350 area and out of the orifice 220 in the mouthpiece 1330.

As provided above, the wicking element 1362 may be coupled to the heating element 1350 (e.g., a resistive heating element or coil) having and/or is coupled to the one or more contacts 1326. It should be appreciated that the heating element 1350 may have various shapes and/or configurations including, for example, one or more shapes and/or configurations in which the heating element 1350 is formed from a substrate material that has been shaped to include a heating portion in contact with the wicking element 1362 as well as a contact portion including the one or more contacts 1326.

In some implementations of the current subject matter, the heating element 1350 of the vaporizer cartridge 1320 may be formed from a sheet of substrate material that is either crimped around at least a portion of the wicking element 1362 or bent to provide the heating portion configured to receive the wicking element 1362. For example, the wicking element 1362 may be pushed into the heating element 1350. Alternatively and/or additionally, the heating element 1350, for example, the heating portion of the heating element 1350, may be held in tension and pulled over the wicking element 1362.

The heating element 1350 may be bent such that the heating element 1350 secures the wicking element 1362 between at least two or three portions of the heating element 1350. Moreover, the heating element 1350 may be bent to conform to a shape of at least a portion of the wicking element 1362. Configurations of the heating element 1350 may allow for more consistent and enhanced quality manufacturing of the heating element 1350. Consistency of manufacturing quality of the heating element 1350 may be especially important during scaled and/or automated manufacturing processes. For example, the heating element 1350 in accordance with one or more implementations may help to reduce tolerance issues that may arise during manufacturing processes when assembling a heating element 1350 having multiple components.

Additionally, discussed further below in regards to an included embodiment relating to a heating element formed of crimped metal, the heating element 1350 may be entirely and/or selectively plated with one or more materials to enhance heating performance of the heating element 1350. Plating all or a portion of the heating element 1350 including, for example, at least a portion of the contact portion of the heating element 1350 including the one or more contacts 1326, may help to minimize heat losses. Plating may also help in concentrating heat to at least a portion of the heating element 1350, thereby increasing the efficiency of heating the heating element 1350 including by reducing heat losses. It should be appreciated that selectively plating some but not all portions of the heating element 1350 may help to direct the current provided to the heating element 1350 to a proper location, for example, the contact portion of the heating element 1350 including the one or more contacts 1326. Selective plating may also help to reduce the amount of plating material and/or costs associated with manufacturing the heating element 1350.

As noted above, the heating element 1350, in some implementations of the current subject matter, may be configured to receive at least a portion of the wicking element 1362 such that the wicking element 1362 is disposed at least partially inside the heating element 1350 (e.g., a heating portion of the heating element 1350). For example, the wicking element 1362 may extend near or next to contacts 1326 and through the heating portion of the heating element 1350 in contact with contacts 1326. The wick housing 910 may surround at least a portion of the heating element 1350 and connect the heating element 1350 directly or indirectly to the airflow passageway 1338. The vaporizable material 1302 may be drawn by the wicking element 1362 through one or more passageways connected to the reservoir 140. For example, as shown in FIG. 2C, the reservoir 140 may include a first opening 210*a* that is in fluid communication with the wicking element 1362 such that the vaporizable material 1302 may be drawn by the wicking element 1362 through at least the first opening 210*a*. In one embodiment, one or both of the primary passageway 1382 or an overflow channel 1104 may be utilized to help route or deliver the vaporizable material 1302 to one or more portions of the wicking element 1362 (e.g., to one or both ends of the wicking element 1362, radially along a length of the wicking element 1362, and/or the like). Moreover, in some implementations of the current subject matter, an interior surface of the wick housing 910 may include one or more fluidic features configured to route and/or deliver the vaporizable material 1302 to one or more portions of the wicking element 1362.

Figure 6:
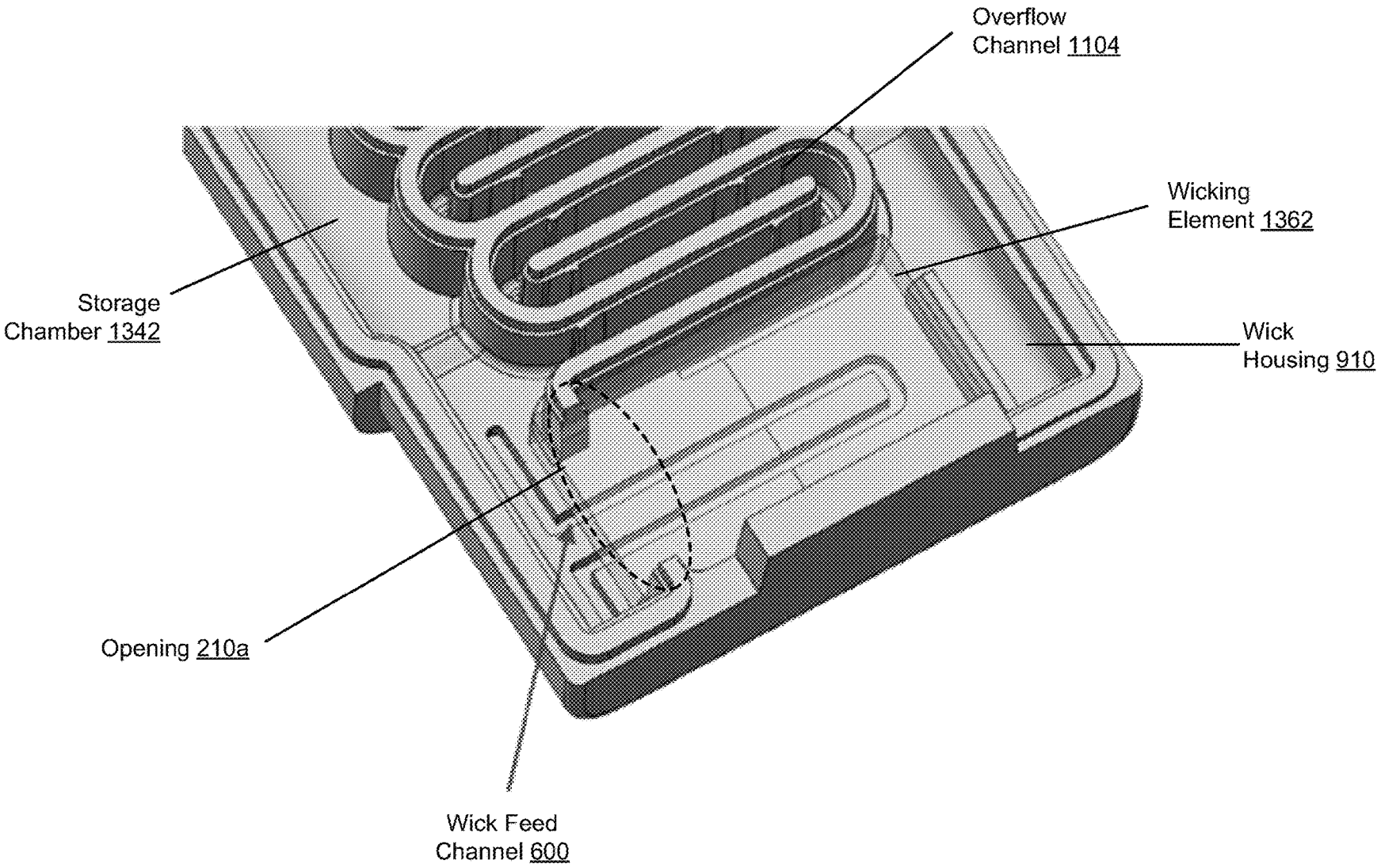
FIG. 6 depicts a perspective view of a cross section of a wick housing consistent with implementations of the current subject matter.

To further illustrate, FIG. 6 depicts a perspective view of a cross section of the wick housing 910 consistent with implementations of the current subject matter. In some implementations of the current subject matter, the wick housing 910 may include one or more wick feed channels configured to route and/or deliver the vaporizable material 1302 to one or more portions of the wicking element 1362. For example, as shown in FIG. 6, the interior surface of the wick housing 910 may include a wick feed channel 600, which may extend from the storage chamber 1342 to an end of the wick housing 910 away from the first opening 210*a* where the wick housing 910 is in fluid communication with the storage chamber 1342. The wick feed channel 600 may be configured to improve the saturation of the wicking element 1362. For instance, the wick feed channel 600 may be shaped and positioned to encourage the delivery of the vaporizable material 1302 to one or more specific portions of the wicking element 1362 such as, for example, one or more portions of the wicking element 1362 adjacent to the heating element 1350.

As provided in further detail below, particularly with reference to FIGS. 2A-B, exchange of air and the vaporizable material 1302 into and out of the reservoir 140 of the vaporizer cartridge 1320 may be advantageously controlled by incorporated a structure referred to as a collector 1313.

The inclusion of the collector 1313 may also improve a volumetric efficiency of the vaporizer cartridge 1320, defined as a volume of liquid vaporizable material that is eventually converted to an inhalable aerosol relative to a total volume of the liquid vaporizable material included in the vaporizer cartridge 1320 (which may correspond to a capacity of the vaporizer cartridge 1320 itself).

Figure 9:
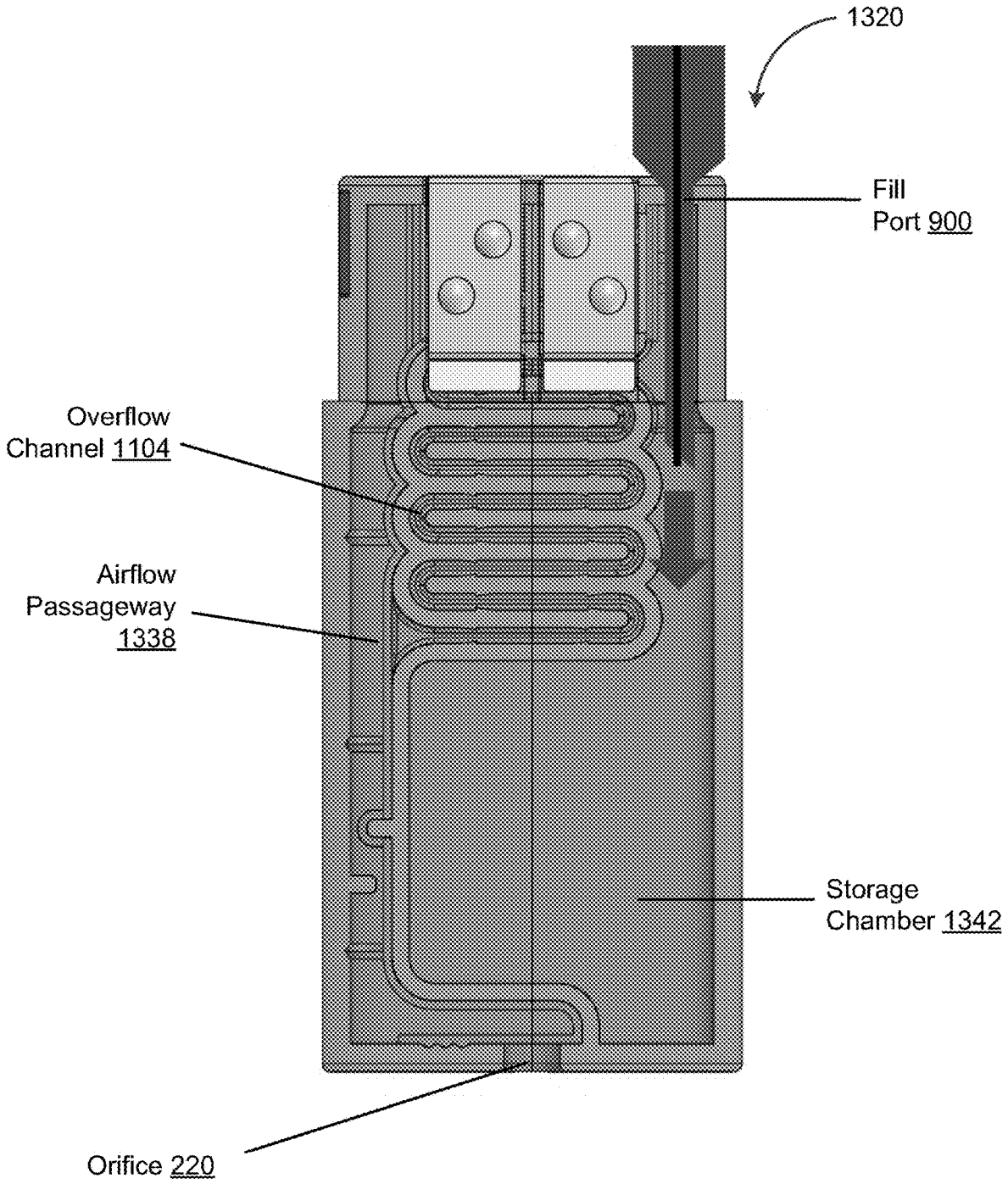
FIG. 9 depicts an example of a technique for filling a vaporizer cartridge consistent with implementations of the current subject matter.

In accordance with some implementations, the vaporizer cartridge 1320 may include the reservoir 140 that is at least partially defined by at least one wall (which can optionally be a wall that is shared with an outer shell of the cartridge) configured to contain a liquid vaporizable material 1302. The reservoir 140 may include a storage chamber 1342 and an overflow volume 1344, which may include or otherwise contain the collector 1313. The storage chamber 1342 may contain the vaporizable material 1302 and the overflow volume 1344 may be configured to collect and/or retain at least a portion of the vaporizable material 1302, when one or more factors cause the vaporizable material 1302 in the reservoir storage chamber 1342 to travel into the overflow volume 1344. In some implementations of the current subject matter, the vaporizer cartridge 1320 may be initially filled with the vaporizable material 1302 such that void space within the collector 1313 is pre-filled with the vaporizable material 1302. FIG. 9 depicts an example of a technique for filling the vaporizer cartridge 1320 with the vaporizable material 1302. As shown in FIG. 9, the vaporizer cartridge 1320 may be filled through a fill port 900 that is subsequently sealed.

In some implementations of the current subject matter, the volumetric size of the overflow volume 1344 may be configured to be equal to, approximately equal to, or greater than the amount of increase in the volume of the content (e.g., vaporizable material 1302 and air) contained in the storage chamber 1342, when the volume of the content in the storage chamber 1342 expands due to a maximum expected change in pressure that the reservoir 140 may undergo relative to an ambient pressure.

Depending on changes in ambient pressure, temperature, and/or other factors, the vaporizer cartridge 1320 may experience a change from a first pressure state to a second pressure state (e.g., a first relative pressure differential between the interior of the reservoir 140 and ambient pressure and a second relative pressure differential between the interior of the reservoir 140 and ambient pressure). For example, in the first pressure state, the pressure inside the reservoir 140 may be less than an ambient pressure external to the reservoir 140. Contrastingly, in the second pressure state, the pressure inside the reservoir 140 may exceed the ambient pressure. When the vaporizer cartridge 1320 is in an equilibrium state, the pressure inside the reservoir 140 may be substantially equal to the ambient pressure external to the reservoir 140.

In some aspects, the overflow volume 1344 may have the air vent 1318 to the exterior of cartridge 1320 and may be in communication with the reservoir storage chamber 1342 so that the overflow volume 1344 may act as a venting channel to provide for the equalization of pressure in the reservoir 140, collect and at least temporarily retain the vaporizable material 1302 entering the overflow volume 1344 (e.g., from the storage chamber 1342 in response to variations in a pressure differential between the storage chamber 1342 and ambient pressure), and/or optionally reversibly return at least a portion of the vaporizable material 1302 collected in the overflow volume 1344.

As used herein, a "pressure differential" may refer to a difference between a pressure within an internal part of the vaporizer cartridge 1320 and an ambient pressure external to the vaporizer cartridge 1320. Drawing the vaporizable material 1302 from the storage chamber 1342 to the atomizer 141 (e.g., the wicking element 1362 and the heating element 1350) for conversion to vapor or aerosol phases may reduce the volume of the vaporizable material 1302 remaining in the storage chamber 1342. Absent a mechanism for returning air into the storage chamber 1342 (e.g., to increase the pressure inside the vaporizer cartridge 1320 to achieve a substantial equilibrium with ambient pressure), low pressure or even a vacuum may develop within the vaporizer cartridge 1320. The low pressure or vacuum may interfere with the capillary action of the wicking element 1362 to draw additional quantities of the vaporizable material 1302 to the heating element 1350.

Alternatively, the pressure inside of the reservoir 140 can also increase and exceed the ambient pressure external to the reservoir 140 due to various environmental factors such as, for example, a change in ambient temperature, altitude, and/or volume of the reservoir 140. For example, the pressure inside of the reservoir 140 may increase when the vaporizer cartridge 1320 is subject to compression. This increase in internal pressure may sometimes occur after air is returned into the storage chamber 1342 to achieve an equilibrium between the pressure inside the reservoir 140 and the ambient pressure external to the reservoir 140. However, it should be appreciated that a sufficient change in one or more environmental factors may cause the pressure in the reservoir 140 to increase from below ambient pressure to above ambient pressure (e.g., transition from the first pressure state to the second pressure state) without any additional air entering the reservoir 140 to first achieve an equilibrium between the pressure inside the reservoir 140 and ambient pressure. The resulting negative pressure event in which the pressure inside the reservoir 140 undergoes a sufficient increase may displace at least a portion of the vaporizable material 1302 in the storage chamber 1342. Absent a mechanism for collecting and/or retaining the displaced vaporizable material 1302 within the vaporizer cartridge 1320, the displaced vaporizable material 1302 may leak from the vaporizer cartridge 1320.

Continuing to refer to FIGS. 2A and 2B, the reservoir 140 may be implemented to include a first area and a second area that is separable from the first area, such that the volume of the reservoir 140 is divided into the storage chamber 1342 and the overflow volume 1344. The storage chamber 1342 may be configured to store the vaporizable material 1302 and may be further coupled to the wicking element 1362 via one or more primary passageways 1382. In some examples, a primary passageway 1382 may be very short in length (e.g., a pass-through hole from a space containing the wicking element 1362 or other parts of the atomizer 141). In other examples, the primary passageway 1382 may be part of a longer fluid path between the storage chamber 1342 and the wicking element 1362. The overflow volume 1344 may be configured to collect and at least temporarily retain one or more portions of the vaporizable material 1302 that may enter the overflow volume 1344 from the storage chamber 1342 in the second pressure state in which the pressure in the storage chamber 1342 is greater than ambient pressure, as provided in further detail below.

In the first pressure state, the vaporizable material 1302 may be stored in the storage chamber 1342 of the reservoir 140. As noted, the first pressure state may exist, for example, when the ambient pressure external to the vaporizer cartridge 1320 is approximately the same as or more than the pressure inside the vaporizer cartridge 1320. In this first pressure state, the structural and functional properties of the primary passageway 1382 and the overflow channel 1104 are such that the vaporizable material 1302 may flow from the storage chamber 1342 toward the wicking element 1362 by way of the primary passageway 1382. For example, capillary action of the wicking element 1362 may draw the vaporizable material 1302 into proximity with the heating element 1350. Heat generated by the heating element 1350 may act on the vaporizable material 1302 to convert the vaporizable material 1302 to a gas phase.

In the first pressure state, none or a limited quantity of the vaporizable material 1302 may flow into the collector 1313, for example, into the overflow channel 1104 of the collector 1313. Contrastingly, when the vaporizer cartridge 1320 transitions from the first pressure state to the second pressure state, the vaporizable material 1302 may flow from the storage chamber 1342 into the overflow volume 1344 of the reservoir 140. By collecting and at least temporarily retaining the vaporizable material 1302 entering the collector 1313, the collector 1313 may prevent or limit an undesirable (e.g., excessive) flow of the vaporizable material 1302 out of the reservoir 140. As noted, the second pressure state may exist when the ambient pressure external to the vaporizer cartridge 1320 is less than the pressure inside the vaporizer cartridge 1320. This pressure differential may cause an expanding air bubble inside the storage chamber 1342, which may displace a portion of the vaporizable material 1302 inside the storage chamber 1342. The displaced portion of the vaporizable material 1302 may be collected and at least temporarily retained by the collector 1313 instead of exiting the vaporizer cartridge 1320 to cause undesirable leakage.

Advantageously, flow of the vaporizable material 1302 may be controlled by way of routing the vaporizable material 1302 driven from the storage chamber 1342 to the overflow volume 1344 in the second pressure state. For example, the collector 1313 within the overflow volume 1344 may include one or more capillary structures configured to collect and at least temporarily retain that contain at least some (and advantageously all) of the excess liquid vaporizable material 1302 pushed out of the storage chamber 1342 without allowing the liquid vaporizable material 1302 to reach an outlet of the collector 1313 where the liquid vaporizable material 1302 may exit the collector 1313 to cause undesirable leakage. The collector 1313 may also advantageously include capillary structures that enable the liquid vaporizable material pushed into the collector 1313 (e.g., by excess pressure in the storage chamber 1342 relative to ambient pressure) to be reversibly drawn back into the storage chamber 1342 when the pressure inside the storage chamber 1342 reduces and/or equalizes relative to ambient pressure. In other words, the overflow channel 1104 of the collector 1313 may have microfluidic features or properties that prevent air and the vaporizable material 1302 from bypassing each other during filling and emptying of the collector 1313. That is, microfluidic features may be used to manage the flow of the vaporizable material 1302 both into and out of the collector 1313 (i.e., provide flow reversal features). In doing so, these microfluidic features may prevent or reduce leakage of the vaporizable material 1302 as well as the entrapment of air bubbles in the storage chamber 1342 and/or the overflow volume 1344.

Depending on the implementation, the microfluidic features or properties noted above may be related to the size, shape, surface coating, structural features, and/or capillary properties of the wicking element 1362, the primary passageway 1382, and/or the overflow channel 1104. For example, the overflow channel 1104 in the collector 1313 may optionally have different capillary properties than the primary passageway 1382 leading to the wicking element 1362 such that a certain volume of the vaporizable material 1302 may be allowed to pass from the storage chamber 1342 into the overflow volume 1344, during the second pressure state in which at least a portion of the vaporizable material 1302 inside the storage chamber 1342 is displaced from the storage chamber 1342.

In one example implementation, the overall resistance of the collector 1313 to allowing liquid to flow out of the collector 1313 may be larger than an overall resistance of the wicking element 1362, for example, to allow the vaporizable material 1302 to primarily flow through the primary passageway 1382 toward the wicking element 1362 during the first pressure state.

The primary passageway 1382 may provide a capillary pathway through or into the wicking element 1362 for the vaporizable material 1302 stored in reservoir 140. The capillary pathway (e.g., the primary passageway 1382) may be large enough to permit a wicking action or capillary action to replace the vaporized vaporizable material 1302 in the wicking element 1362 but small enough to prevent leakage of the vaporizable material 1302 out of the vaporizer cartridge 1320 when excess pressure inside the vaporizer cartridge 1320 displaces at least a portion of the vaporizable material 1302 from the storage chamber 1342. The wick housing or the wicking element 1362 may be treated to prevent leakage. For example, the vaporizer cartridge 1320 may be coated after filling to prevent leakage or evaporation through the wicking element 1362. Any appropriate coating may be used, including, for example, a heat-vaporizable coating (e.g., a wax or other material) and/or the like.

When a user inhales from the mouthpiece area 1330 of the vaporizer cartridge 1320, air may flow into the vaporizer cartridge 1320 through the air vent 1318, which may be in operational relationship with the wicking element 1362. The heating element 1350 may be activated in response to a signal generated by the one or more sensors 113 (shown in FIG. 1). As noted, the one or more sensors 113 may include at least one of pressure sensor, motion sensor, flow sensor, or other mechanism capable of detecting a puff and/or an imminent puff including, for example, by detecting changes in the airflow passageway 1338. When the heating element 1350 is activated, the heating element 1350 may undergo a temperature increase as a result of a current flowing through the contacts 1326 or through another electrically resistive part of the heating element 1350 that acts to convert electrical energy to heat energy. It should be appreciated that activating the heating element 1350 may include the controller 104 (e.g., shown in FIG. 1) controlling the power source 112 to discharge an electric current from the power source 112 to the heating element 1350.

Heat generated by the heating element 1350 may be transferred to at least a portion of the vaporizable material 1302 in the wicking element 1362 through conductive, convective, and/or radiative heat transfer such that at least a portion of the vaporizable material 1302 drawn into the wicking element 1362 is vaporized. Depending on implementation, air entering the vaporizer cartridge 1320 may flow over (or around, near, etc.) the wicking element 1362 and the heated elements in the heating element 1350 and may strip away the vaporized vaporizable material 1302 into the airflow passageway 1338, where the vapor may optionally be condensed and delivered in aerosol form, for example, through the orifice 220 in the mouthpiece area 1330.

Referring to FIG. 2B, the storage chamber 1342 may be connected to the airflow passageway 1338 (i.e., via the overflow channel 1104 of overflow volume 1344) for the purpose of allowing the portions of the liquid vaporizable material 1302 driven from the storage chamber 1342 by increased pressure in the storage chamber 1342 relative to ambient to be retained in the overflow volume 1344 without escaping from the vaporizer cartridge 1320. While the implementations described herein relate to the vaporizer cartridge 1320 including the reservoir 140, it will be understood that the approaches described are also compatible with and contemplated for use in a vaporizer without a separable cartridge.

Returning to the example, air, which may be admitted to the storage chamber 1342 when the pressure inside the vaporizer cartridge 1320 is lower than ambient pressure, may increase the pressure inside the vaporizer cartridge 1320 and may cause the vaporizer cartridge 1320 to transition to the second pressure state in which the pressure inside the vaporizer cartridge 1320 exceed the ambient pressure external to the vaporizer cartridge 1320. Alternatively and/or additionally, the vaporizer cartridge 1320 may transition to the second pressure state in response to a change in ambient temperature, a change in ambient pressure (e.g., due to a change in external conditions such as altitude, weather, and/or the like), and/or a change in the volume of the vaporizer cartridge 1320 (e.g., when the vaporizer cartridge 1320 is compacted by an external force such as squeezing). The increase in the pressure inside the storage chamber 1342, for example, in the case of a negative pressure event, may at least expand the air occupying the void space of the storage chamber 1342, thereby displacing at least a portion of the liquid vaporizable material 1302 in the storage chamber 1342. The displaced portion of the vaporizable material 1302 may travel through at least some part of the overflow channel 1104 in the collector 1313. Microfluidic features of the overflow channel 1104 can cause the liquid vaporizable material 1302 to move along a length of the overflow channel 1104 in the collector 1313 only with a meniscus fully covering the cross-sectional area of the overflow channel 1104 transverse to the direction of flow along the length.

In some implementations of the current subject matter, the microfluidic features can include a cross-sectional area sufficiently small that for the material from which walls of the overflow channel 1104 are formed and the composition of the liquid vaporizable material 1302, the liquid vaporizable material 1302 preferentially wets the overflow channel 1104 around an entire perimeter of the overflow channel 1104. For an example in which the liquid vaporizable material 1302 includes one or more of propylene glycol and vegetable glycerin, wetting properties of such a liquid are advantageously considered in combination with the geometry of a second passageway 1384 and materials from which the walls of the overflow channel 1104 are formed. In this manner, as the sign (e.g., positive, negative, or equal) and magnitude of the pressure differential between the reservoir 140 and ambient pressure varies, a meniscus is maintained between the liquid vaporizable material 1302 present in the overflow channel 1104 and air entering from the ambient atmosphere to prevent the vaporizable material 1302 and the air from moving past one another. This meniscus, which may be an air-liquid interface between the vaporizable material 1302 and ambient air, may maintain a pressure differential between the reservoir 140 and ambient pressure. Moreover, the meniscus may regulate the passage of air into the reservoir 140 and the vaporizable material 1302 out of the reservoir 140.

As pressure in the storage chamber 1342 drops sufficiently relative to ambient pressure and if there is sufficient void volume in the storage chamber 1342 to allow it, the vaporizable material 1302 present in the overflow channel 1104 of the collector 1313 may be withdrawn into the storage chamber 1342 sufficiently to cause the leading liquid-air meniscus to reach a gate or port between the overflow channel 1104 of the collector 1313 and the storage chamber 1342. At such time, if the pressure differential in the storage chamber 1342 relative to ambient pressure is sufficiently negative to overcome surface tension maintaining the meniscus at the gate or port, the meniscus may be freed from the gate or port walls to form one or more air bubbles, which are then released into the storage chamber 1342 with sufficient volume to equalize the pressure inside the storage chamber 1342 relative to ambient pressure.

When air admitted into the reservoir 140 as discussed above (or otherwise becomes present therein) experiences an elevated pressure condition relative to ambient (e.g., due to a drop in ambient pressure such as might occur in an airplane cabin or other high altitude locations, when a window of a moving vehicle is opened, when a train or vehicle leaves a tunnel, etc. or an elevation in internal pressure in the reservoir 140 such as might occur due to local heating, mechanical pressure that distorts a shape and thereby reduces a volume of the reservoir 140, etc., or the like), the above-described process may be reversed. Liquid passes through the gate or port into the overflow channel 1104 of the collector 1313 and a meniscus forms at the leading edge of a column of the vaporizable material 1302 passing into the overflow channel 1104 to prevent air from bypassing and flowing counter to the progression of the vaporizable material 1302.

By maintaining this meniscus due to the presence of the aforementioned microfluidic properties, when the elevated pressure in the reservoir 140 is later reduced, the column of vaporizable material 1302 may be withdrawn back into the storage chamber 140, and optionally until the meniscus reaches the gate or port. If the pressure differential sufficiently favors ambient pressure relative to the pressure inside the storage chamber 1342, the above-described bubble formation process may occur until the two pressures equalize. In this manner, the collector 1313 may act as a reversible overflow volume that accepts the vaporizable material 1302 that is pushed out of the storage chamber 1342 under transient conditions of greater storage chamber pressure relative to ambient pressure while allowing at least some (and desirably all or most) of this overflow volume of vaporizable material 1302 to be returned to the reservoir 140 for later delivery, for example, to the heating element 1350 for conversion to an inhalable aerosol.

Depending on implementation, the storage chamber 1342 may or may not be connected to the wicking element 1362 via the overflow channel 1104. In embodiments in which the overflow channel 1104 includes a first end coupled with the storage chamber 1342 and a second end overflow channel 1104 leading to the wicking element 1362, any of the vaporizable material 1302 that may exit the overflow channel 1104 at the second end may further saturate the wicking element 1362.

The storage chamber 1342 may optionally be positioned closer to an end of the reservoir 140 that is near the mouthpiece area 1330. The overflow volume 1344 may be positioned near an end of the reservoir 140 closer to the heating element 1350, for example, between the storage chamber 1342 and the heating element 1350. The example embodiments shown in the figures are not to be construed as limiting the scope of the claimed subject matter as to the position of the various components disclosed herein. For example, the overflow volume 1344 may be positioned at a top portion, a middle portion, or a bottom portion of the vaporizer cartridge 1320. The location and positioning of the storage chamber 1342 may be adjusted relative to the position of the overflow volume 1344, such that the storage chamber 1342 may be positioned at the top portion, middle portion, or bottom portion of the vaporizer cartridge 1320 according to one or more variations.

In one implementation, when the vaporizer cartridge 1320 is filled to capacity, the volume of liquid vaporizable material 1302 may be equal to the internal volume of the storage chamber 1342 plus the overflow volume 1344. The internal volume of the overflow volume may, in some example implementations, correspond to a volume of the overflow channel 1104 between a gate or port connecting the overflow channel 1104 to the storage chamber 140 and an outlet of the overflow channel 1104. In other words, the vaporizer cartridge 1320 may be initially filled with liquid vaporizable material 1302 such that all or at least some of the internal volume of the collector 1313 is occupied with the liquid vaporizable material 1302. In such an example, liquid vaporizable material 1302 may be delivered to the atomizer 141 (e.g., including the wicking element 1362 and the heating element 1350) as needed for delivery to a user. For example, to deliver a portion of the vaporizable material 1302, the portion of the vaporizable material 1302 may be drawn from the reservoir 140, thereby causing any vaporizable material 1302 present in the overflow channel 1104 of the collector 1313 to be drawn back into the storage chamber 140 because air cannot enter through the overflow channel 1104 due to the meniscus maintained by the microfluidic properties of the overflow channel 1104 (which prevents air from flowing past the vaporizable material 1302 present in the overflow channel 1104).

After a sufficient quantity of the vaporizable material 1302 has been delivered to the atomizer 141 from the reservoir 140 (e.g., for vaporization and user inhalation) to cause the original volume of the collector 1313 to be drawn into the reservoir 140, the above-discussed action occurs. For instance, one or more air bubbles may be released from a gate or port between the secondary passage 1384 and the reservoir 140 to equalize pressure inside the reservoir 140 (e.g., relative to ambient pressure) as a portion of the vaporizable material 1302 is removed from the reservoir 140. When the pressure inside the reservoir 140 increases above ambient pressure (e.g., due to the admission of air in the first pressure state, a change in temperature, a change in ambient pressure, a change in a volume of the vaporizer cartridge 1320, and/or the like), a portion of the liquid vaporizable material 1302 inside the reservoir 140 may become displaced and thus move out of the reservoir 140 past the gate or port into the overflow channel 1104 until the elevated pressure condition in the storage compartment subsides, at which point the liquid vaporizable material 1302 in the overflow channel 1104 may be drawn back into the reservoir 140.

In certain embodiments, the overflow volume 1344 may be sufficiently large to contain a percentage of the vaporizable material 1302 stored in the storage chamber 1342, including up to approximately 100% of the capacity of the storage chamber 1342. In one embodiment, the collector 1313 may be configured to contain at least 6 percent to 25 percent of the volume of the vaporizable material 1302 storable in the storage chamber 1342. Other ranges are also within the scope of the current subject matter.

The structure of the collector 1313 may be configured, constructed, molded, fabricated or positioned in the overflow volume 1344, in different shapes and having different properties, to allow for overflowing portions of the vaporizable material 1302 to be at least temporarily received, contained or stored in the overflow volume 1344 in a controlled manner (e.g., by way of capillary pressure), thereby preventing the vaporizable material 1302 from leaking out of the vaporizer cartridge 1320 or excessively saturating the wicking element 1362. It will be understood that the above description referring to the overflow channel 1104 is not intended to be limiting to a single such overflow channel 1104. One, or optionally more than one, the overflow channel 1104 may be connected to the storage chamber 140 via one or more than one gate or port. In some implementations of the current subject matter, a single gate or port may connect to more than one overflow channel 1104, or a single overflow channel 1104 may split into more than one overflow channel 1104 to provide additional overflow volume or other advantages.

In some implementations of the current subject matter, an air vent 1318 may connect the overflow volume 1344 to the airflow passageway 1338 that ultimately leads to ambient air environment outside of the vaporizer cartridge 1320. This air vent 1318 may allow for a path for air or bubbles that may have been formed or trapped in the collector 1313 to escape through the air vent 1318, for example during the second pressure state in which the overflow channel 1104 fills with a portion of the vaporizable material 1302 displaced from the storage chamber 1342.

In accordance with some aspects, the air vent 1318 may act as a reverse vent and provide for the equalization of pressure within the vaporizer cartridge 1320 during a reverting back to an equilibrium state, from the second pressure state, as the overflow of the vaporizable material 1302 returns back to the storage chamber 1342 from the overflow volume 1344. In this implementation, as ambient pressure exceeds the internal pressure in the vaporizer cartridge 1320, ambient air may flow through the air vent 1318 into the overflow channel 1104 and effectively help push the vaporizable material 1302 temporarily stored in the overflow volume 1344 in a reverse direction back into the storage chamber 1342.

Referring again to FIGS. 2A-C, in one or more embodiments, in the first pressure state, the overflow channel 1104 may be at least partially occupied with air, which may enter the overflow channel 1104 through the air vent 1318. In the second pressure state, the vaporizable material 1302 may enter the overflow channel 1104, for example through a second opening 210*b* at a point of interface between the storage chamber 1342 and the overflow channel 1104 of the overflow volume 1344. As a result, air in the overflow channel 1104 may become displaced (e.g., by the incoming vaporizable material 1302) and may exit through the air vent 1318. In some embodiments, the air vent 1318 may act as or include a control valve (e.g., a selective osmosis membrane, a microfluidic gate, etc.) that allows for air to exit the overflow volume 1344, but blocks the vaporizable material 1302 from exiting from the overflow channel 1104 into the airflow passageway 1338. As noted earlier, the air vent 1318 may act as an air exchange port to allow air to enter and exit the collector 1313 as, for example, the collector 1313 fills with the vaporizable material 1302 displaced by excess pressure in the storage chamber 1342 and empties when the pressure inside the storage chamber 1342 substantially equalizes with ambient pressure. That is, the air vent 1318 may allow air to enter and exit the collector 1313 when during a transition between the first pressure state when the pressure inside the vaporizer cartridge 1320 is less than the ambient pressure, the second pressure state when the pressure inside the vaporizer cartridge 1320 exceeds the ambient pressure, and an equilibrium state when the pressure inside the vaporizer cartridge 1320 and the ambient pressure are substantially the same.

Accordingly, the vaporizable material 1302 may be stored in the collector 1313 until pressure inside the vaporizer cartridge 1320 is stabilized (e.g., when the pressure inside the vaporizer cartridge 1320 is substantially equal to ambient pressure or meets a designated equilibrium) or until the vaporizable material 1302 is removed from the overflow volume 1344 (e.g., by being drawn to the atomizer 141 including the wicking element 1362 and the heating element 1350 for vaporization). Thus, the level of the vaporizable material 1302 in the overflow volume 1344 may be controlled by managing the flow of vaporizable material 1302 into and out of the collector 1313 as ambient pressure changes. In one or more embodiments, overflow of the vaporizable material 1302 from the storage chamber 1342 into the overflow volume 1344 may be reversed or may be reversible depending on detected changes in environment (e.g., when a pressure event that caused the vaporizable material 1302 overflow subsides or is concluded).

As noted above, in some implementations of the current subject matter, in a state when pressure inside of the vaporizer cartridge 1320 becomes lower than the ambient pressure (e.g., when transitioning from the second pressure state back to the first pressure state), flow of the vaporizable material 1302 may be reversed in a direction that causes the vaporizable material 1302 to flow from the overflow volume 1344 back into the storage chamber 1342 of the reservoir 140. Thus, depending on implementation, the overflow volume 1344 may be configured for temporary retention of the overflow portions of the vaporizable material 1302 during the second pressure state when high pressure inside the vaporizer cartridge 1320 displaces at least a portion of the vaporizable material 1302 from the storage chamber 1342. Depending on an implementation, during or after a reversal back to the first pressure state when the pressure inside the vaporizer cartridge 1320 is substantially equal to or below ambient pressure, at least some of the overflow of the vaporizable material 1302 retained in the collector 1313 may be returned back to the storage chamber 1342.

To control the vaporizable material 1302 flow in the vaporizer cartridge 1320, in other implementations of the current subject matter, the collector 1313 may optionally include an absorbent or semi-absorbent material (e.g., material having sponge-like properties) for permanently or semi-permanently collecting or retaining the overflow of the vaporizable material 1302 traveling through the overflow channel 1104. In one example embodiment in which absorbent material is included in the collector 1313, the reverse flow of the vaporizable material 1302 from the overflow volume 1344 back into the storage chamber 1342 may not be as practical or possible as compared to embodiments that are implemented without (or without as much) absorbent material in the collector 1313. That is, the presence of the absorbent or semi-absorbent material may at least partially inhibit the vaporizable material 1302 collected in the overflow volume 1344 from returning back to the storage chamber 1342. Accordingly, the reversibility and/or the reversibility rate of the vaporizable material 1302 to the storage chamber 1342 may be controlled by including more or less densities or volumes of absorbent material in the collector 1313 or by controlling texture of the absorbent material, where such characteristics result in a higher or lower rate of absorption, either immediately or over longer time periods.

Figure 2D:
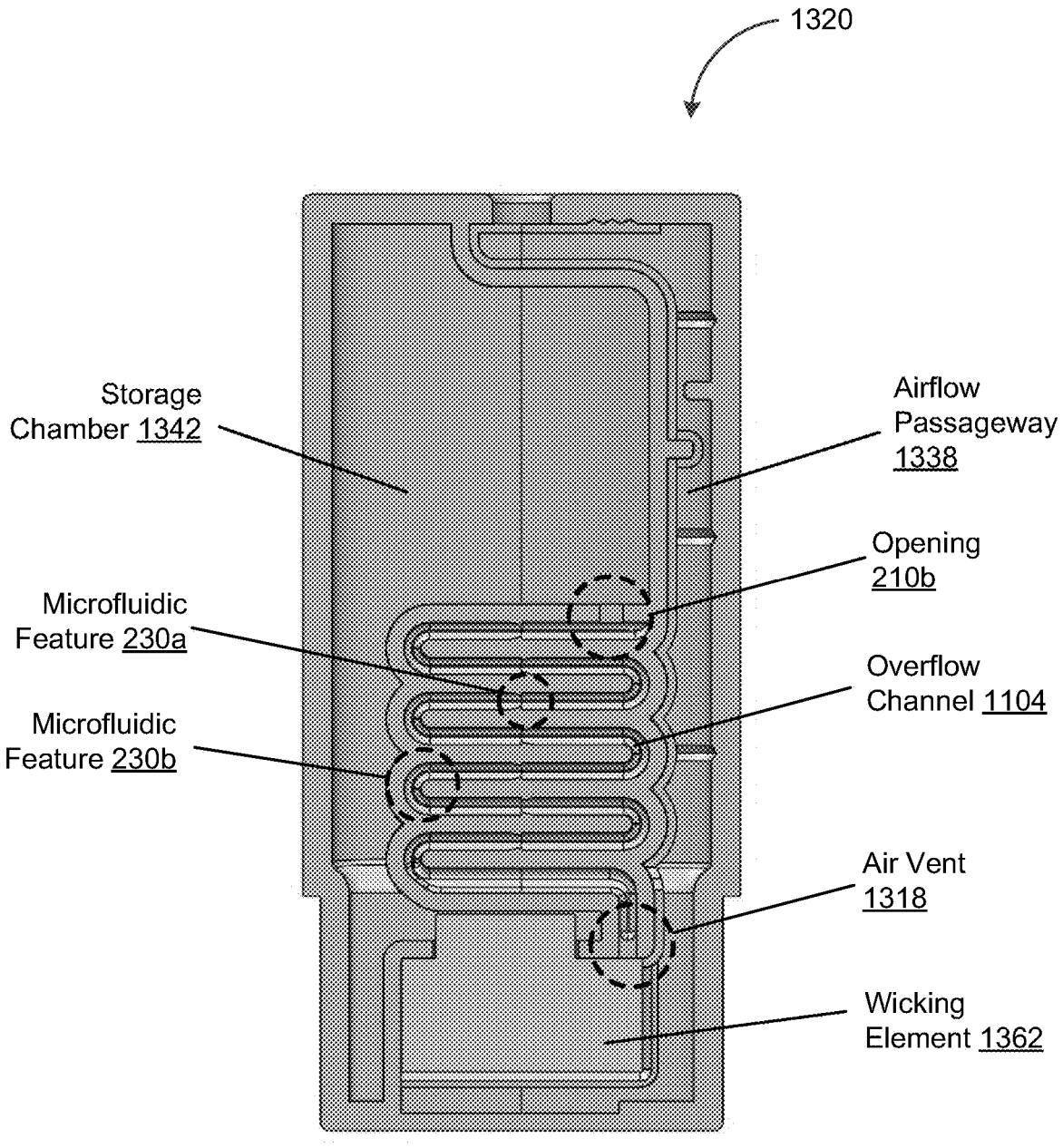
FIG. 2D depicts a planar cross-sectional view of an example of a vaporizer cartridge having a storage chamber and an overflow volume consistent with implementations of the current subject matter.
Figure 2E:
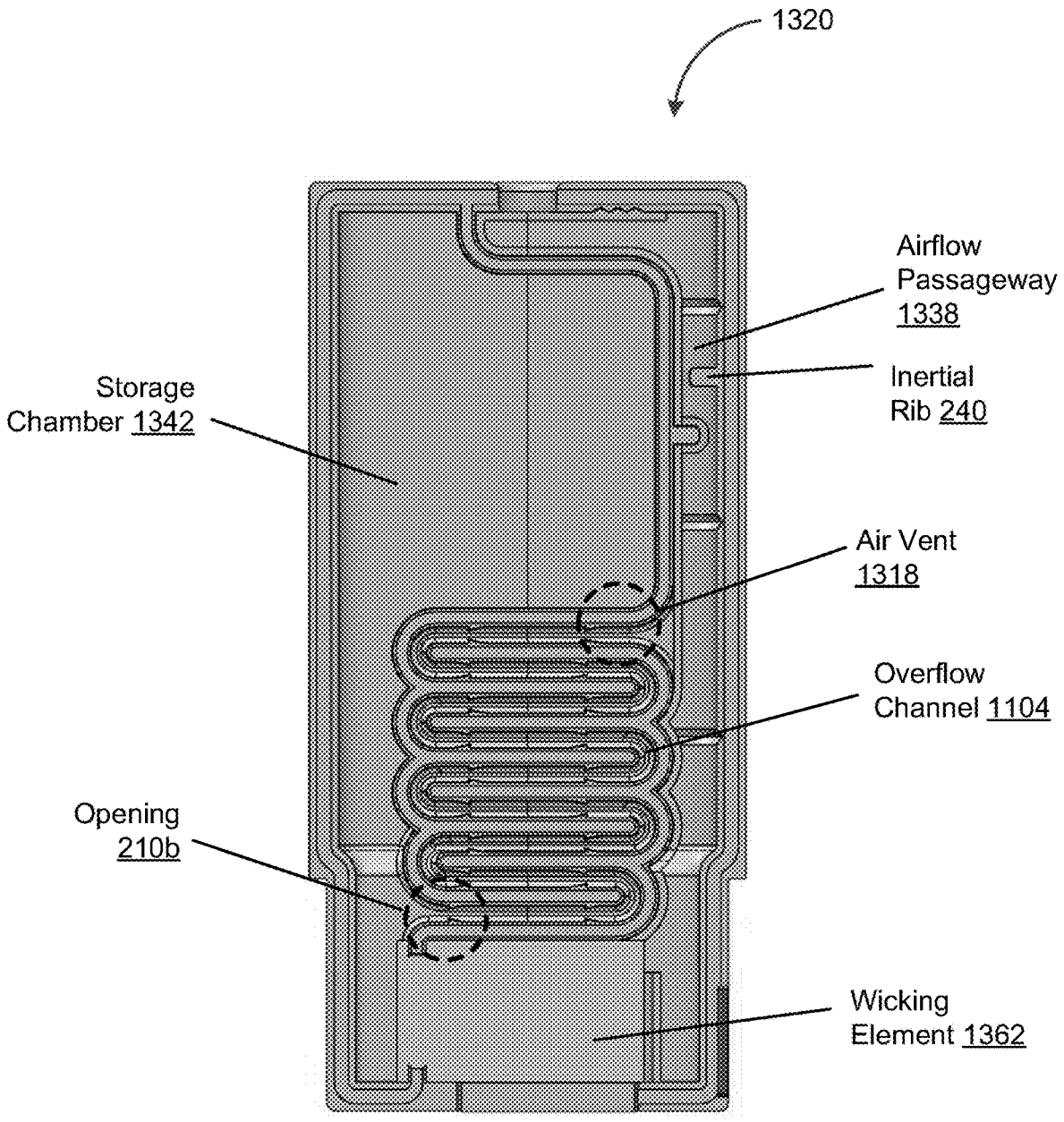
FIG. 2E depicts a planar cross-sectional view of an example of a vaporizer cartridge having a storage chamber and an overflow volume consistent with implementations of the current subject matter.

FIGS. 2D-E depict cross sectional views of examples of the vaporizer cartridge 1320 consistent with implementations of the current subject matter. As noted, in some implementations of the current subject matter, the vaporizer cartridge 1320 may include one or more microfluidic features configured to prevent air and the vaporizable material 1302 from bypassing each other during filling and emptying of the collector 1313. These microfluidic features, which manage the flow of the vaporizable material 1302 into and out of the collector 1313, may minimize leakage of the vaporizable material 1302 as well as the entrapment of air bubbles in the storage chamber 1342 and/or the overflow volume 1344.

In some implementations of the current subject matter, the collector 1313 of the vaporizer cartridge 1320 may include the overflow channel 1104. Referring again to FIGS. 2D-E, a first end of the overflow channel 1104 may include the air vent 1318 in fluid communication with the airflow passageway 1338 while a second end of the overflow channel 1104 may include the second opening 210*b* in fluid communication with the storage chamber 1342. Accordingly, the vaporizable material 1302 may enter and exit the overflow channel 1104 through the second opening 210*b* while air may enter and exit the overflow channel 1104 through the air vent 1318. For example, as noted, air entering through the air vent 1318 may relieve any vacuum that may develop within the reservoir 140 due to the depletion of the vaporizable material 1302. Alternatively, at least a portion of the vaporizable material 1302 in the storage chamber 1342 may enter the overflow channel 1104 through the second opening 210*b* during a negative pressure event where the vaporizable material 1302 is displaced from the storage chamber 1342 due to an increase in the pressure inside the reservoir 140. FIGS. 2D-E depict examples of the vaporizer cartridge 1320 having a different placement of the air vent 1318 and the second opening 210*b*.

Referring to FIG. 2D, in some implementations of the current subject matter, the air vent 1318 may be disposed adjacent to the wick housing 910 and the wicking element 1362 while the second opening 210*b* is disposed away from the wick housing 910 and the wicking element 1362, for example, above the air vent 1318. Alternatively, in the example of the vaporizer cartridge 1320 shown in FIG. 2E, the second opening 210*b* may be disposed adjacent to the wick housing 910 and the wicking element 1362 while the air vent 1318 may be disposed away from the wick housing and the wicking element 1362, for example, above the second opening 210*b*. It should be appreciated that proximity between the wicking element 1362 and the second opening 210*b*, which is in fluid communication with the storage chamber 1342, may minimize the hydrostatic head between the wicking element 1362 and the storage chamber 1342. As such, the example of the vaporizer cartridge 1320 shown in FIG. 2E may be more resilient to leakage through the wicking element 1362 because the negative pressure created by the meniscus at the second opening 210*b* is preserved instead of being diminished by the hydrostatic head between the wicking element 1362 and the storage chamber 1342.

In some implementations of the current subject matter, the overflow channel 1104 may include one or more microfluidic features including, for example, a first microfluidic feature 230*a*, a second microfluidic feature 230*b*, and/or the like. The first microfluidic feature 230*a* and/or the second microfluidic feature 230*b* may be configured to control the flow of air and the vaporizable material 1302 into and out of the reservoir 140. For example, the first microfluidic feature 230*a* and/or the second fluid features 230*b* may be configured to discourage the flow of the vaporizable material 1302 in one direction the overflow channel 1104 (e.g., away from the storage chamber 1342 and out of the overflow channel 1104) and encourage the flow of the vaporizable material 1302 in a reverse direction (e.g., back into the storage chamber 1342). Moreover, the first microfluidic feature 230*a* and the second microfluidic feature 230*b* may be configured to permit airflow to the storage chamber 1342 through the overflow channel 1104 in order to equalize the pressure inside the storage chamber 1342 with ambient pressure.

One example of a microfluidic feature may be one or more constriction points in which the cross sectional shape and/or dimensions of the overflow channel 1104 vary across a length of the overflow channel 1104. As shown in FIG. 2D, the first microfluidic feature 230*a* may be a type of constriction point in which the cross sectional shape and/or dimensions of the overflow channel 1104 at a first portion of the overflow channel 1104 differs from a cross sectional shape and/or dimensions of the overflow channel 1104 at a second portion of the overflow channel 1104 and/or a third portion of the overflow channel 1104 at either side of the first portion of the overflow channel 1104. For example, constriction points may be formed by one or more bumps, raised edges, and/or protrusions extending from an interior surface of the overflow channel 1104.

Figure 2F:
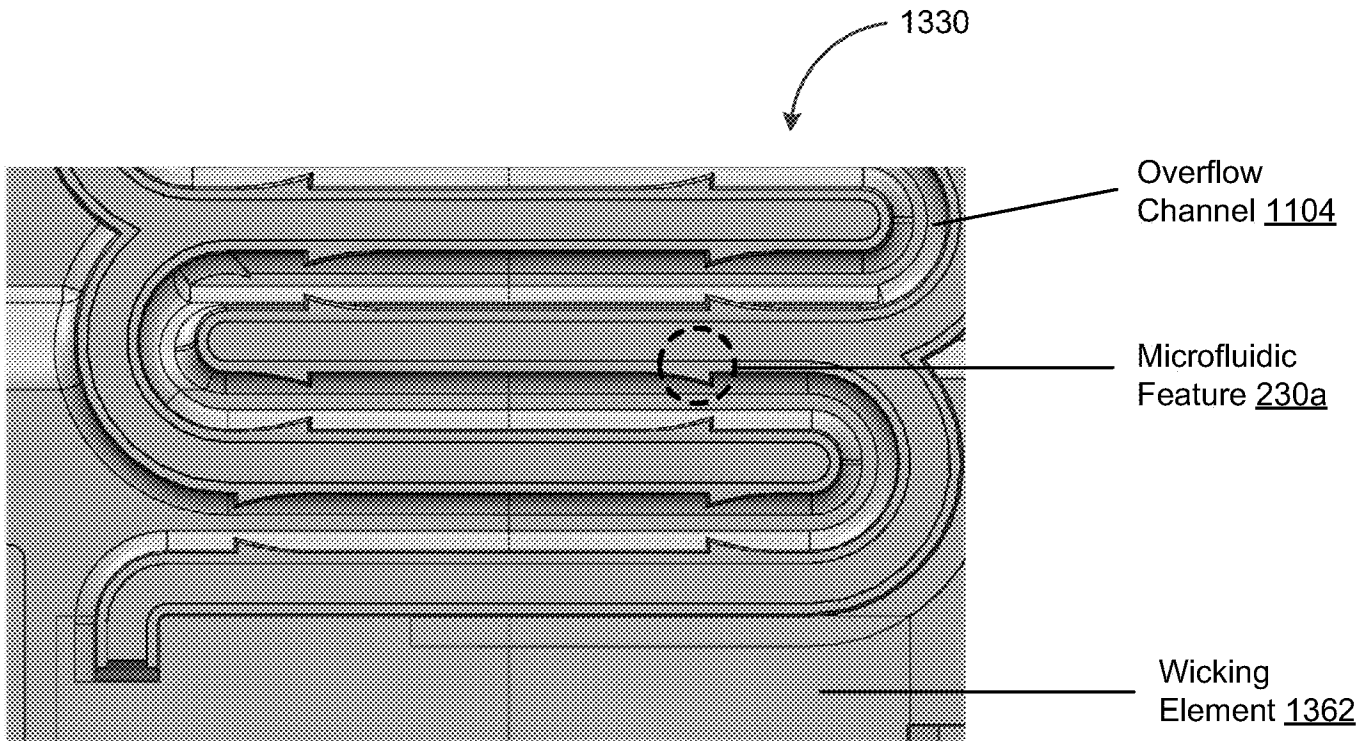
FIG. 2F depicts a planar cross-sectional view of a collector having an example of a microfluidic feature consistent with implementations of the current subject matter.

To further illustrate, FIG. 2F depicts a planar cross-sectional view of the collector 1313 having an example of the first microfluidic feature 230*a* consistent with implementations of the current subject matter. Referring to FIG. 2F, the first microfluidic feature 230*a* may be a bump, a raised edge, a protrusion, or another form of a constriction point extending from an interior surface of the overflow channel 1104. In some implementations of the current subject matter, the shape of the first microfluidic feature 230*a* may be defined as a bump, finger, prong, fin, edge, or any other shape that constricts a cross-sectional area transverse to a flow direction in the overflow channel 1104. For example, the first microfluidic features 230*a* may be in the shape of a shark fin, for example, in which the distal end of the first microfluidic feature 230*a* tapers to an edge. The pointed or cantilevered edge of the shark fin shape may be rounded although the cantilevered edge may also be tapered to a sharp end.

Other examples of microfluidic features may include one or more variations in the shape and/or orientation of the overflow channel 1104 along a length of the overflow channel 1104. For example, in some implementations of the current subject matter, at least a portion of the overflow channel 1104 may spiral, curve, bend, taper, turn, and/or slope. To further illustrate, FIG. 2D shows that the second microfluidic feature 230*b* may be a curvature in the overflow channel 1104 where the overflow channel 1104 running in one direction turns in an opposite direction. It should be appreciated that the shape, size, relative location, and total quantity of microfluidic features disposed along the length of the overflow channel 1104 may be adjusted to further control the ingress and egress of the vaporizable material 1302 into and out of the overflow channel 1104, for example, by fine-tuning a tendency of a meniscus (e.g., separating the vaporizable material 1302 and air) to form within the overflow channel 1104.

Figure 3A:
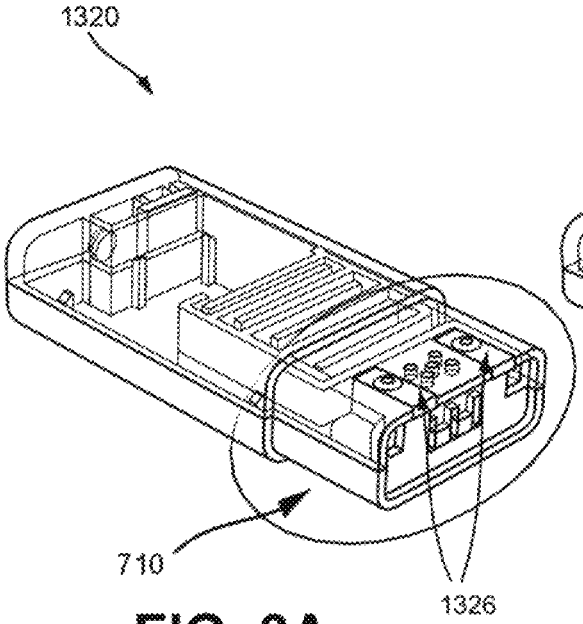
FIG. 3A depicts a perspective view of a vaporizer cartridge having one example of a connector consistent with implementations of the current subject matter.
Figure 3B:
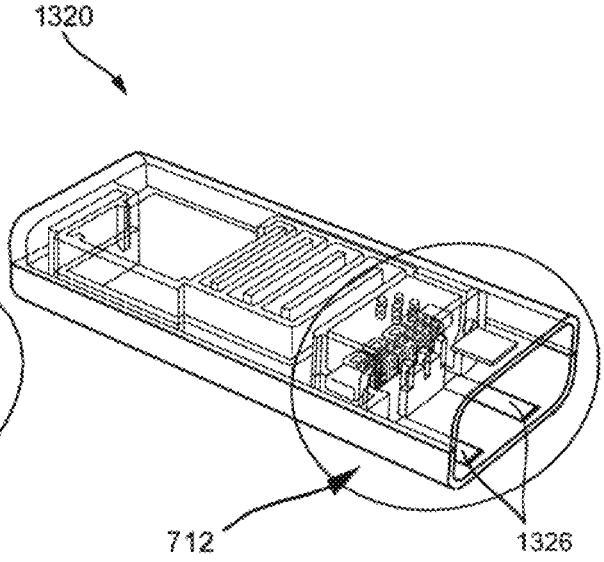
FIG. 3B depicts a perspective view of a vaporizer cartridge having another example of a connector consistent with implementations of the current subject matter.
Figure 3C:
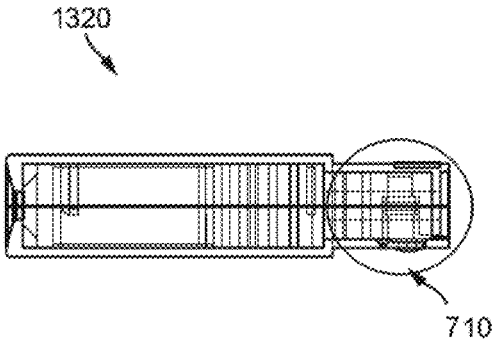
FIG. 3C depicts a planar cross-sectional view of a vaporizer cartridge having one example of a connector consistent with implementations of the current subject matter.

In some implementations of the current subject matter, the vaporizer cartridge 1320 may couple with the vaporizer body 110 of the vaporizer device 100 in a variety of different manners. For example, FIGS. 3A-D and 3H depict various design alternatives for connectors configured to form a coupling between the vaporizer cartridge 1320 and the vaporizer body 110 of the vaporizer device 100. FIGS. 3A-B and 3H each depict perspective views of various examples of the connectors while FIGS. 3C-D each depict planar cross-sectional side views of various examples of the connectors.

The examples of the connectors shown in FIGS. 3A-D and 3H may include complementary male connectors (e.g., protrusions) and female connectors (e.g., receptacles). As shown in FIGS. 1, 2A-B, 3A-D, and 3H, one end of the vaporizer cartridge 1320 may include one or more connectors to enable a coupling between the vaporizer cartridge 1320 and the vaporizer body 110 of the vaporizer device 100. For example, one end of the vaporizer cartridge 1320 may include one or more mechanical connectors, electrical connectors, and fluid connectors configured to provide an electrical coupling, a mechanical coupling, and/or a fluid coupling between the vaporizer cartridge 1320 and the vaporizer body 110. It should be appreciated that these connectors may be implemented with various configurations.

In one implementation of the current subject matter, one end of the vaporizer cartridge 1320 may include a male connector 710 (e.g., a protrusion) that is configured to couple with a female connector (e.g., the cartridge receptacle 118) in the vaporizer body 110. In this example, when the vaporizer cartridge 1320 is coupled with the vaporizer body 110, the contacts 1326 disposed on the male connector 710 may form an electric coupling with the corresponding receptacle contacts 125 in the cartridge receptacle 118. Moreover, the contacts 1326 on the male connector 710 may mechanically engage the receptacle contacts 125 in the cartridge receptacle 118, for example, by friction fit (e.g., snap-lock engagement) and/or spring tension, to secure the vaporizer cartridge 1320 in the cartridge receptacle 118 of the vaporizer body 110.

Figure 3D:
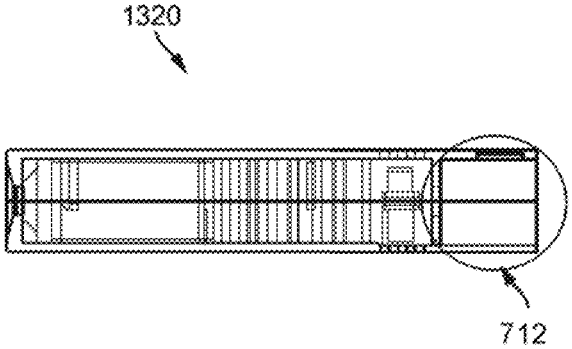
FIG. 3D depicts a planar cross-sectional view of a vaporizer cartridge having another example of a connector of consistent with implementations of the current subject matter.

Alternatively, FIGS. 3B and 3D depicts another example of the vaporizer cartridge 1320 in which one end of the vaporizer cartridge 1320 includes a female connector 712. The female connector 712 may be a receptacle that is configured to receive a corresponding male connector (e.g., a protrusion) on the vaporizer body 110. In this example implementation, the contacts 1326 may be disposed inside the female connector 712 and may be configured to form an electric coupling as well as a mechanical coupling with corresponding contacts on the male connector on the vaporizer body 110.

FIG. 3H depicts another example of the vaporizer cartridge 1320 consistent with implementations of the current subject matter. Referring to FIG. 3H, in some implementations of the current subject matter, the vaporizer cartridge 1320 may include a hybrid connector 720, which may include a sleeve 725 configured to extend at least partially over and/or around the male connector 710. When coupled with the vaporizer body 110 of the vaporizer device 110, the male connector 710 may be disposed at least partially inside the cartridge receptacle 118, with the contacts 1326 on the male connector 710 forming an electrical coupling with the receptacle contacts 125 in the cartridge receptacle 118.

Moreover, when the vaporizer cartridge 1320 is coupled with the vaporizer body 110, the sleeve 725 may extend below an open top of the cartridge receptacle 118 to at least partially enclose the cartridge receptacle 118. The male connector 710 may include at least a portion of the vaporizer cartridge 1320 including the wick housing 910. Accordingly, when the vaporizer cartridge 1320 is coupled with the vaporizer body 110 and the male connector 710 is disposed at least partially inside the cartridge receptacle 118, the sleeve 725 and the cartridge receptacle 118 may provide insulation for the heating element 1350 and the wicking element 1362 disposed inside the wicking housing 910.

Figure 7:
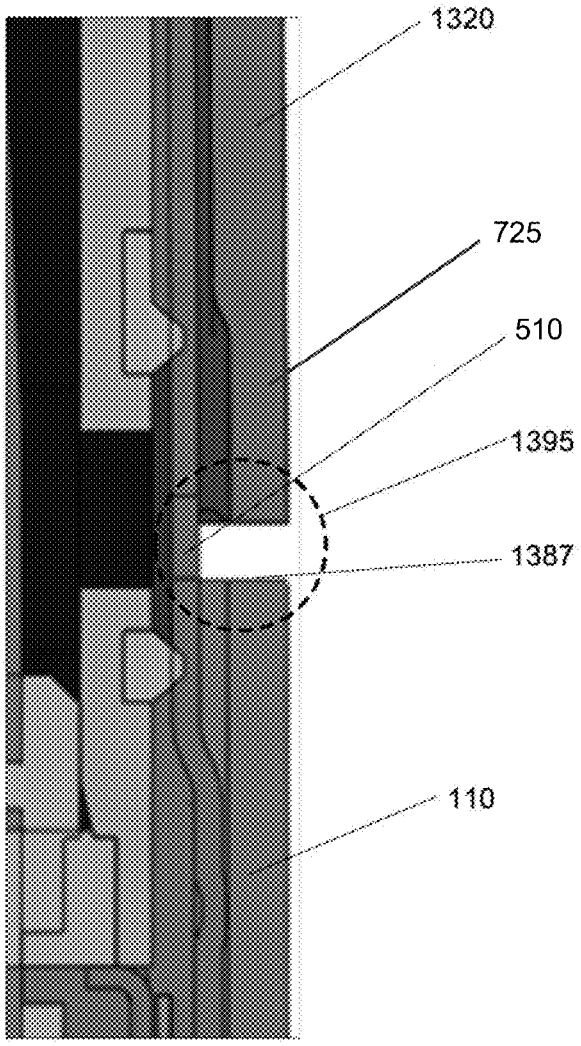
FIG. 7 depicts a planar view of a cross section of an example of a vaporizer cartridge coupled with a vaporizer body consistent with implementations of the current subject matter.

FIG. 7 depicts a planar view of a cross section of an example of the vaporizer cartridge 1320 coupled with the vaporizer body 110 consistent with implementations of the current subject matter. In some implementations of the current subject matter, when the vaporizer cartridge 1320 is coupled with the vaporizer body 110, a recessed area 1395 (e.g., a cavity, a groove, a gap, a seam, and/or the like) may be formed between one end of the sleeve 725 and the vaporizer body 110 such that one or more air inlets 510 in the cartridge receptacle 118 may be disposed within the recessed area 1395 such that portions of the vaporizer cartridge 1320 and the vaporizer body 110 may extend beyond the area including the one or more air inlets 510. The recessed area 1395 may extend at least partially around the circumference of the vaporizer cartridge 1320 and the vaporizer body 110 to provide clearance for the one or more air inlets 510 because a user's finger (or other body part) may be able to cover only a portion of the recessed area 1395. Preventing inadvertent blockage of the one or more air inlets 510 may ensure adequate airflow to the vaporizer cartridge 1320.

Figure 3E:
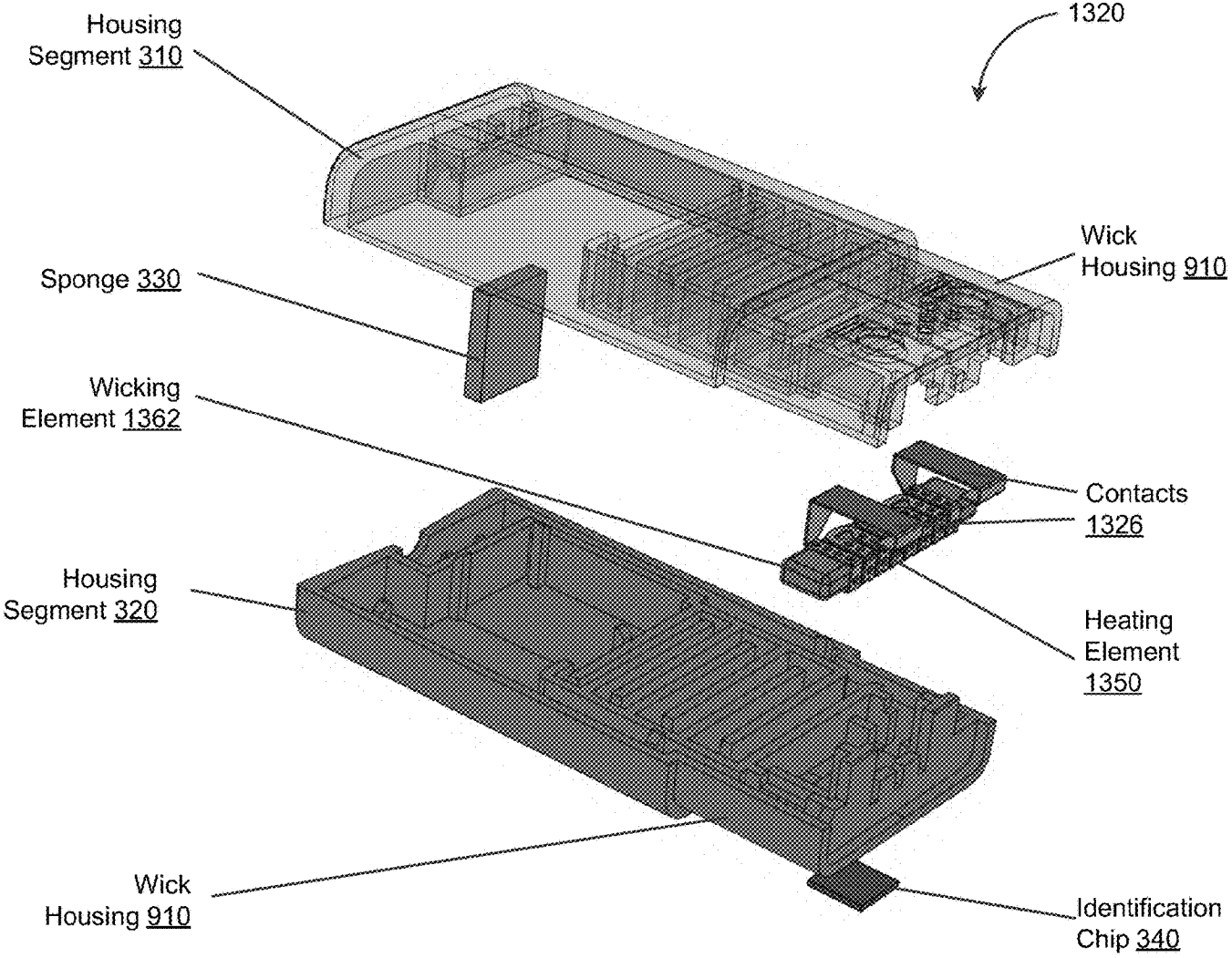
FIG. 3E depicts an exploded view of an example of a vaporizer cartridge consistent with implementations of the current subject matter.

FIG. 3E depicts an exploded view of an example of the vaporizer cartridge 1320 consistent with implementations of the current subject matter. As shown in FIG. 3E, in some implementations of the current subject matter, the vaporizer cartridge 1320 may have a top-down architecture in which a first housing segment 310 is coupled with a second housing segment 320 to form the vaporizer cartridge 1320. In the example shown in FIG. 3E, the first housing segment 310 and the second housing segment 320 may each form substantially half of a housing of the vaporizer cartridge 1320, for example, along a longitudinal axis of the vaporizer cartridge 1320. For example, the first housing segment 310 may form an upper half of the housing of the vaporizer cartridge 1320 and the second housing segment 320 may form a lower half of the housing of the vaporizer cartridge 1320. Nevertheless, it should be appreciated that the first housing segment 310 and the second housing segment 320 may each form a different proportion of the housing of the vaporizer cartridge 1320.

In some implementations of the current subject matter, the vaporizer cartridge 1320 may include a sponge 330 or other liquid absorbent features, which may be disposed at or proximate to one end of the airflow passageway 1338 where the airflow passageway 1338 interfaces with the orifice 220. Condensate may build up along the airflow passageway 1338 during use of the vaporizer cartridge 1320. For example, condensate may form if some of the vaporizable material 1302 in the gas phase condenses prior to exiting the orifice 220. The condensate built up along the airflow passageway 1338 may cause an unpleasant user experience when subsequently commingled with the aerosol traveling through the airflow passageway 1338, for example in the form of large liquid droplets which may be deposited directly into a user's mouth rather than being carried with the incoming air stream being inhaled by the user. As such, a sponge 330 or other liquid absorbent feature may be configured to filter or otherwise capture larger droplets, such as those formed from the condensate, thereby preventing ingestion of liquid condensate droplets by the user. The sponge 330 or other liquid absorbent feature may function by having the inhaled airflow pass nearby, particularly in conjunction with a change in airflow direction, which may beneficially cause condensate droplets (being larger than the vaporizable material condensed into aerosol particles directly from the gas phase) to be removed by inertial impaction with the sponge 330 or other liquid absorbent feature. Alternatively and/or additionally, to prevent condensate from collecting in the airflow passageway 1338 and from being delivered to the user as part of the aerosol, one or more features (e.g., protrusions, projections, bumps such as the inertial rib 240 shown in FIG. 2E) may be disposed along an interior surface of the airflow passageway 1338. The one or more features may be further configured to redirect at least a portion of the condensate towards the wick housing 910 (e.g., the wicking element 1362 and the heating element 1350).

Referring again to FIG. 3E, in some implementations of the current subject matter, the vaporizer cartridge 1320 may include an identification chip 340, which may be disposed on an exterior of the first housing segment 310 and/or the second housing segment 320. The identification chip 340 may be configured to store a variety of information associated with the vaporizer cartridge 1320 including, for example, a type of the vaporizable material 1302, usage data associated with the vaporizer cartridge 1320, authentication data, temperature settings, and/or the like. Instead of the exterior of the first housing segment 310 and/or the second housing segment 320, the identification chip 340 may also be disposed at a different location on the vaporizer cartridge 1320. For example, the identification chip 340 may be disposed on a surface of the atomizer 141 that interfaces with the vaporizer body 110 when the vaporizer cartridge 1320 is coupled with the vaporizer body 110. The identification chip 340 may be configured to communicate with a corresponding chip reader located in the vaporizer body 110 of the vaporizer device 100 when the vaporizer cartridge 1320 is coupled to the vaporizer body 110.

Figure 3F:
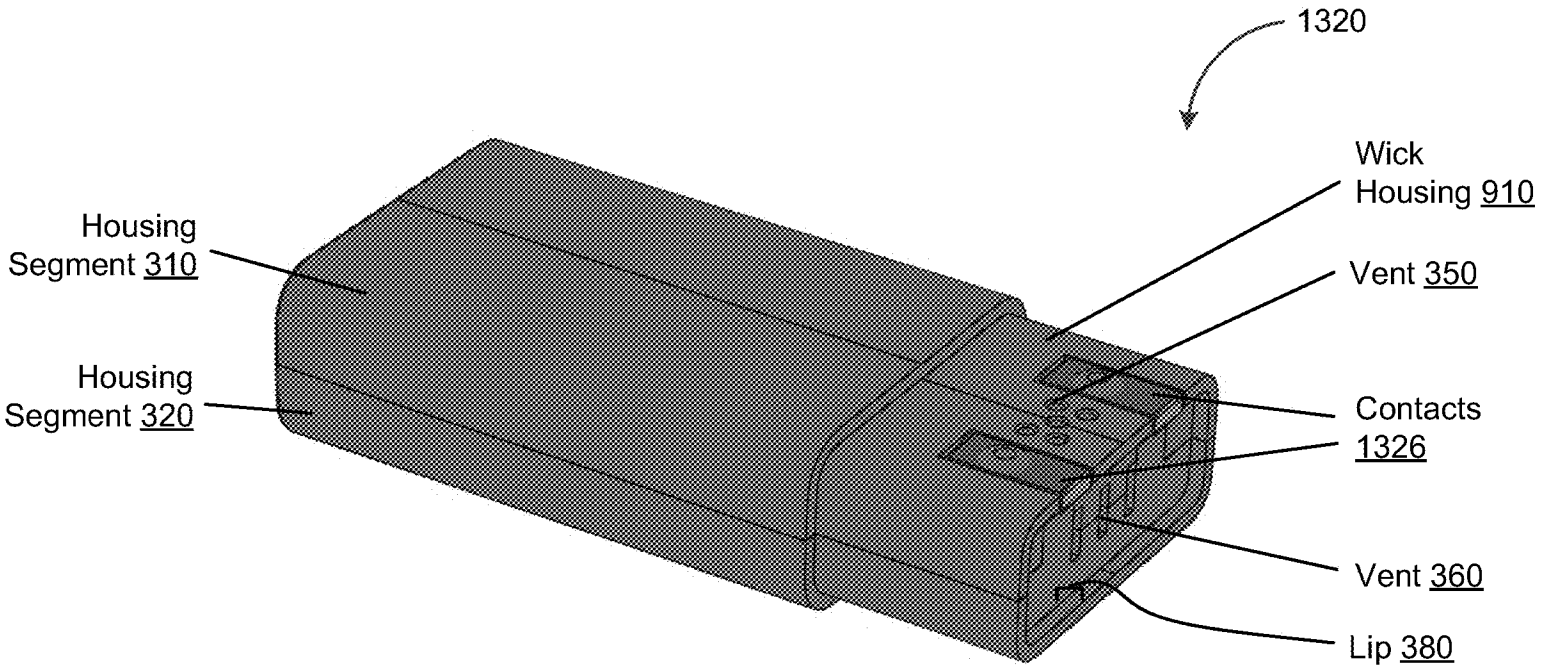
FIG. 3F depicts a perspective view of an example of a vaporizer cartridge consistent with implementations of the current subject matter.
Figure 3G:
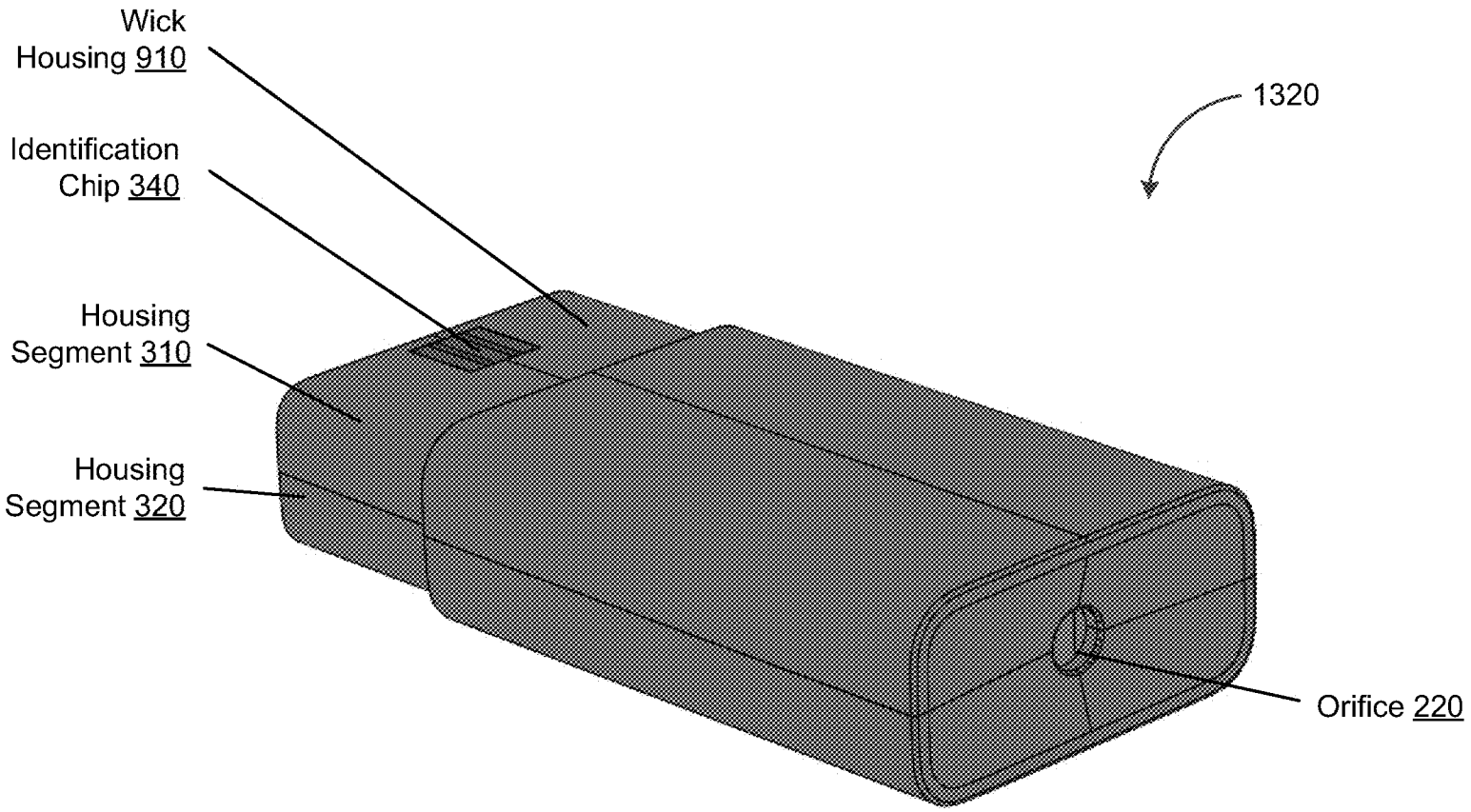
FIG. 3G depicts a perspective view of an example of a vaporizer cartridge consistent with implementations of the current subject matter.
Figure 3H:
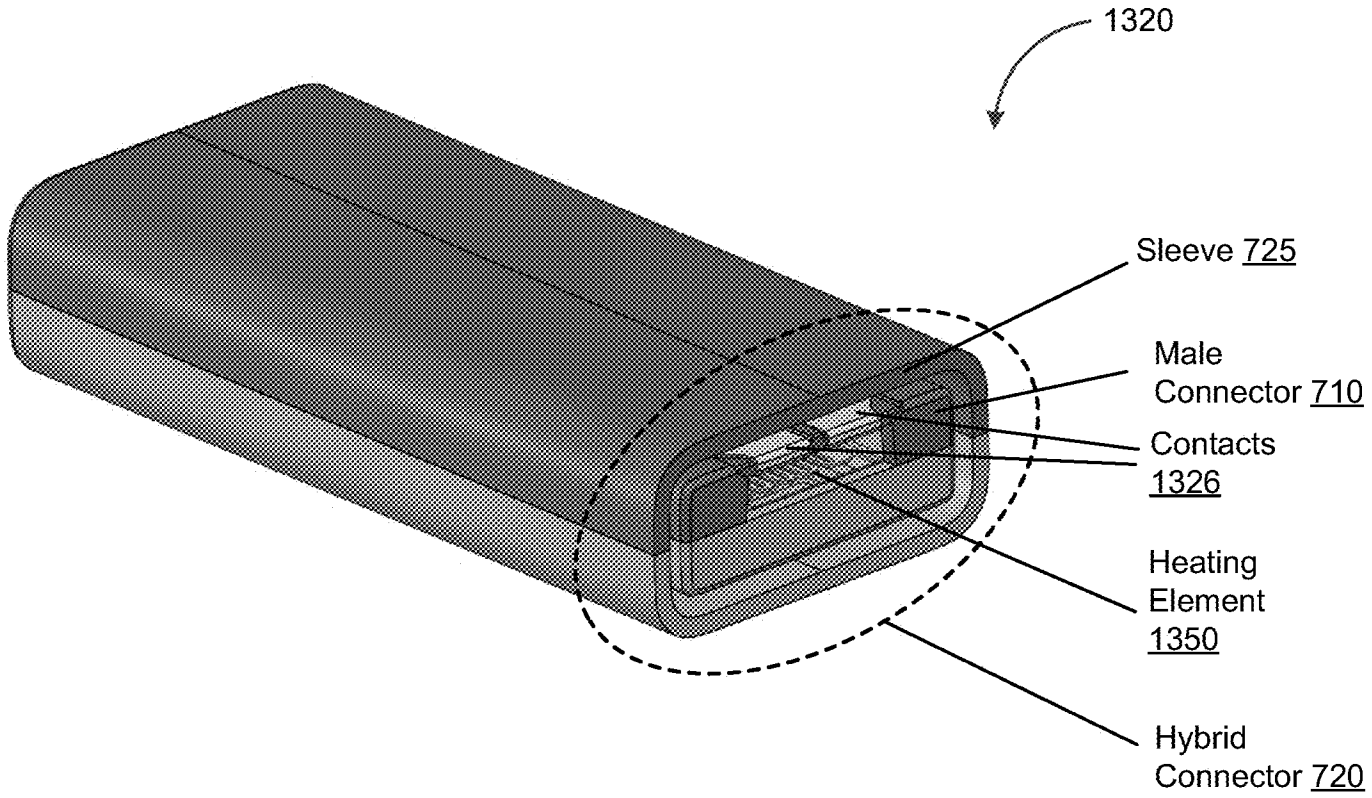
FIG. 3H depicts another example of a vaporizer cartridge consistent with implementations of the current subject matter.

FIGS. 3F-G depict perspective views of an example of the vaporizer cartridge 1320 having the top-down architecture. Referring to FIGS. 3A-G, at least a portion of the first housing segment 310 and the second housing segment 320, when coupled, may form the wick housing 910 configured to accommodate at least a portion of the heating element 1350 and the wicking element 1362. The wick housing 910 may be disposed at one end of the vaporizer cartridge 1320 configured to couple with the vaporizer body 110 of the vaporizer device 110. For example, FIG. 3E shows the wick housing 910 as being part of the male connector 710 at one end of the vaporizer cartridge 1320. As such, when the vaporizer cartridge 1320 is coupled with the vaporizer body 110, for example, by being disposed in the cartridge receptacle 118 of the vaporizer body 110, the wick housing 910 including the heating element 1350 and the wicking element 1362 may be disposed at least partially inside the cartridge receptacle 118 such that the cartridge receptacle 118 of the vaporizer body 110 may provide additional insulation for the heating element 1350. Alternatively, the wick housing 910 may also be disposed at a top of the female connector 712 at one end of the vaporizer cartridge 1320.

Referring again to FIGS. 3F-G, the vaporizer cartridge 1320 may include the orifice 220, which may be an opening at one end of the vaporizer cartridge 1320 serving as the mouthpiece 1330. Moreover, the vaporizer cartridge 1320 may include one or more vents including, for example, a first vent 350, a second vent 360, and/or the like. The first vent 350 and the second vent 360 may be disposed at or proximate to the wick housing 910. When the vaporizer cartridge 1320 is coupled with the vaporizer body 110, the first vent 350 and/or the second vent 360 may be in fluid communication with the one or more air inlets 510 in the cartridge receptacle 118. Accordingly, air entering the one or more air inlets 510 may further enter the vaporizer cartridge 1320 through the first vent 350 and/or the second vent 360. One or more seals may be disposed at an interface between the vaporizer cartridge 1320 and the vaporizer body 110 in order to ensure that the air entering the one or more air inlets 510 enters the first vent 350 and/or the second vent 360 instead of around the wick housing 910.

In the example of the vaporizer cartridge 1320 shown in FIG. 3F, the first vent 350 may be disposed at a side of the wick housing 910. Moreover, the first vent 350 may include one or more apertures configured to provide pinpoint vapor evacuation and/or airflow to the wicking element 1362. This pinpoint vapor evacuation and/or airflow may provide a variety of advantages including, for example, control condensation within the vaporizer cartridge 1320, improve capillary action of the wicking element 1360, and/or the like. The top-down architecture of the vaporizer cartridge 1320 may enable the apertures serving as the first vent 350 to be molded directly into the side walls of the wick housing 910 without requiring any slide action in the tooling. Moreover, the first vent 350 may provide more optimal air streams for evacuating the vaporized vaporizable material 1302 from the heating element 1350 at least because perpendicular air impingement from the first vent 350 may result in a smaller boundary layer of the vaporized vaporizable material 1302 at the heating element 1350 and thus enable more rapid local evacuation and conversion of the vaporizable material 1302 from a liquid phase to vapor.

Alternatively and/or additionally, FIG. 3F shows the vaporizer cartridge 1320 as including the second vent 960 disposed at a bottom of the wick housing 910. The second vent 960 may include one or more apertures configured to enable air to flow into the wick housing 910 and around and/or past the wick element 1362 disposed at least partially inside the wick housing 910. Adequate airflow through the wick housing 910 may be necessary to provide for a proper and timely vaporization of vaporizable material 1302 absorbed into the wicking element 1362 in reaction to the heat generated by the heating element 1350 positioned near or around the wicking element 1362.

In some implementations of the current subject matter, the vaporizer cartridge 1320 may include one or more capillary features configured to prevent undesirable egress of the vaporizable material 1302 from the vaporizer cartridge 1320. For example, FIG. 3F shows a lip 380 disposed at least partially around a perimeter of the wick housing 910, for example, around a bottom portion of the wick housing 910 where the vaporizer cartridge 1320 interfaces with the vaporizer body 110. The lip 380 may provide a gap (e.g., of approximately 0.6 millimeters) between the bottom of the wick housing 910 and the vaporizer body 110 when the vaporizer cartridge 1320 is coupled with the vaporizer body 110. In doing so, the lip 380 may serve as a capillary break that prevents the vaporizable material 1302 in the vaporizer cartridge 1320 from coming in contact with the vaporizer body 110. Alternatively and/or additionally, to prevent the vaporizable material 1302 present in the wick housing 1315, for example, the vaporizable material 1302 drawn into the wicking element 1362, from flowing out of the wick housing 1315, the interior dimensions (e.g., cross-sectional area, diameter, width, length, and/or the like) of the apertures forming the first vent 350 and/or the second vent 360 may be stepped in order to provide, for example, one or more constriction points at which a meniscus may form to prevent the further egress of the vaporizable material 1302.

Figure 4A:
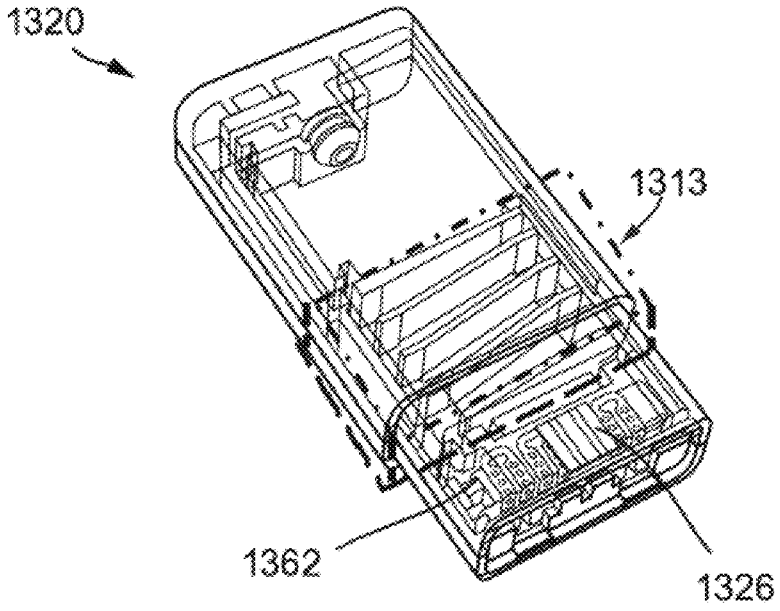
FIG. 4A depicts a transparent perspective view of an example of a vaporizer cartridge consistent with implementations of the current subject matter.

FIG. 4A depicts a transparent perspective view of an example of the vaporizer cartridge 1320 consistent with implementations of the current subject matter. As shown in FIG. 4A, the vaporizer cartridge 1320 may include the collector 1313, the heating element 1350, the wicking element 1362, the contacts 1326, and the airflow passageway 1338. The collector 1313, as noted, may be configured to control the exchange of air and the vaporizable material 1302 into and out of the reservoir 140 of vaporizer cartridge 1320. FIG. 4A shows that, when assembled, the collector 1313 may be disposed within the first housing segment 310 and the second housing segment 320 of the vaporizer cartridge 1320. However, it should be appreciated that the vaporizer cartridge 1320 having the top-down architecture may be assembled in a variety of manners, for example consistent with what is shown in FIGS. 4B-C.

Figure 4B:
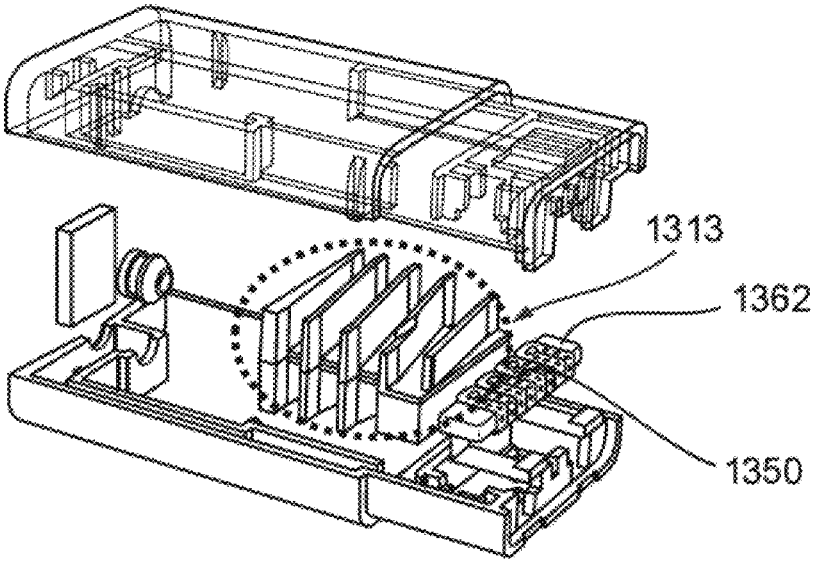
FIG. 4B depicts an exploded perspective view of an example of a vaporizer cartridge consistent with implementations of the current subject matter.

Referring to FIG. 4B, in some implementations of the current subject matter, the collector 1313 as being configured, designed, manufactured, fabricated, or constructed fully or partially independent from the first housing segment 310 and/or the second housing segment 320 of the vaporizer cartridge 1320. Furthermore, the collector 1313 may be formed fully or partially independently of the other components of the vaporizer cartridge 1320 including, for example, the storage chamber 1342, the airflow passageway 1338, the storage chamber 1342, the heating element 1350, the wicking element 1362, and/or the like. Accordingly, in the example of the vaporizer cartridge 1320 shown in FIG. 4B, the vaporizer cartridge 1320 may be formed by disposing, between the first housing segment 310 and the second housing segment 320, an assembly including the collector 1313 as well as the heating element 1350 and the wicking element 1362. The first housing segment 310 and the second housing segment 320 may subsequently be joined using a variety of techniques including, for example, adhesives, ultrasonic welding, electron beam welding, laser beam welding, and/or the like.

Figure 4C:
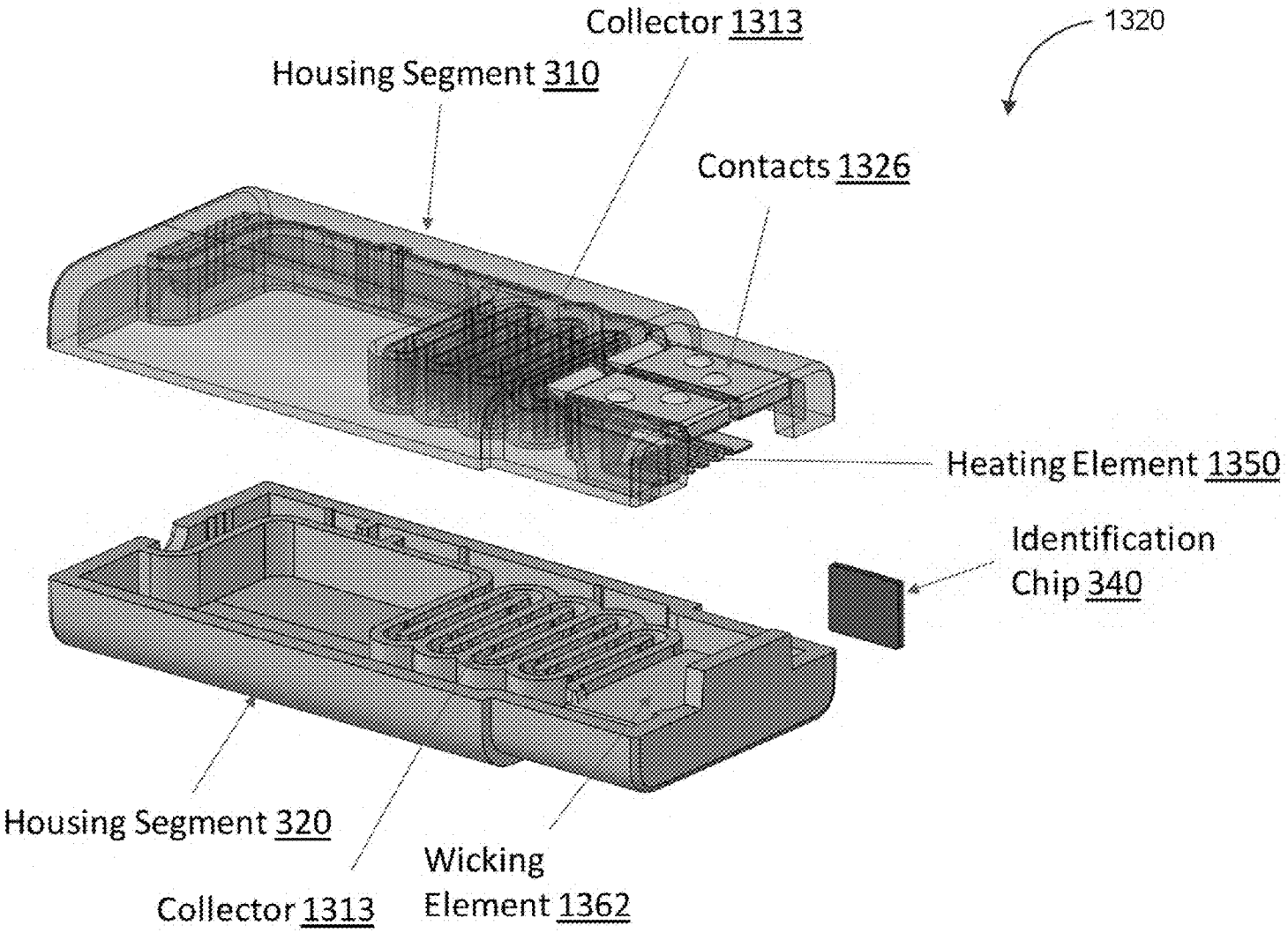
FIG. 4C depicts an exploded perspective view of another example of a vaporizer cartridge consistent with implementations of the current subject matter.

Alternatively, FIG. 4C shows a first portion of the collector 1313 being formed as a part of the first housing segment 310 and a second portion of the collector 1313 being formed as a part of the second housing segment 320. The example of the vaporizer cartridge 1320 shown in FIG. 4C may be assembled by at least joining the first housing segment 310 including the first portion of the collector 1313 with the second housing segment 320 including the second portion of the collector 1313. Various techniques may be used to join the first housing segment 310 and the second housing segment 320 including, for example, adhesives, ultrasonic welding, electron beam welding, laser beam welding, and/or the like.

As noted, assembling the vaporizer cartridge 1320 may include joining the first housing segment 310 and the second housing segment 320. In some implementations of the current subject matter, the first housing segment 310 and the second housing segment 320 may be joined by laser beam welding, a welding technique in which a laser beam (e.g., an infrared laser beam and/or the like) provides the heat for joining together the first housing segment 310 and the second housing segment 320. Accordingly, while the first housing segment 310 may be formed from a first material that is transparent to a laser beam, the second housing segment 320 may be formed from a second material that is opaque to the laser beam. Although the first material and the second material may exhibit difference responses to the wavelengths of the laser beam, it should be appreciated that the first material and the second material may be configured to exhibit identical responses to light in the visible spectrum (e.g., wavelengths between 400 and 700 nanometers) such that the first housing segment 310 and the second housing segment 320 are visually identical to a user.

Figure 5A:
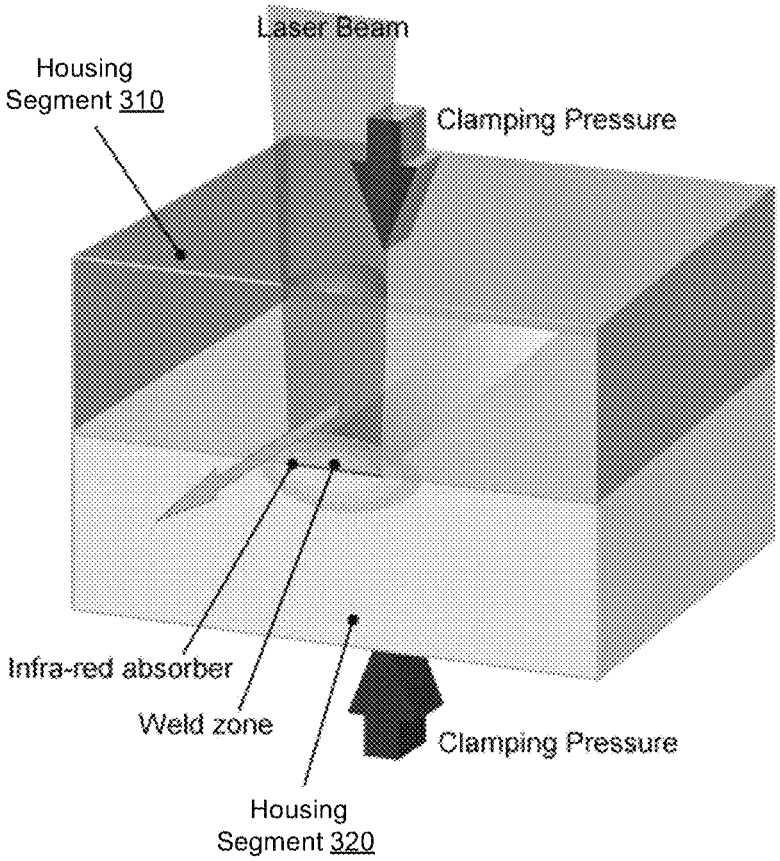
FIG. 5A depicts a perspective view of a cross section of an example of a vaporizer cartridge consistent with implementations of the current subject matter.
Figure 5B:
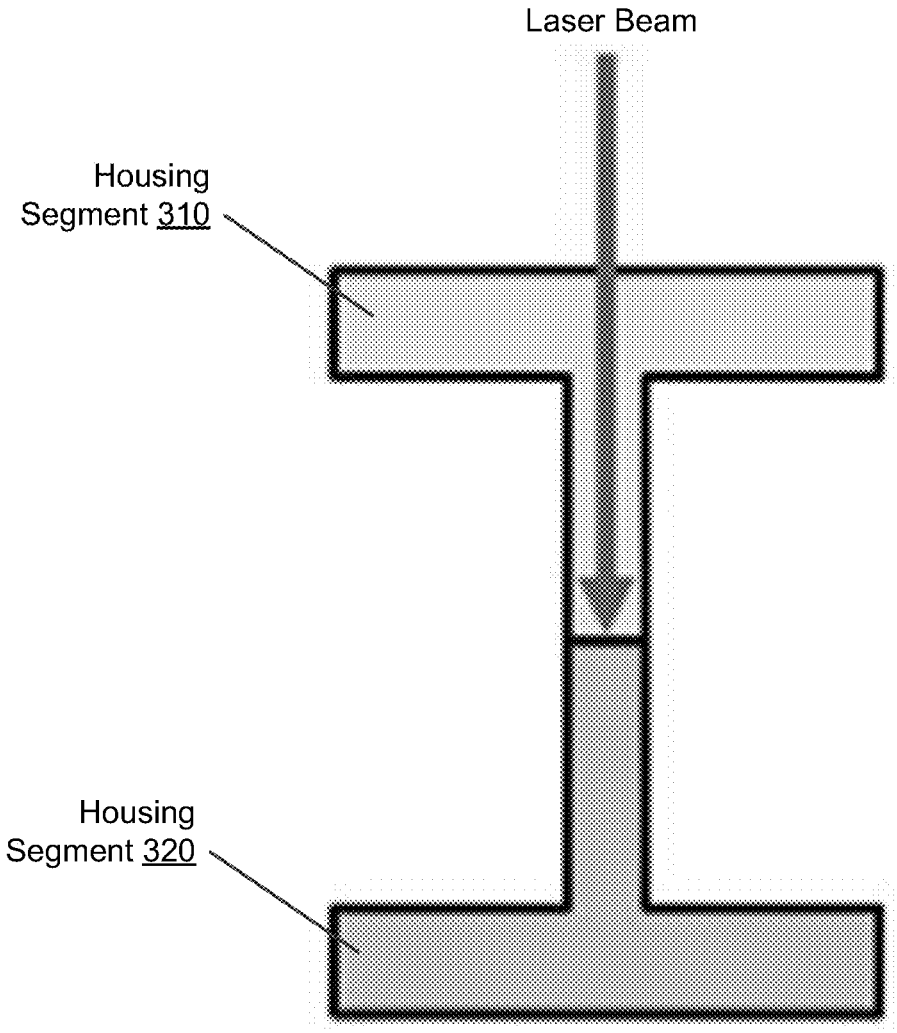
FIG. 5B depicts a planar view of a cross section of an example of a vaporizer cartridge consistent with implementations of the current subject matter.

To further illustrate, FIGS. 5A-B depicts a cross section of an example of the vaporizer cartridge 1320 where the first housing segment 310 is being joined with the second housing segment 320. As shown in FIGS. 5A-B, the first housing segment 310 may be formed from a first material that is transparent to the laser beam (e.g., an infrared laser beam and/or the like) whereas the second housing segment 320 may be formed from a second material that is opaque to the laser beam. Accordingly, while the first housing segment 310 and the second housing segment 320 are secured together, for example, by a clamping pressure, the laser beam may penetrate the first housing segment 310 to reach a weld zone between the first housing segment 310 and the second housing segment 320 where the portion of the second housing segment 320 in the weld zone absorbs the energy from the laser beam. Heat from the laser beam may thus melt the portion of the second housing segment 320 in the weld zone. Moreover, subsequent cooling of the melted portion of the second housing segment 320 in the weld zone may cause the first housing segment 310 and the second housing segment 320 to fuse together, thereby forming a laser weld between the first housing segment 310 and the second housing segment 320.

Alternatively and/or additionally, the first housing segment 310 and the second housing segment 320 may be formed from a first material that is transparent to the laser beam while a film of a second material that is opaque to the laser beam (e.g., the infrared absorber shown in FIG. 5A) may be disposed between the first housing segment 310 and the second housing segment 320, for example, in the weld zone between the first housing segment 310 and the second housing segment 320. Configured as such, the laser beam may penetrate either the first housing segment 310 or the second housing segment 320 to form, in the weld zone between the first housing segment and the second housing segment 320, a laser weld by at least melting the film of the second material disposed in the weld zone.

In some implementations of the current subject matter, instead of the collector 1313 for managing the exchange of air and the vaporizable material 1302 into and out of the reservoir 140, the vaporizer cartridge 1320 may include a different mechanism to prevent a vacuum (or partial vacuum) from forming within the reservoir 140 when the vaporizable material 1302 is drawn from the reservoir 140. FIGS. 8A-E depict various views of an example of the vaporizer cartridge 1320 that includes, instead of the collector 1313, a diaphragm 800 configured to maintain a vacuum (or partial vacuum) within the reservoir 140 such that the pressure within the reservoir 140 is kept below ambient pressure. For example, as shown in FIGS. 8A-E, the diaphragm 800 may be coupled to the first housing segment 310 and cover an air inlet 850 included in the first housing segment 310. The diaphragm 800 may be attached to the first housing segment 310 by a variety of mechanisms including, for example, adhesives, heat staking, laser welding, and/or the like. One side of the diaphragm 800 may define one wall of the reservoir 140. Meanwhile, a pocket may be formed between the opposite side of the diaphragm 800 and the first housing segment 310. The diaphragm 800 may maintain the vacuum (or partial vacuum) within the reservoir 140 by exerting a pulling force against the vaporizable material 1302 in the reservoir 140. Maintaining the vacuum (or partial vacuum) within the reservoir 140 may prevent the vaporizable material 1302 from leaking, for example, through the wicking element 1362.

As shown in FIGS. 8A-E, the vaporizer cartridge 1320 may include the first housing segment 310, the second housing segment 320, the heating element 1350, the wicking element 1362, the identification chip 340, the airflow passageway 1338, the orifice 220, and the one or more contacts 1326. The diaphragm 800 may be coupled to a housing segment, for example, the first housing segment 310. The wicking element 1362 may be in fluid communication with the reservoir 140, which may be disposed on one side of the diaphragm 800. Meanwhile, the air inlet 850 in the first housing segment 310 may be disposed on an opposite side of the diaphragm 800. The air inlet 850 may be configured to admit air into the vaporizer cartridge 1320. For example, when the vaporizable material 1302 is drawn from the reservoir 140, the diaphragm 800 may deflect and distend inward against the reservoir 140 on one side of the diaphragm 800 as air enters through the air inlet 850 to fill a volume on the opposite side of the diaphragm 800. The deflection of the diaphragm 800 may maintain contact between the diaphragm 800 and the vaporizable material 1302 remaining in the reservoir 140 such that the diaphragm 800 may continue to exert a pulling force against the vaporizable material 1302 and maintain the vacuum pressure within the reservoir 140 to prevent the vaporizable material 1302 from leaking, for example, through the wicking element 1362.

Figure 8A:
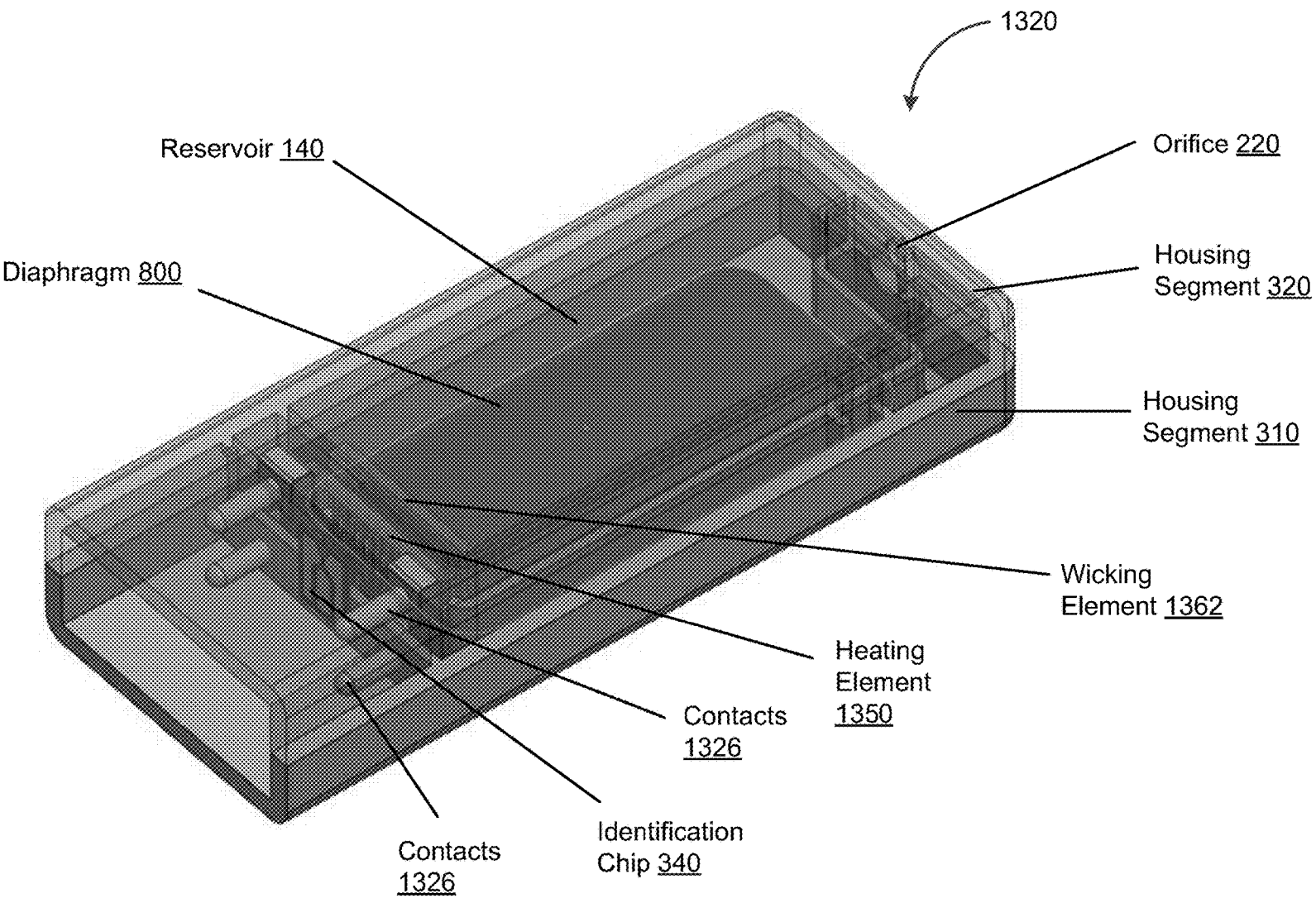
FIG. 8A depicts a transparent perspective view of another example of a vaporizer cartridge consistent with implementations of the current subject matter.
Figure 8B:
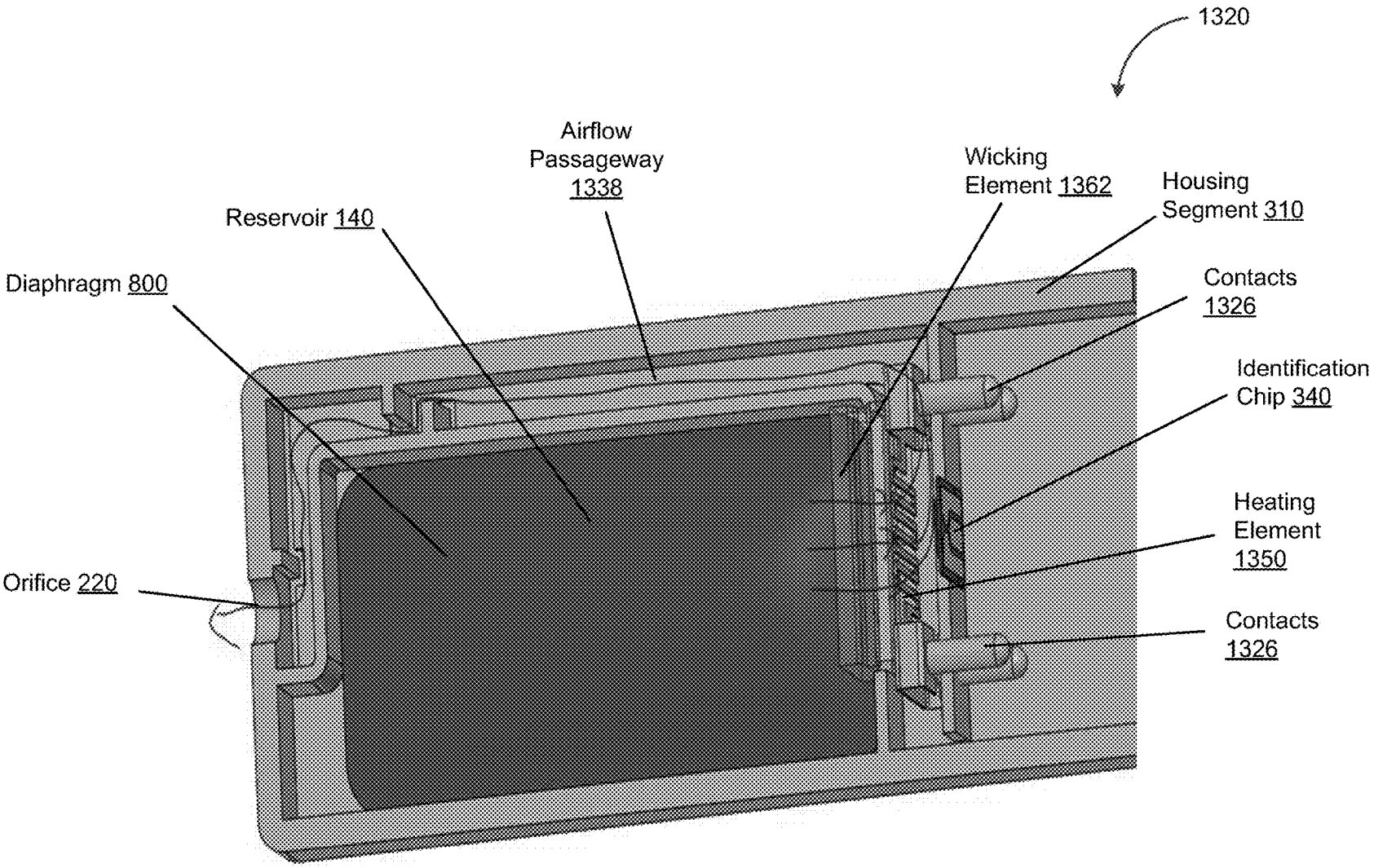
FIG. 8B depicts a cross sectional view of another example of a vaporizer cartridge consistent with implementations of the current subject matter.
Figure 8C:
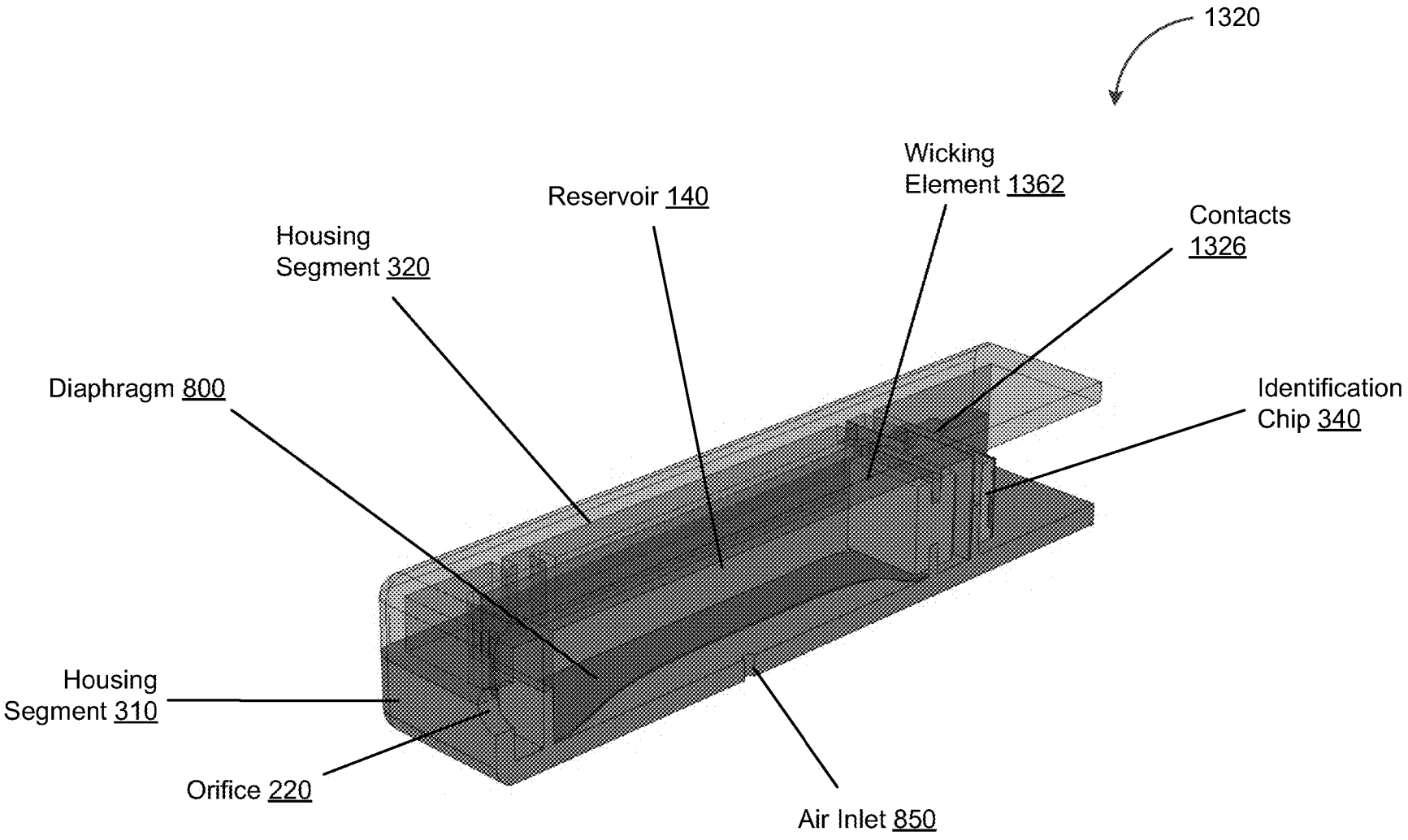
FIG. 8C depicts a cross sectional view of another example of a vaporizer cartridge consistent with implementations of the current subject matter.
Figure 8D:
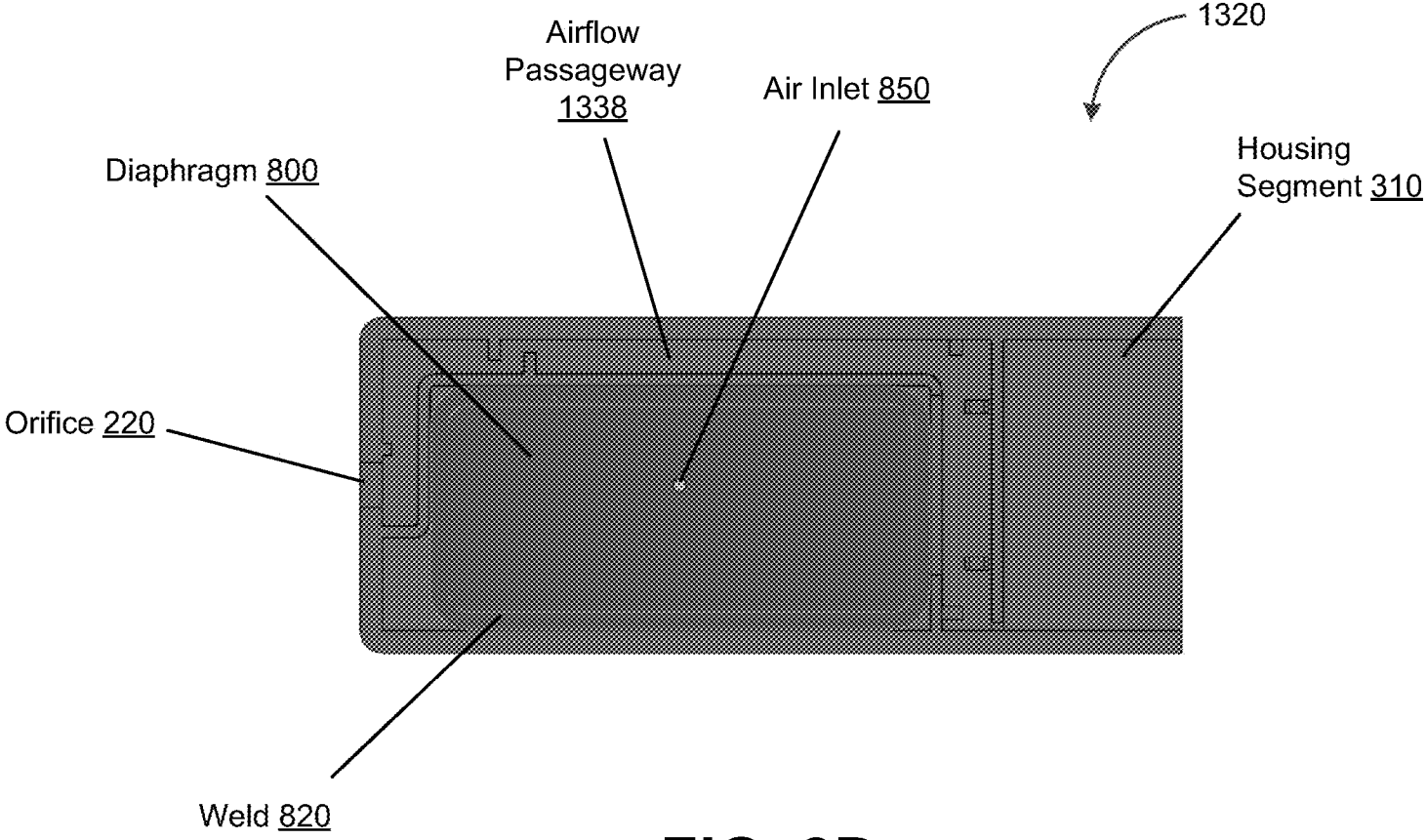
FIG. 8D depicts a transparent top view of another example of a vaporizer cartridge consistent with implementations of the current subject matter.

As noted, the vaporizer cartridge 1320 may be assembled with the diaphragm 800 being coupled to the first housing segment 310 (or the second housing segment 320). A fluid tight seal may be formed around the diaphragm 800 and the first housing segment 310 (or the second housing segment 320). For example, as shown in FIG. 8D, the diaphragm 800 may be joined to the first housing segment 310 (or the second housing segment 320) by a weld 820 (e.g., a laser weld and/or the like) formed around a perimeter of the diaphragm 800. As noted, the diaphragm 800 may be configured to deflect, for example, by distending inward against the reservoir 140 as the vaporizable material 1302 is drawn from the reservoir 140. Accordingly, the diaphragm 800 may be formed from one or more materials exhibiting suitable mechanical properties including, for example, an ability to deflect, distend, and/or the like. For instance, the diaphragm 800 may be formed from an elastic material (e.g., a natural rubber, a synthetic rubber, a nitrile rubber, a silicone rubber, a urethane rubber, a chloroprene rubber, an ethylene vinyl acetate (EVA) rubber, a thermoplastic elastomer (TPE), and/or the like) that is capable of expanding and contracting depending on the quantity of the vaporizable material 1302 included in the reservoir 140. Moreover, the material forming the diaphragm 800 may be selected based on its bonding properties (e.g., for forming a fluid tight seal with the first housing segment 310 and/or the second housing segment 320) as well as its compatibility with the vaporizable material 1302 (e.g., stable when exposed to the vaporizable material 1302).

In some implementations of the current subject matter, the diaphragm 800 may be in an undistended or a minimally distended state when an initial volume of the vaporizable material 1302 is disposed in the reservoir 140. As portions of the vaporizable material 1302 is drawn from the reservoir 140 on one side of the diaphragm 800, the diaphragm 800 may distend inward as air enters the vaporizer cartridge 1320 through the air inlet 850 and fills a volume on an opposite side of the diaphragm 800. For example, FIG. 8C shows the diaphragm 800 being distended at least partially due to portions of the vaporizable material 1302 being drawn from the reservoir 140 on one side of the diaphragm 800 and air entering the vaporizer cartridge 1320 on the opposite side of the diaphragm 800. Portions of vaporizable material 1302 may be drawn out of the reservoir 140 by the wicking element 1362 and vaporized by the heat generated by the heating element 1350 to generate an inhalable aerosol that travels through the airflow passageway 1138 and exits the orifice 220 for delivery to a user.

The distention of the diaphragm 800 may maintain contact between the diaphragm 800 and the vaporizable material 1302 remaining in the reservoir 140 such that the diaphragm 800 may continue to maintain a vacuum (or partial vacuum) within the reservoir 140 by at least exerting a pulling force against the remaining vaporizable material 1302. The presence of a vacuum (or partial vacuum) may, as noted, prevent leakage of the vaporizable material 1302, for example, through the wicking element 1362. The diaphragm 800 may continue to distend until the diaphragm 800 reaches an opposite side of the reservoir 140, for example, the wall of the second housing segment 320. Alternatively, the diaphragm 800 may distend until the pressure inside the reservoir 140 is sufficiently low (e.g., a threshold quantity below ambient pressure) to draw air into the reservoir 140 through the wicking element 1362 (or a controlled orifice such as a wick vent 866). For example, air may enter the reservoir 140 when the pressure within the reservoir 140 is sufficiently negative relative to ambient pressure to cause air to be drawn into the reservoir 140, for example, through the wicking element 1362, around the wicking element 1362, through a controlled orifice (e.g., the wick vent 866), and/or the like. It should be appreciated that the magnitude of the pulling force exerted by the diaphragm 800, the propensity of the diaphragm 800 to (or against) distending, and the magnitude of the distension exhibited by the diaphragm 800 may vary in accordance with one or more properties of the diaphragm 800 including, for example, material, thickness, size, shape, and/or the like.

The diaphragm 800 may provide a number of advantages including, a decoupling between the characteristics of the vaporizable material 1302 and the mechanism for maintaining vacuum pressure (or backpressure) within the reservoir 140. That is, the diaphragm 800 may be capable of maintaining vacuum pressure within the reservoir 140 and preventing leakage of the vaporizable material 1302 regardless of the variations in the properties (e.g., surface tension, viscosity, and/or the like) of the vaporizable material 1302 that may arise due to environmental factors and/or across different varieties of the vaporizable material 1302, as well as variations in the properties of the cartridge components in contact with the vaporizable material 1302 due to variations in the interface (e.g., wetting angle) between the vaporizable material 1302 and the cartridge components. As such, the vaporizer cartridge 1320 including the diaphragm 800 may be suitable for a large variety of the vaporizable material 1302. Furthermore, the diaphragm 800 may be more spatially efficient. For instance, the capacity of the vaporizer cartridge 1320 implemented with the diaphragm 800 may be increased without requiring a corresponding increase in the size of the vaporizer cartridge 1320. Alternatively, the size of the vaporizer cartridge 1320 may be reduced by including the diaphragm 800 and/or by varying the dimensions of the diaphragm 800.

Figure 8E:
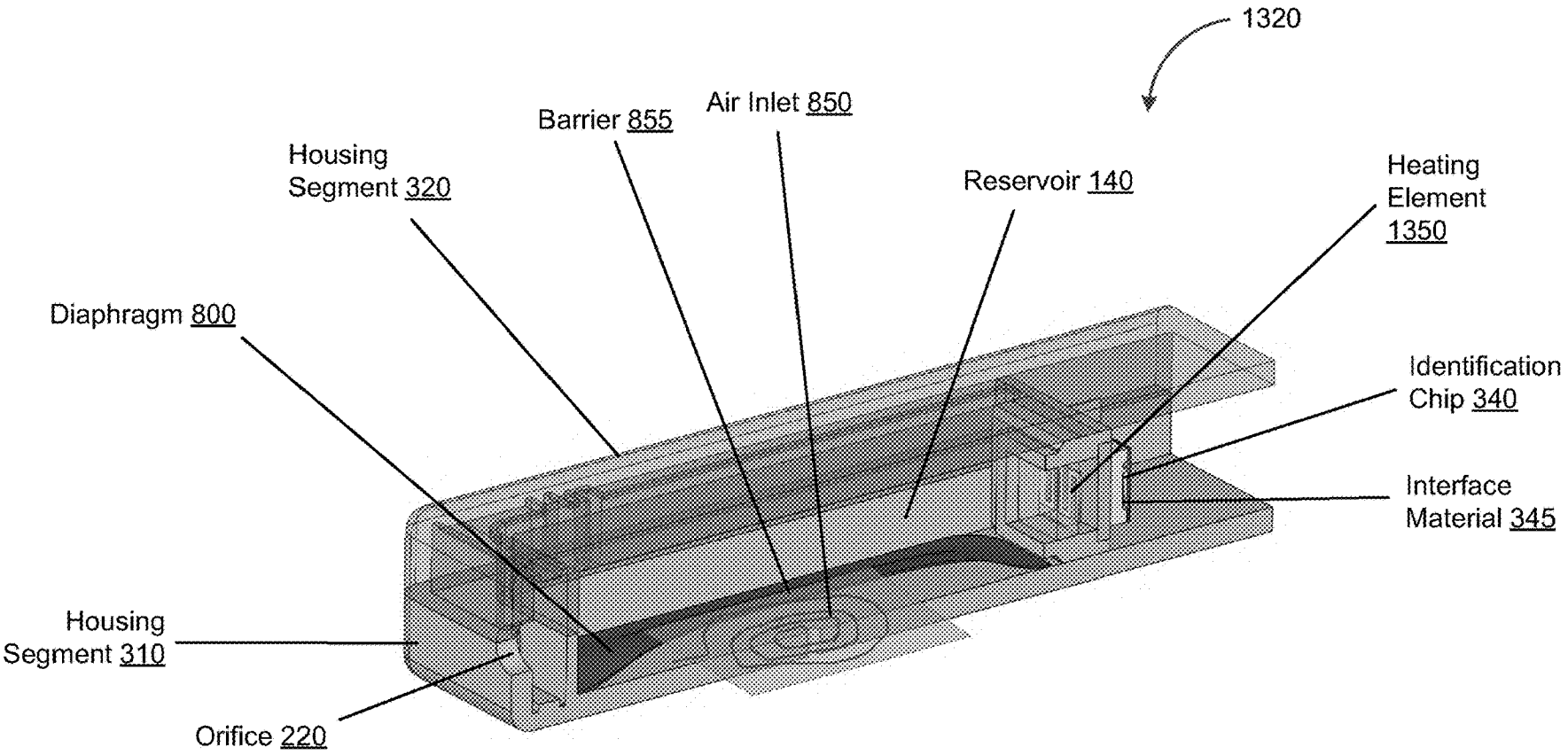
FIG. 8E depicts another cross sectional view of another example of a vaporizer cartridge consistent with implementations of the current subject matter.

FIG. 8E depicts a cross sectional view of an example of the vaporizer cartridge 1320 having a variation of the air inlet 850 configured to minimize the transmission of vapor (e.g., water vapor) that may diffuse through the diaphragm 800. As noted, the air inlet 850 may be configured to admit air into the vaporizer cartridge 1320 such that the air may fill a volume on an opposite side of the diaphragm 800 from the reservoir 140. In the example of the vaporizer cartridge 1320 shown in FIGS. 8C-D, the air inlet 850 may be an aperture through the first housing segment 310, which may not be able to minimize the transmission of vapor. Alternatively, in the example of the vaporizer cartridge 1320 shown in FIG. 8E, the air inlet 850 may be a channel (e.g., a spiraling channel) that is formed by molding a groove into the wall of the first housing segment 310 and covering the groove with a barrier 855 (e.g., a metallized film and/or the like) that is coupled to the first housing segment 310 by heat staking, laser welding, and/or the like.

By implementing the air inlet 850 as a channel instead of an aperture, the air inlet 850 may provide a path that is more resistant to the transmission of vapor (e.g., water vapor) but still conducive to air flow into the vaporizer cartridge 1320. As noted, air entering through the air inlet 850 may fill a volume on a side of the diaphragm 800 opposite of the reservoir 140 such that the diaphragm 800 may distend sufficiently to maintain contact with the vaporizable material 1302 remaining in the reservoir 140 as the vaporizable material 1302 is drawn from the reservoir 140. When implemented as the channel shown in FIG. 8E, the air inlet 850 may admit air into the vaporizer cartridge 1320 but minimize the transmission of the vapor (e.g., water vapor) that diffuses across the diaphragm 800. For example, the air inlet 850 may be configured to have a length to cross sectional area ratio of at least 30 to 1 (or a different length to cross-sectional area ratio) in order for the resulting channel to prevent the passage of vapor while still permitting air flow.

FIGS. 10A-D depicts various views of another example of the vaporizer cartridge 1320 consistent with implementations of the current subject matter. As shown in FIGS. 10A-D, the vaporizer cartridge 1320, which may include the first housing segment 310, the second housing segment 320, the heating element 1350, the wicking element 1362, the diaphragm 800, the identification chip 340, the airflow passageway 1338, the orifice 220, and the one or more contacts 1326, may further include a preload 810 configured to preset the diaphragm 800 against one or more positional limits including, for example, an undistended or minimally distended position of the diaphragm 800, a maximally distended position of the diaphragm 800, and/or the like. In doing so, the preload 810 may maintain vacuum pressure within the reservoir 140 prior to use of the vaporizer cartridge 1320 such that the vaporizable material 1302 is retained within the reservoir 140 even when the vaporizer cartridge 1320 is subjected to environmental and/or mechanical shocks such as changes in orientation, accelerations, and/or the like. For example, the preload 810 may prevent air from entering the vaporizer cartridge 1320 (e.g., through the air inlet 850), cause an inadvertent distention of the diaphragm 800, and leakage of the vaporizable material 1302 from the reservoir 140 by distending the diaphragm 800. The properties of the diaphragm 800 may be such that the diaphragm 800 may be more prone to being distended from an initial, undistended state than from a subsequent, distended state. The preload 810 may therefore minimize the likelihood of leakage when the diaphragm 800 is in the initial, undistended state.

In the example of the vaporizer cartridge 1320 shown in FIGS. 10A-D, the preload 810 is shown as a spring (e.g., a leaf spring, a bias spring, and/or the like) formed from a variety of material including, for example, plastic, metal, and/or the like. However, it should be appreciated that the preload 810 may be configured in a variety of manner including, for example, as a coil, a beam, and/or the like. Furthermore, instead of and/or in addition to the preload 810, the diaphragm 800 may be preset by withdrawing a portion of the initial volume of the vaporizable material 1302 from the reservoir 140. As noted, the diaphragm 800 may be more prone to being distended from an initial, undistended state than from a subsequent, distended state. The withdrawal of the vaporizable material 1302 may thus preset the diaphragm 800 in a distended state that is less prone to inadvertent distention.

Figure 10A:
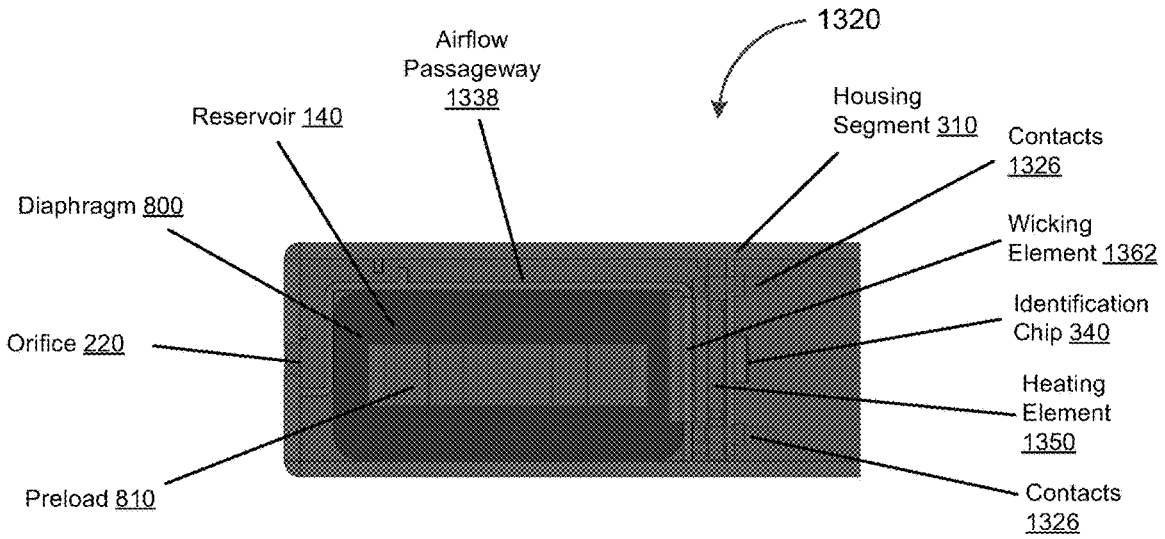
FIG. 10A depicts a transparent top view of an example of a vaporizer cartridge consistent with implementations of the current subject matter.
Figure 10B:
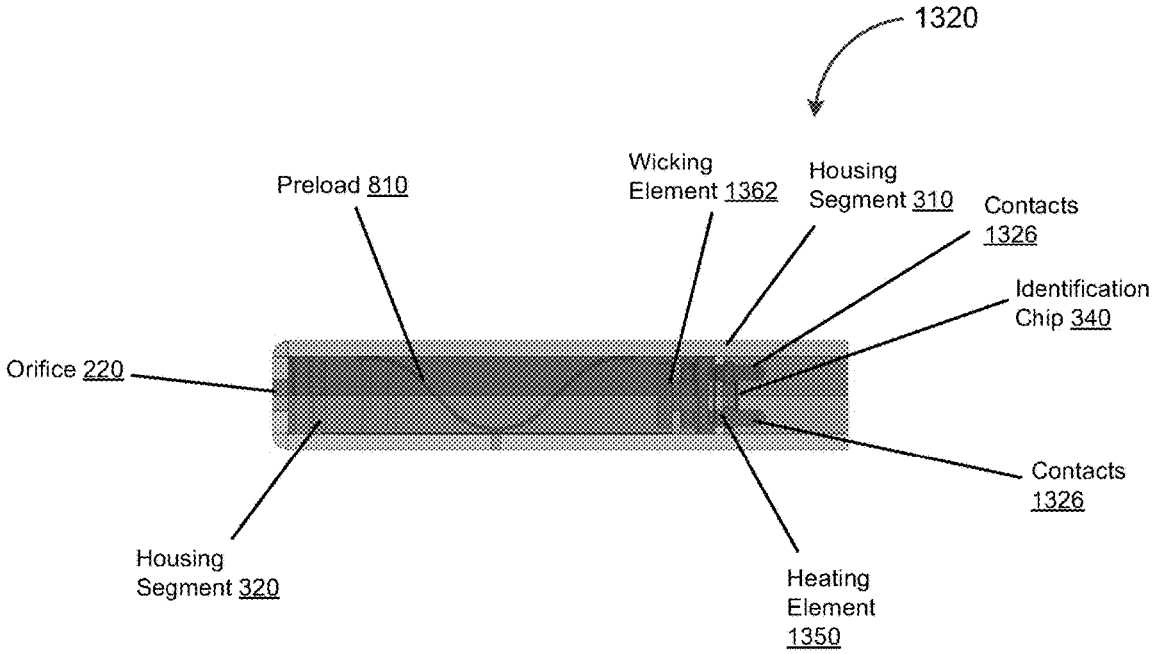
FIG. 10B depicts a transparent side view of an example of a vaporizer cartridge consistent with implementations of the current subject matter.
Figure 10C:
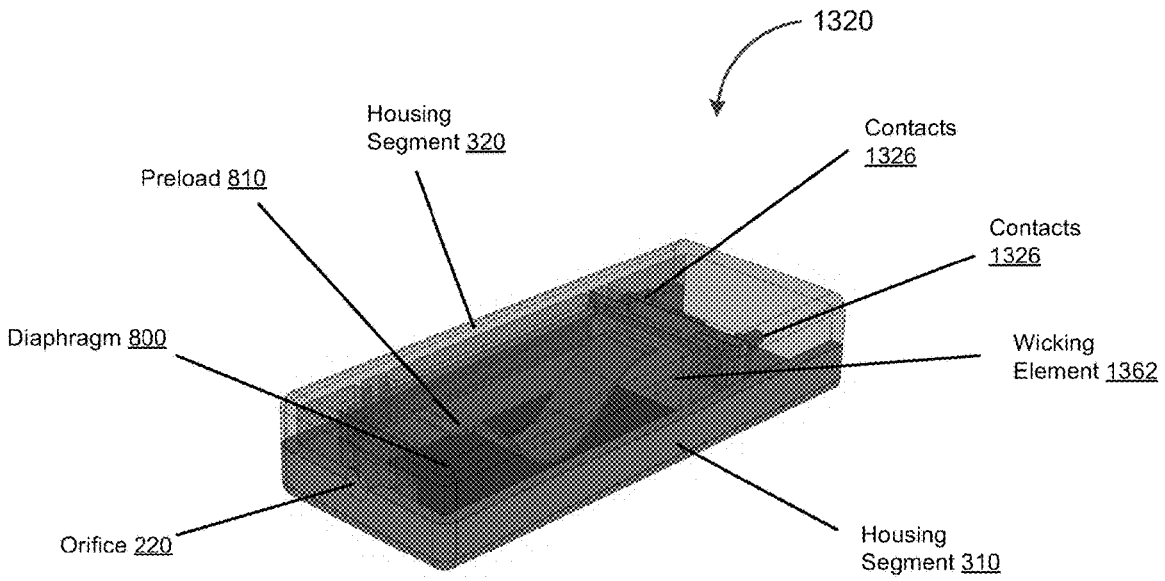
FIG. 10C depicts a transparent perspective view of an example of a vaporizer cartridge consistent with implementations of the current subject matter.
Figure 10D:
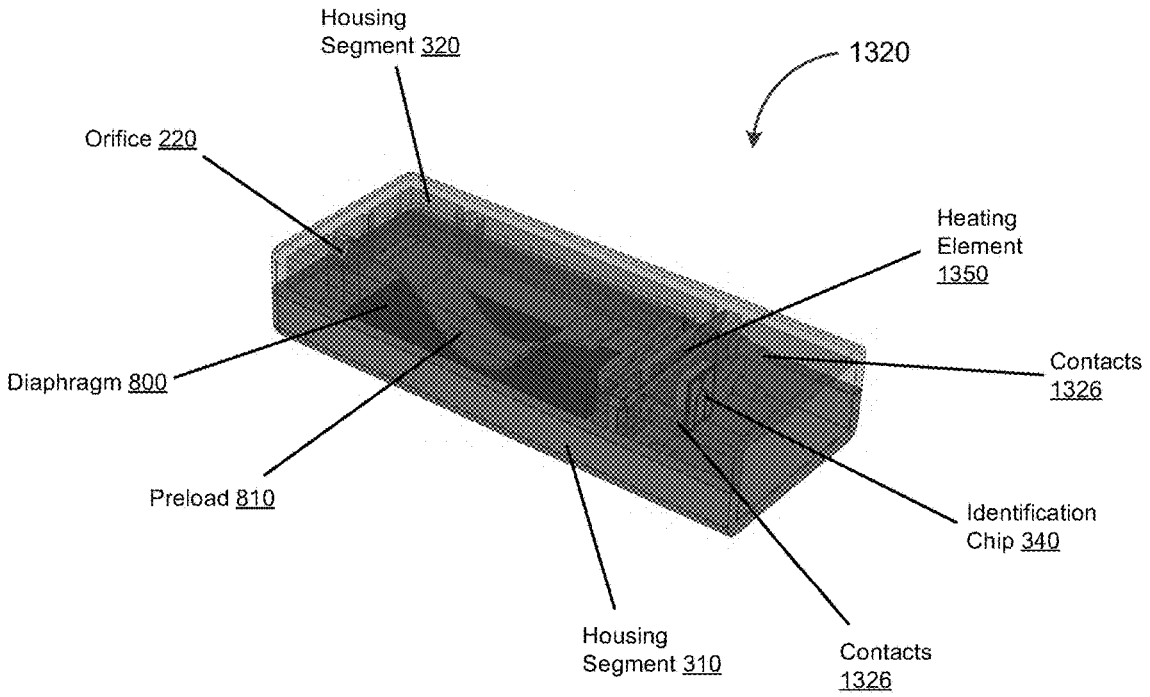
FIG. 10D depicts another transparent perspective view of an example of a vaporizer cartridge consistent with implementations of the current subject matter.
Figure 10G:
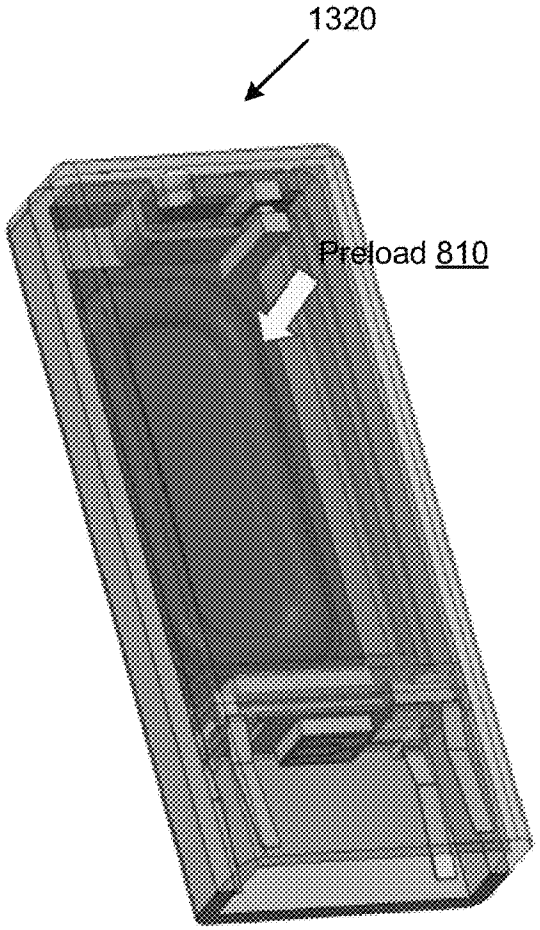
FIG. 10G depicts a transparent perspective view of a vaporizer cartridge having another example of a preload consistent with implementations of the current subject matter.
Figure 10F:
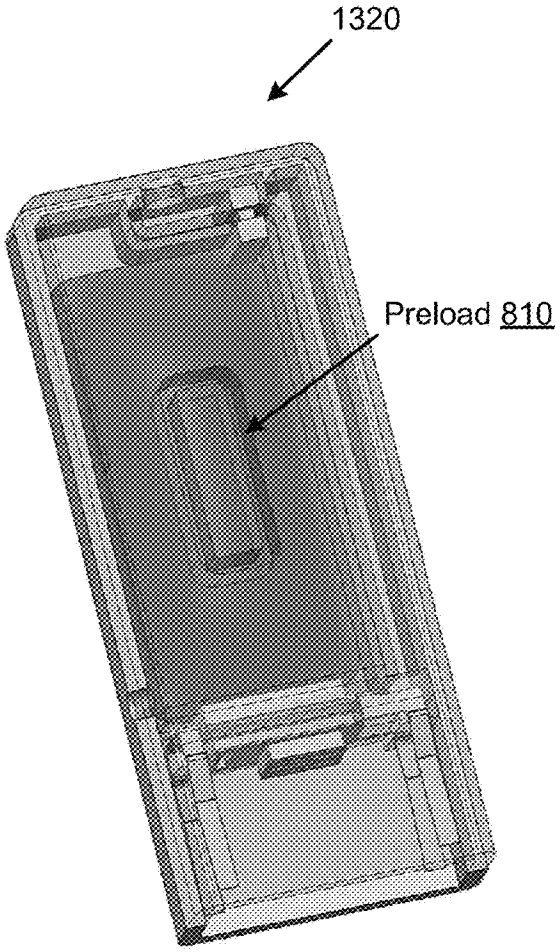
FIG. 10F depicts a transparent perspective view of a vaporizer cartridge having another example of a preload consistent with implementations of the current subject matter.
Figure 10E:
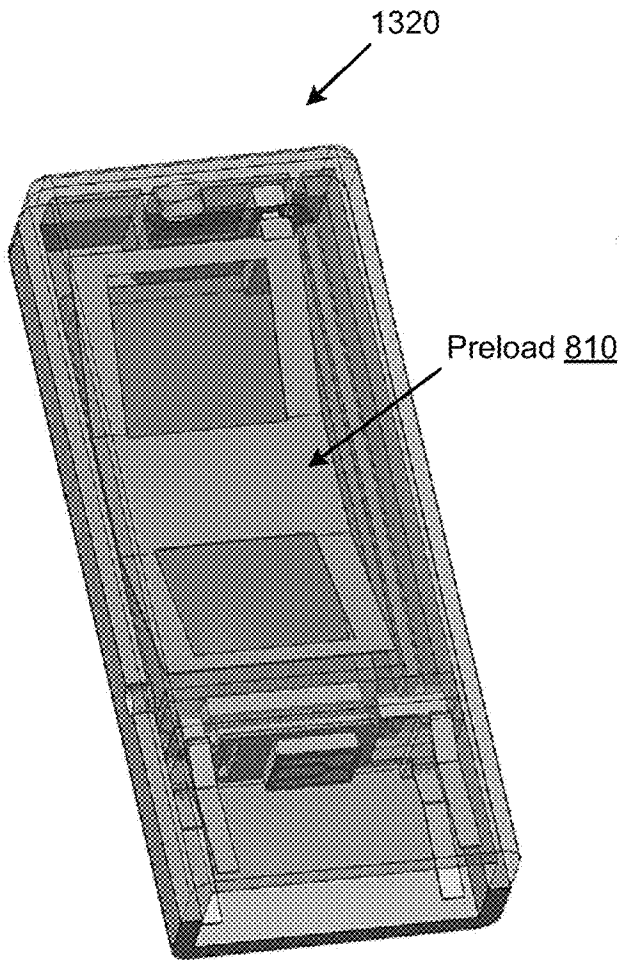
FIG. 10E depicts a transparent perspective view of a vaporizer cartridge having an example of a preload consistent with implementations of the current subject matter.

FIGS. 10E-G depict transparent perspective views of the vaporizer cartridge 1320 having additional examples of the preload 810 consistent with implementations of the current subject matter. As noted, the preload 810 configured to impose one or more positional limits including, for example, an undistended or minimally distended position of the diaphragm 800, a maximally distended position of the diaphragm 800, and/or the like. Referring to FIG. 10E, one example of the preload 810 may be a spring loading. In addition to imposing one or more position limits, the force exerted by the spring loading against the diaphragm 800 may impose precise pressure controls that prevent excessive distensions of the diaphragm 800. As shown in FIG. 10E, one or more graphic designs may be applied to the spring loading, for example, by stamping, embossing, ink deposits, and/or the like.

Referring to FIG. 10F, the preload 810 may also be implemented as a backstop protruding from the second housing segment 320. The backstop may prevent the diaphragm 800 from distending beyond a maximally distended position corresponding to one or more dimensions of the backstop. In the example shown in FIG. 10F, the backstop may also include one or more graphics designs. For added compliance, FIG. 10G depicts an example of the preload 810 that is implemented as one or more features on the diaphragm 800. For instance, as shown in FIG. 10G, the preload 810 may include one or more projections on the surface of the diaphragm 800. Such projections, which may assume a variety of shapes including any desired graphic designs, may have one or more dimensions (e.g., depth, height, thickness, and/or the like) corresponding to a positional limit of the diaphragm 800. For example, the ridge shown in FIG. 10G may prevent the diaphragm 800 from distending beyond the certain point set by the depth of the ridge.

As noted, the wicking element 1362 and the heating element 1350 may form the atomizer 141 of the vaporizer cartridge 1320. According to various implementations of the current subject matter, the atomizer 141 may be an integrated assembly or a separate subassembly of the vaporizer cartridge 1320. To further illustrate, FIGS. 11A-B depict different cross sectional views of an example of the vaporizer cartridge 1320 in which the atomizer 141 is part of an integrated assembly for the vaporizer cartridge 1320.

Figure 11A:
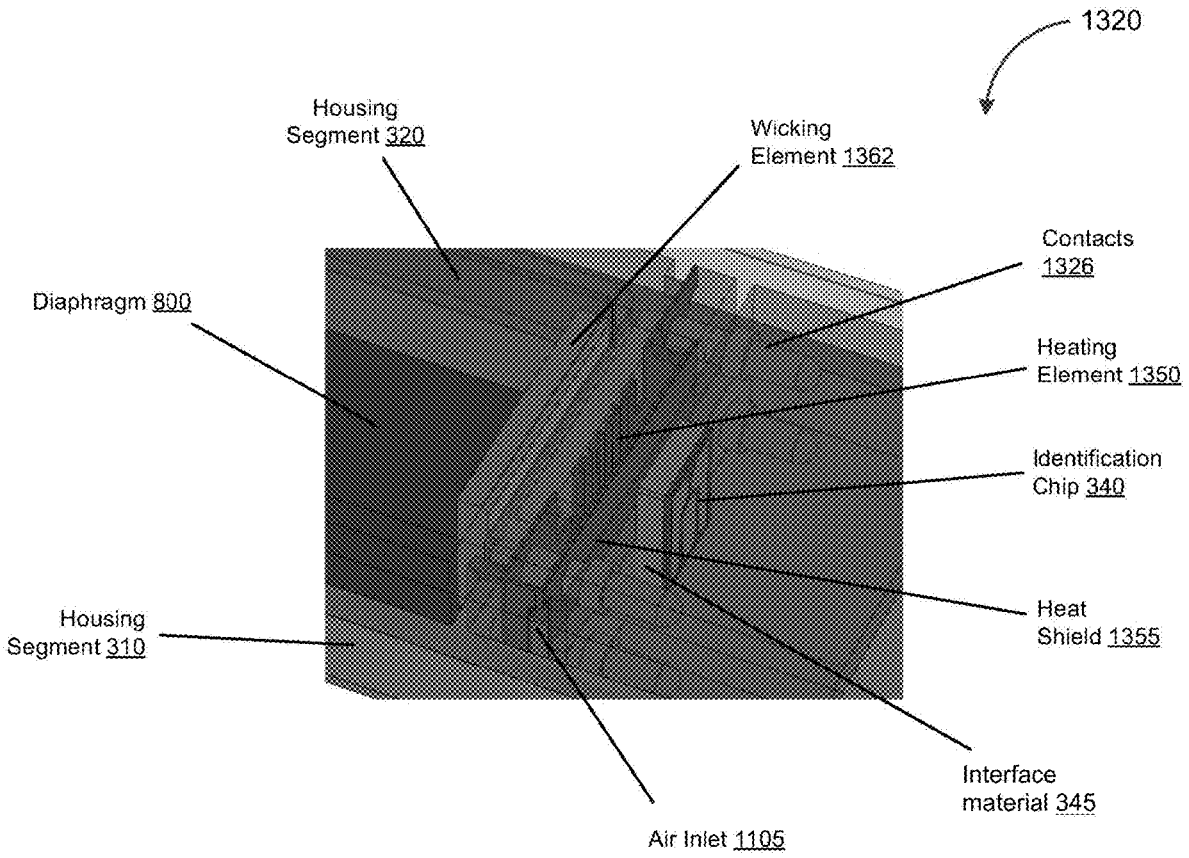
FIG. 11A depicts a cross-sectional view of an example of an integrated atomizer assembly for a vaporizer cartridge consistent with implementations of the current subject matter.
Figure 11B:
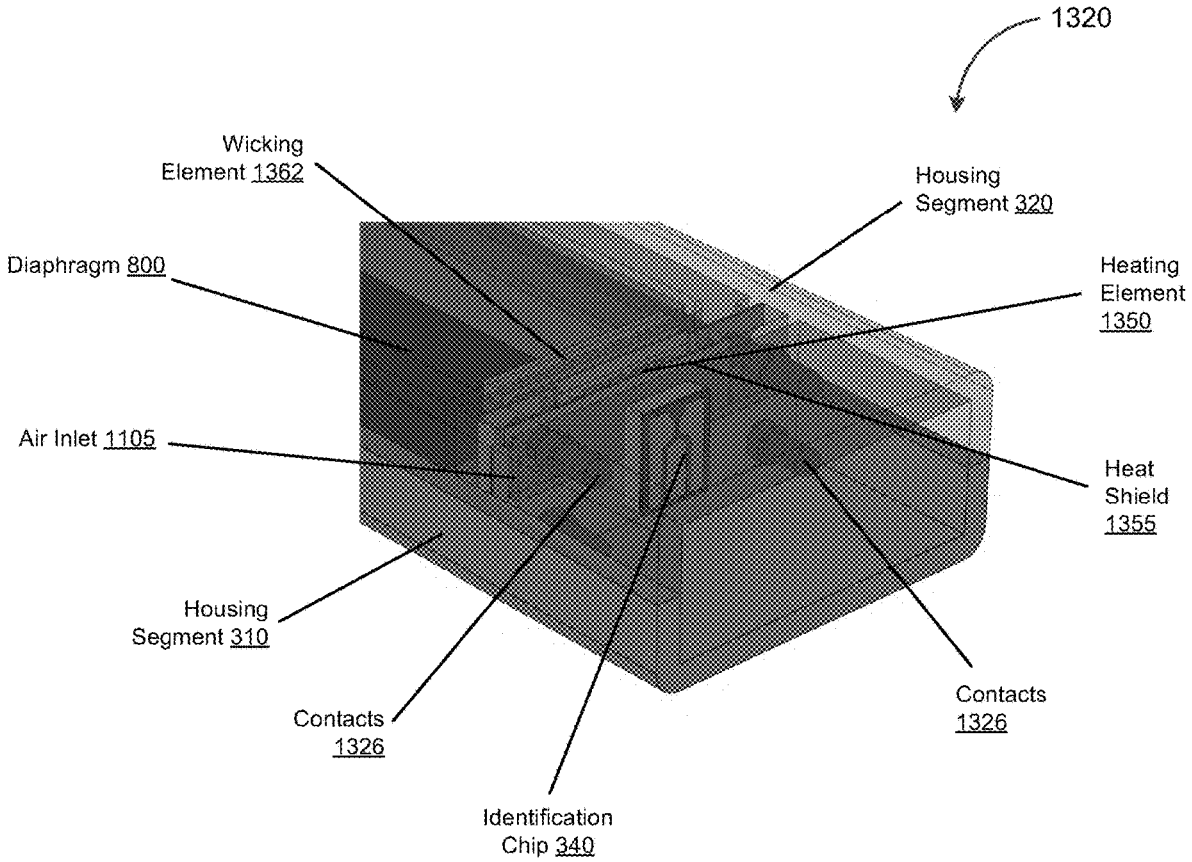
FIG. 11B depicts another cross-sectional view of an example of an integrated atomizer assembly for a vaporizer cartridge consistent with implementations of the current subject matter.

Referring to FIGS. 11A-B, the atomizer 141 may include the wicking element 1362 disposed adjacent to the heating element 1350. Proximity between the wicking element 1362 and the heating element 1350 may improve the flow of the vaporizable material 1302 towards the heating element 1350 at least because flow constriction may be minimized by a short flow distance and by the heat generated by the heating element 1350 reducing a viscosity of the vaporizable material 1302 near the wicking element 1362. The atomizer 141 may include an air inlet 1105 configured to admit ambient air, for example, when air is drawn into the vaporizer cartridge 1320 by a user puffing on the vaporizer device 100. Air entering through the air inlet 1105 may pass over the heating element 1350 and mix with the liquid vaporizable material 1302.

Referring again to FIGS. 11A-B, the contacts 1326 may be inserted through the first housing segment 310 and/or the second housing segment 320 with press fit to provide a hermetic seal that prevents leakage of the vaporizable material 1302 through the contacts 1326. The heating element 1350 shown in FIGS. 11A-B may include a heat shield 1355 configured to protect the housing of the vaporizer cartridge 1320 (e.g., the first housing segment 310 and the second housing segment 320) from exposure to excess heat from the heating element 1350. Furthermore, instead of being attached directly to the housing of the vaporizer cartridge 1320, the identification chip 340 may be attached to the vaporizer cartridge 1320 via an interface material 345 (e.g., a compliant elastomer, a foam, and/or the like) configured to maximize contact between the identification chip 340 and the vaporizer body 110 as well as between the contacts 1326 and the corresponding receptacle contacts 125 in the vaporizer body 110 when the vaporizer cartridge 1320 is coupled with the vaporizer body 110. In implementations of the current subject matter where the identification chip 340 includes three contacts, the identification chip 340 may be self-leveling to ensure an adequate degree of contact with each of the three contacts.

Figure 12A:
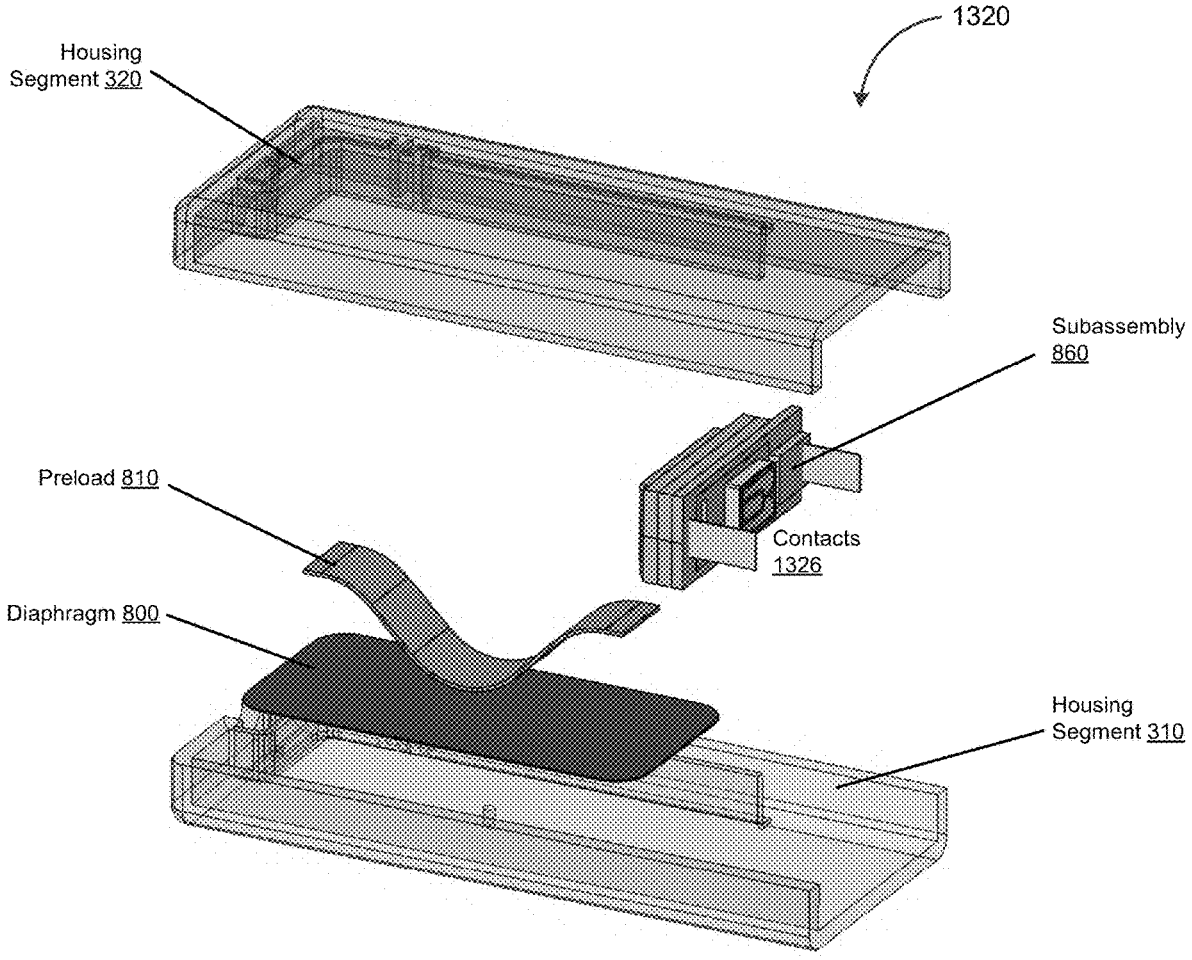
FIG. 12A depicts an exploded view of an example of a vaporizer cartridge having an atomizer subassembly consistent with implementations of the current subject matter.
Figure 12B:
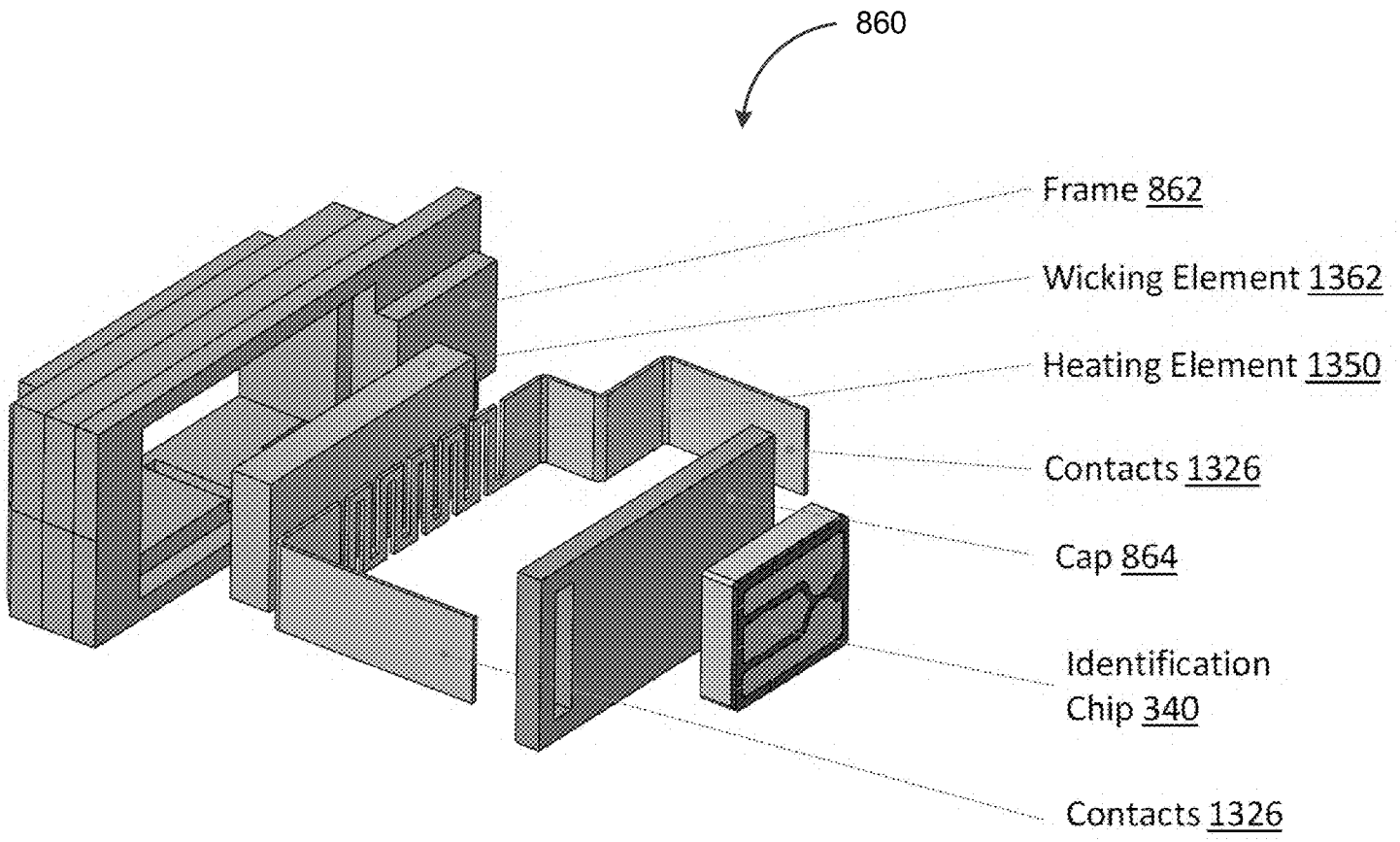
FIG. 12B depicts an exploded view of an example of an atomizer subassembly consistent with implementations of the current subject matter.
Figure 12C:
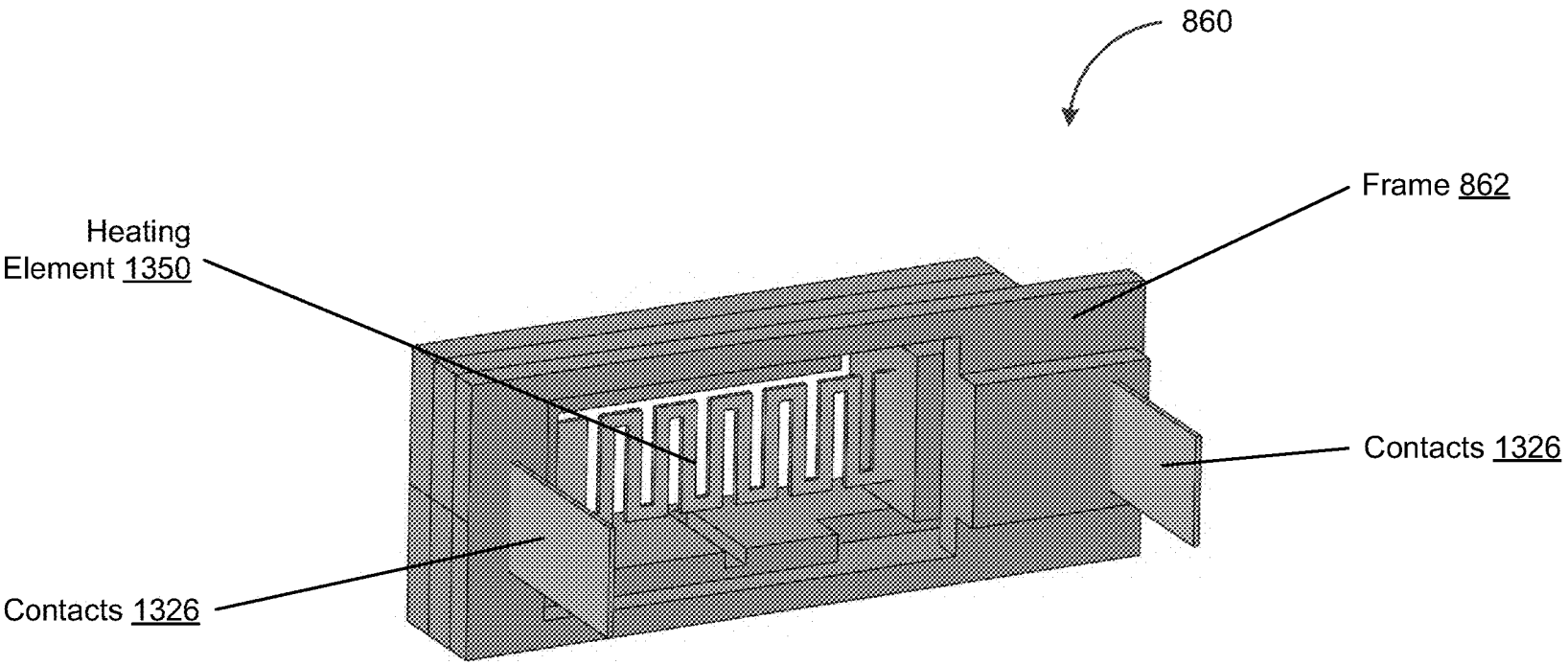
FIG. 12C depicts a perspective view of an example of an atomizer subassembly consistent with implementations of the current subject matter.

FIG. 12A depict an exploded view of an example of the vaporizer cartridge 1320 in which the atomizer 141 is part of a subassembly 860 for the vaporizer cartridge 1320. FIGS. 12B-C depict various examples of the subassembly 860 consistent with implementations of the current subject matter. Referring to FIGS. 12A-C, the subassembly 860 may include the wicking element 1362, the heating element 1350, the identification chip 340 (optional), and a frame 862. In the example of the subassembly 860 shown in FIG. 12B, the wicking element 1362 and the heating element 1350 may be secured to the frame 862 by a cap 864. One or more portions of the heating element 1350 extending beyond the cap 864 may form the contacts 1326 while the identification chip 340 may be coupled to an exposed surface of the cap 864. Alternatively, FIG. 12C shows that the heating element 1350 as being integrated into the frame 862, for example, by over molding, insert molding, and/or the like, such that a hermetic seal is present between the frame 862 and the contacts 1362 formed by the portions of the heating element 1350 extending beyond the frame 862.

Figure 12D:
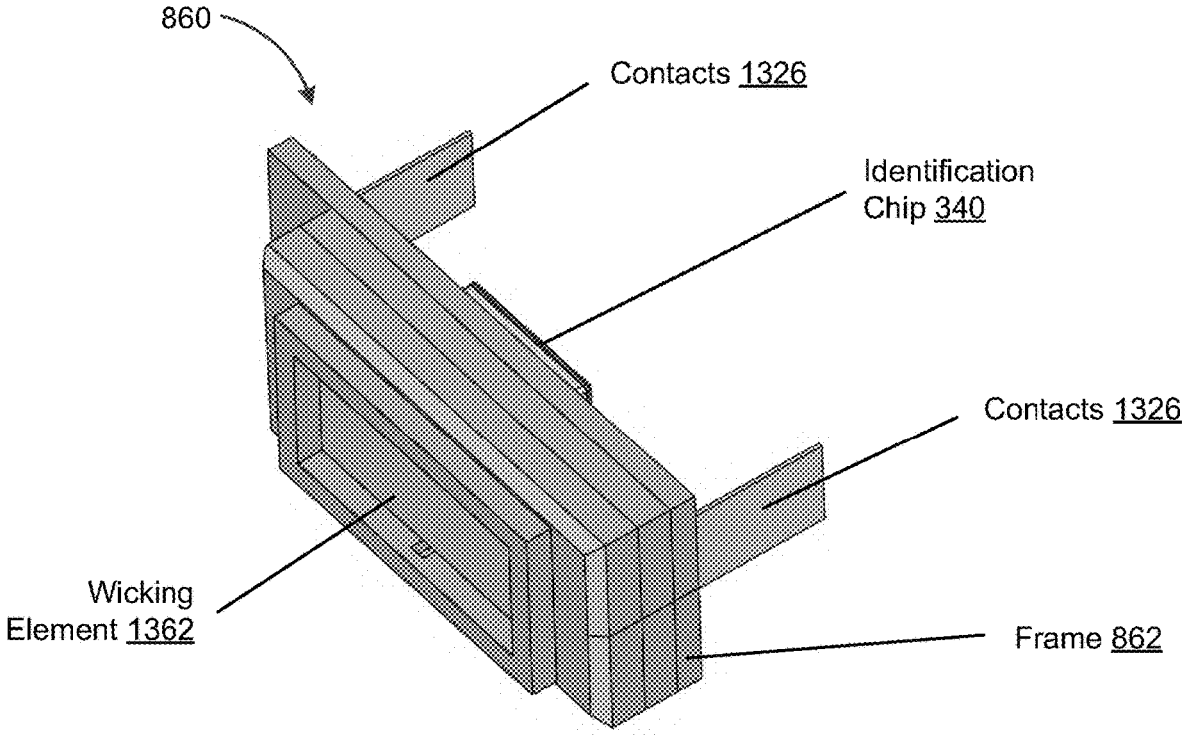
FIG. 12D depicts another perspective view of an example of an atomizer subassembly consistent with implementations of the current subject matter.
Figure 12E:
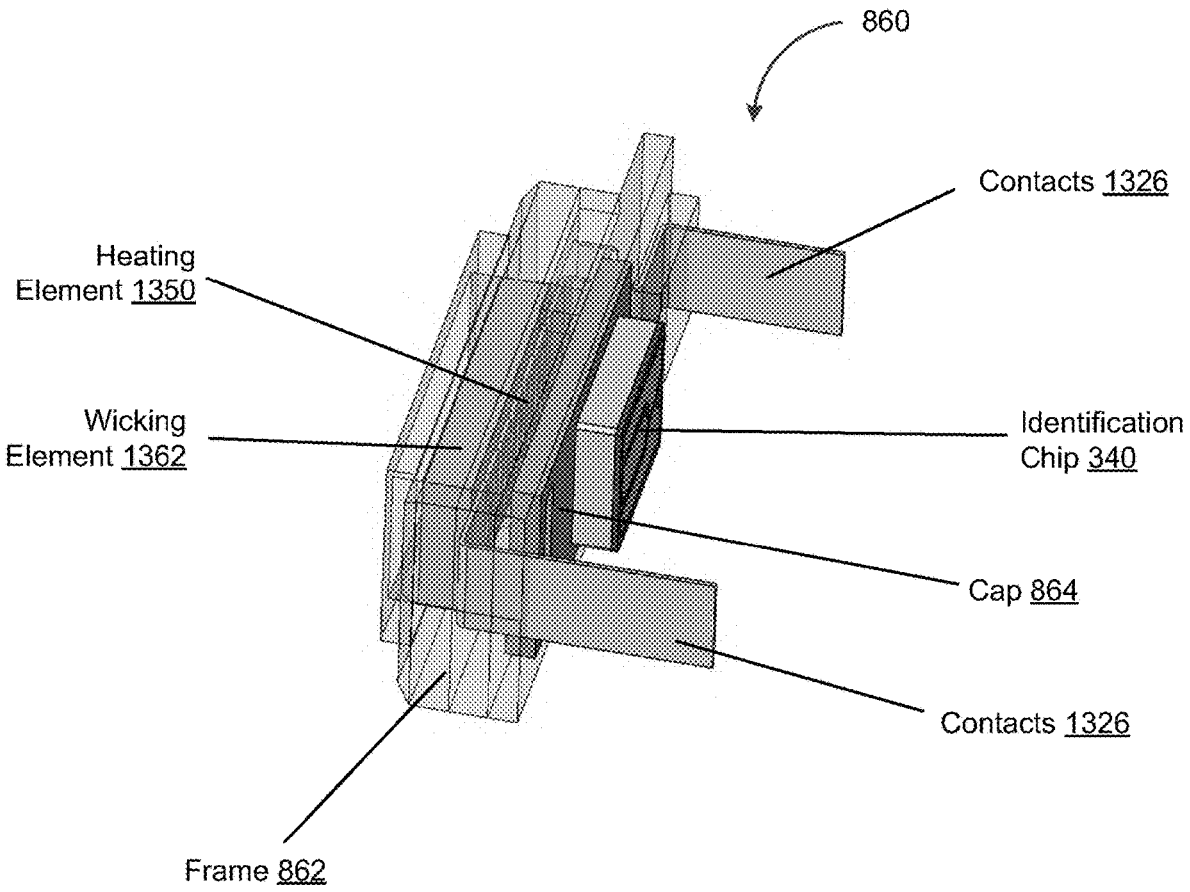
FIG. 12E depicts another perspective view of an example of an atomizer subassembly consistent with implementations of the current subject matter.
Figure 12F:
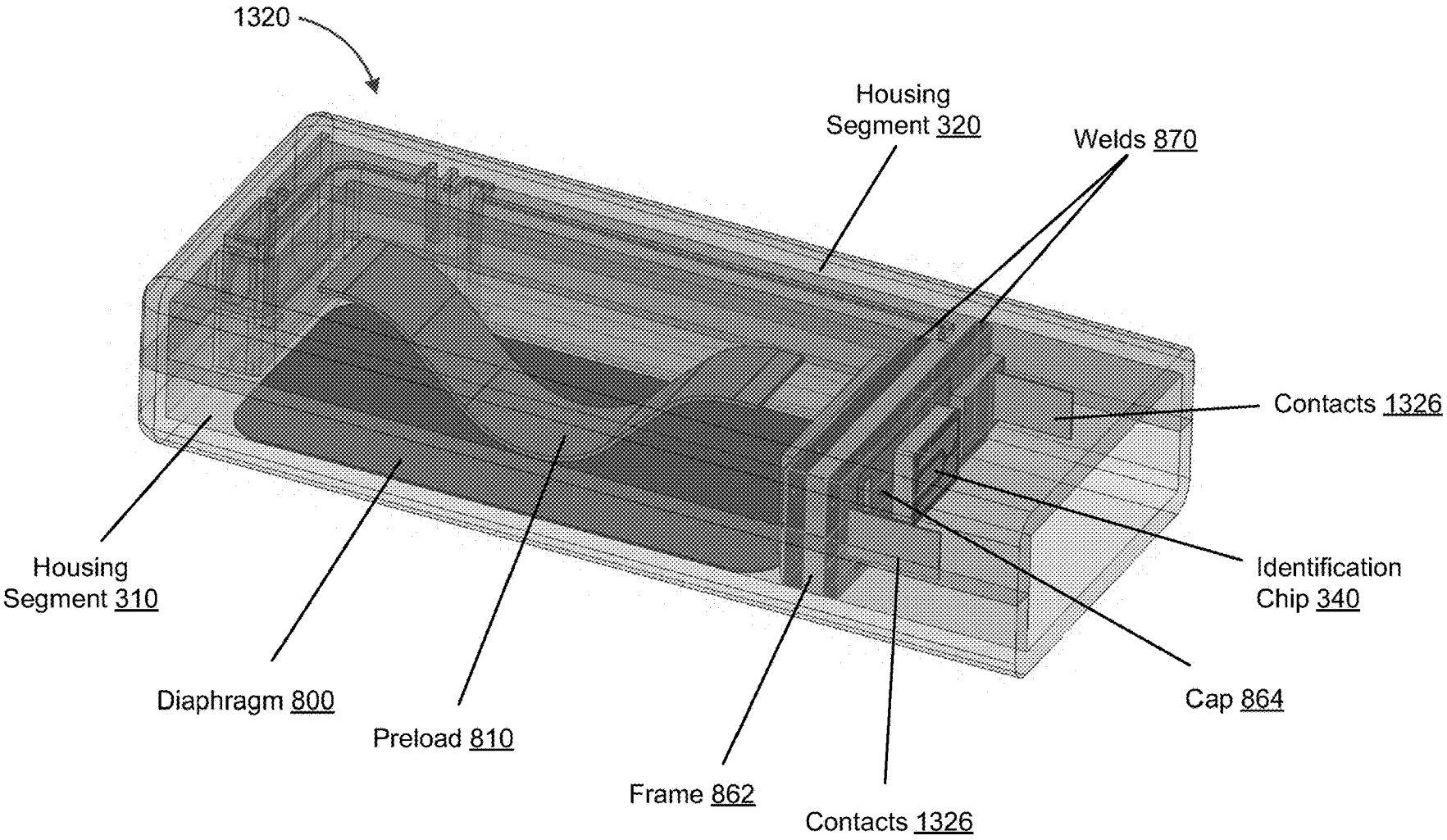
FIG. 12F depicts a transparent perspective view of an example of a vaporizer cartridge having an atomizer subassembly consistent with implementations of the current subject matter.
Figure 12G:
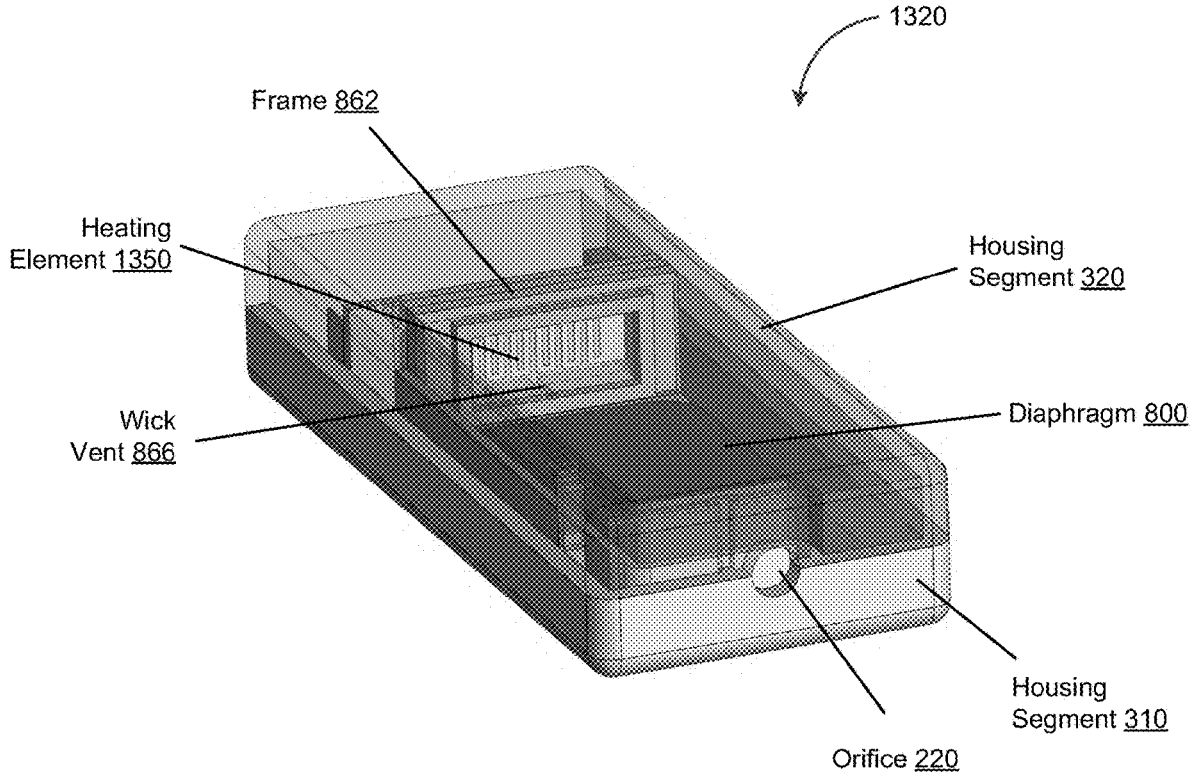
FIG. 12G depicts another transparent perspective view of an example of a vaporizer cartridge having an atomizer subassembly consistent with implementations of the current subject matter.

FIGS. 12D-E depict perspective views of the subassembly 860 consistent with implementations of the current subject matter. As shown in FIGS. 12D-E, when assembled, at least a portion of the wicking element 1362 may be exposed through the frame 862 such that the wicking element 1362 may be in fluid communication with the vaporizable material 1302 in the reservoir 1302. Moreover, as noted, one or more portions of the heating element 1350 extending beyond the frame 862, for example, the cap 864, may form the contacts 1326. FIG. 12G depicts a transparent perspective view of an example of the vaporizer cartridge 1320 in which the frame 862 includes an optional controlled orifice, for example, the wick vent 866, providing a passageway for air to enter the reservoir 140 on one side of the diaphragm 800.

As noted, air may be drawn into the reservoir 140 when the pressure inside the reservoir 140 is sufficiently low relative to ambient pressure, although the pressure within the reservoir 140 may remain lower than ambient pressure. The wick vent 866 may provide a more controlled or otherwise more optimal passageway for air to enter the reservoir 140 than around the wicking element 1362. The wicking element 1362 adjacent to the wick vent 866 may ensure that wick vent 866 remains saturated to prevent an unbroken path of air between the reservoir 140 and the ambient environment.

A meniscus at the wick vent 866, for example, an air-liquid interface between the vaporizable material 1302 and ambient air, may maintain the vacuum (or partial vacuum) within the reservoir 140 such that the pressure within the reservoir 140 remains lower than ambient pressure. As noted, this pressure differential may prevent the vaporizable material 1302 from leaking out of the reservoir 140, for example, through the wicking element 1362. Moreover, the size and/or geometry of the wick vent 866 may be configured to retain the vaporizable material 1302 in the wick vent 866 and/or return the vaporizable material 1302 back to the reservoir 140.

In some implementations of the current subject matter, the subassembly 860 may be coupled with the first housing segment 310 and the second housing segment 320 in order to form the vaporizer cartridge 1320. For example, the subassembly 860 may be joined with the first housing segment 310 and the second housing segment 320 using a variety of techniques including, for example, adhesives, ultrasonic welding, electron beam welding, laser beam welding, and/or the like. To further illustrate, FIG. 12F depicts a transparent perspective view of an example of the vaporizer cartridge 1320 in which the subassembly 860 is joined to the first housing segment 310 and the second housing segment 320 by one or more welds 870 (e.g., a laser weld and/or the like) formed around a perimeter of the frame 862.

In order to form the one or more welds 870, the first housing segment 310 and the second housing segment 320 may be formed from a first material that is transparent to a laser beam while the frame 862 may be formed from a second material that is opaque to the laser beam. Alternatively, the first housing segment 310, the second housing segment 320, and the frame 862 may be formed from the first material that is transparent to the laser beam and a film of the second material that is opaque to the laser beam may be disposed at a weld zone where the frame 862 interfaces with the first housing segment 310 and the second housing segment 320.

Figure 13A:
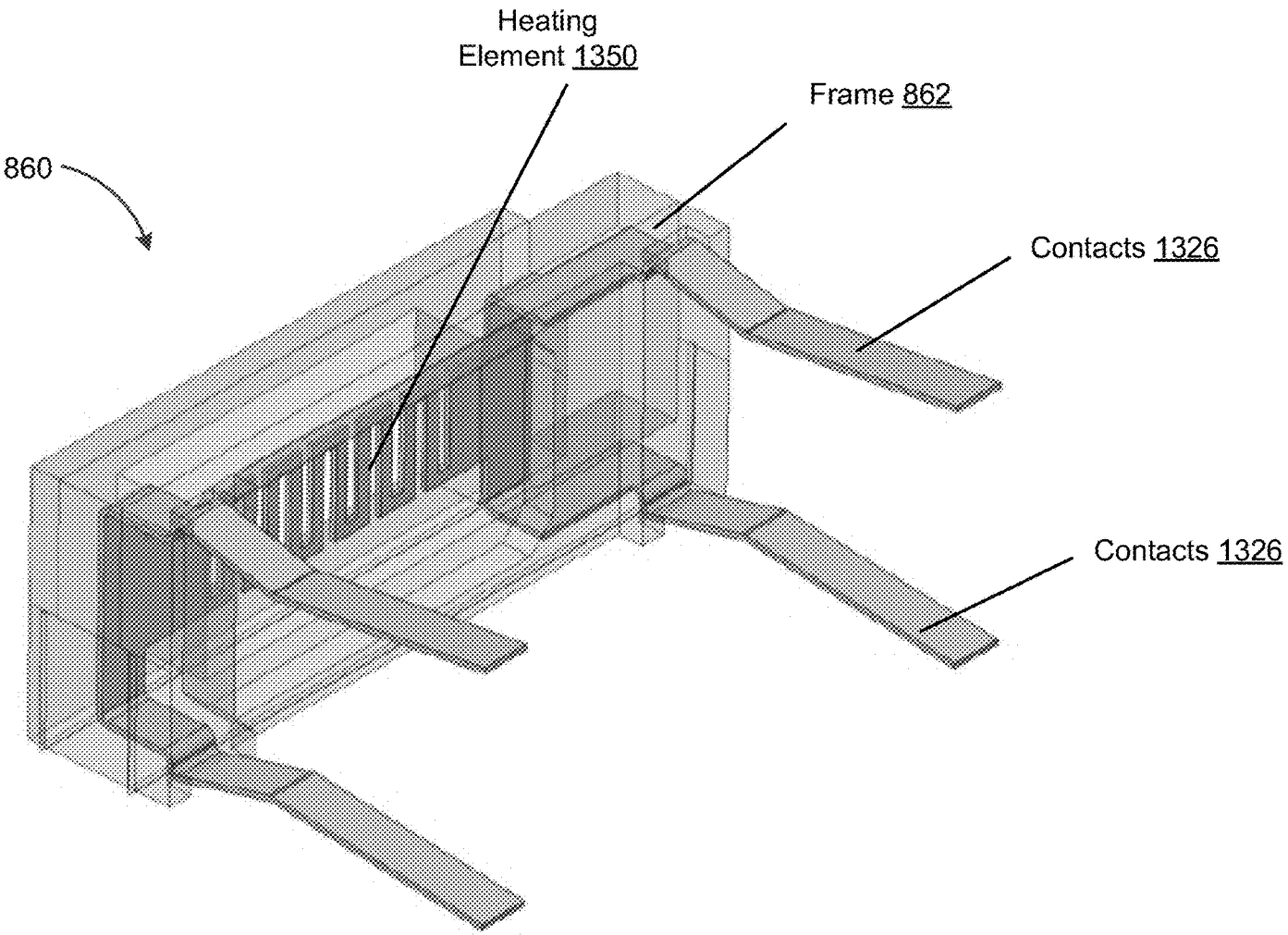
FIG. 13A depicts a perspective view of another example of an atomizer subassembly consistent with implementations of the current subject matter.
Figure 13B:
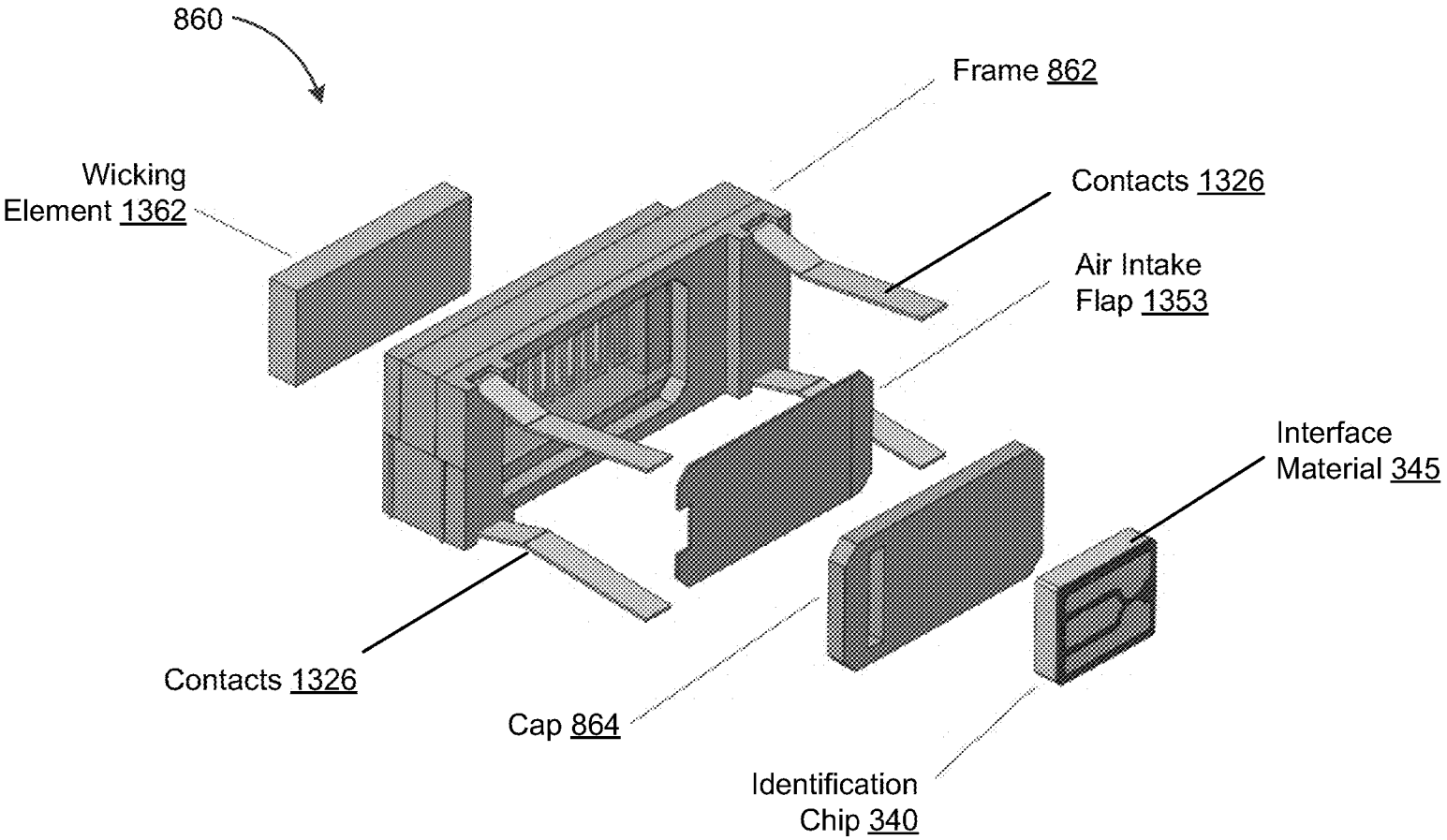
FIG. 13B depicts an exploded view of an example of an atomizer subassembly consistent with implementations of the current subject matter.
Figure 13C:
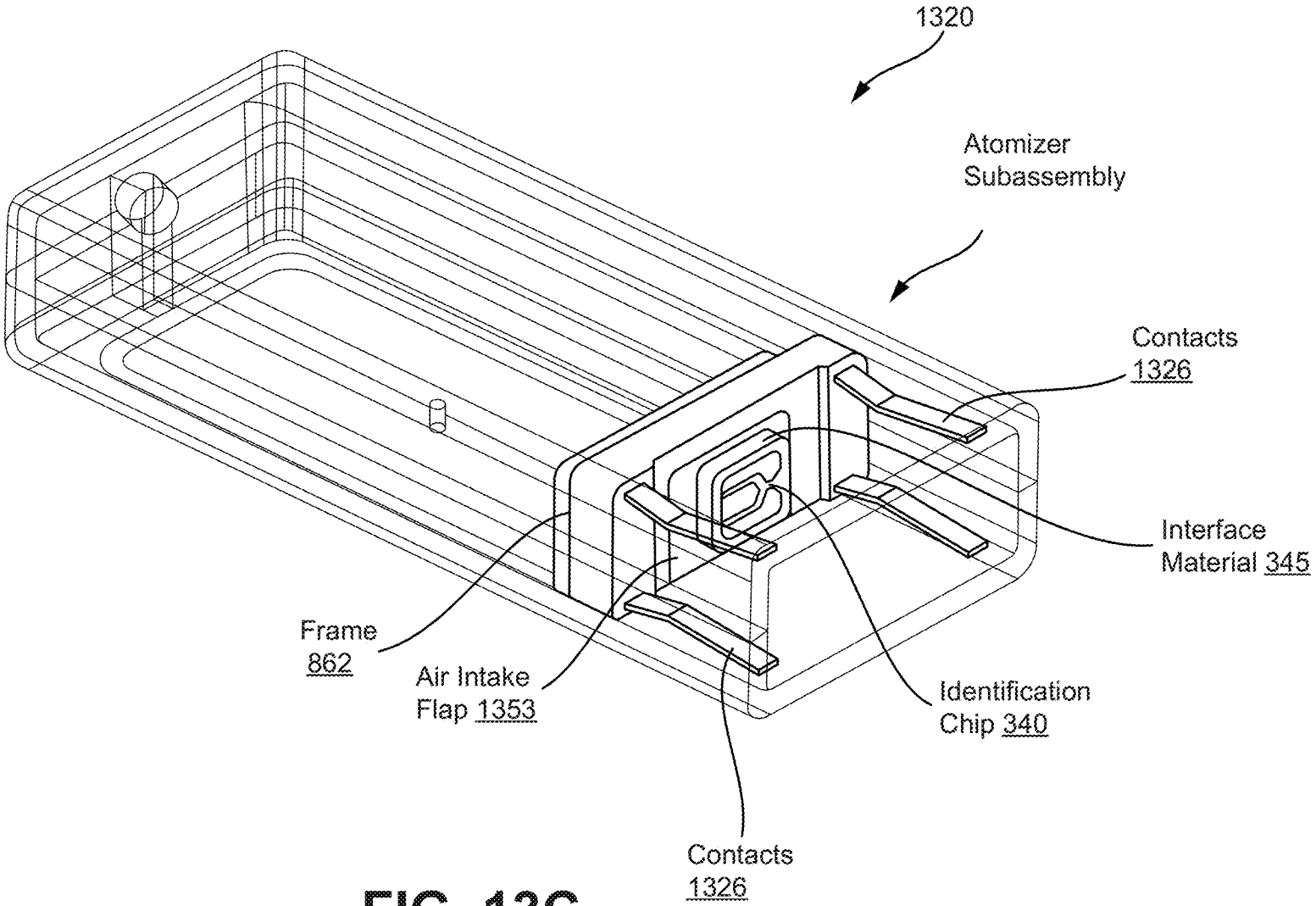
FIG. 13C depicts a transparent perspective view of an example of a vaporizer cartridge having an atomizer subassembly consistent with implementations of the current subject matter.

FIG. 13A depicts a perspective view of another example of the atomizer subassembly 860 consistent with implementations of the current subject matter. An exploded view of the example of the atomizer subassembly 860 is shown in FIG. 13B. The example of the atomizer subassembly 860 shown in FIGS. 13A-B may include the wicking element 1362, the heating element 1350 with one or more contacts 1326, the identification chip 340, the interface material 345, the frame 862, and the cap 864. The wicking element 1362 and the heating element 1350 may be secured to the frame 862 by the cap 864. The one or more contacts 1326 may be formed by one or more portions of the heating element 1350 extending beyond the frame 862 and the cap 864. In the example of the atomizer subassembly 860 shown in FIGS. 13A-E, the one or more contacts 1326 may be crimped to create build-in compliance. That is, the one or more contacts 1326 may be folded, at least partially, to create one or more bends that lend spring tension to the one or more contacts 1326 such that in addition to providing an electrical coupling between the vaporizer cartridge 1320 and the vaporizer body 110, the one or more contacts 1326 may also mechanically engage the receptacle contacts 125 in the cartridge receptacle 118 (e.g., by spring tension) to secure the vaporizer cartridge 1320 in the cartridge receptacle 118 of the vaporizer body 110.

In some implementations of the current subject matter, the frame 862 may be over-molded around the heating element 1350 and the one or more contacts 1326 such that the frame 862 interfaces with the first housing segment 310 and the second housing segment 320. The over-molding may enable the formation of a hermetic seal between the atomizer subassembly 860 and the first housing segment 310 and the second housing segment 320 when the atomizer subassembly 860 is joined to the first housing segment 310 and the second housing segment 320 using, for example, adhesives, ultrasonic welding, electron beam welding, laser beam welding, and/or the like.

Figures 14A, 14B, 14C:
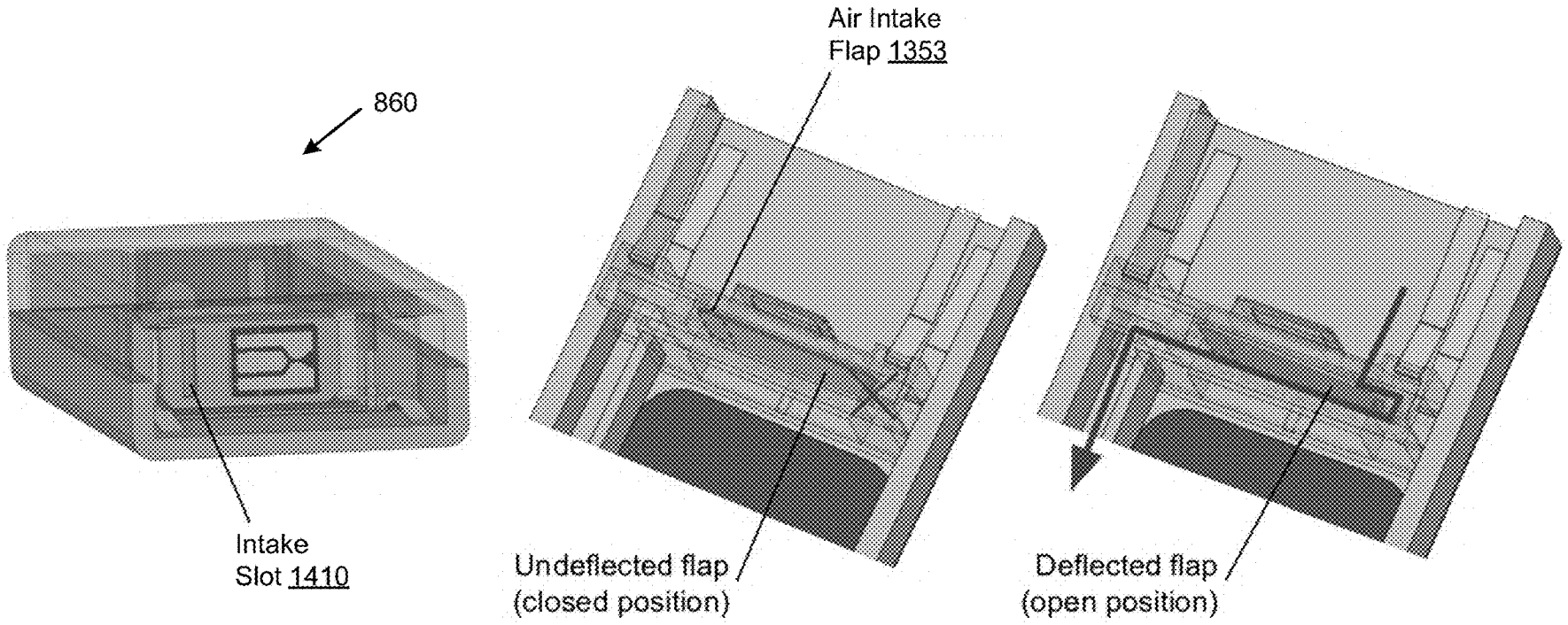
FIG. 14A depicts a transparent perspective view of an example of a vaporizer cartridge having an air intake flap consistent with implementations of the current subject matter.
FIG. 14B depicts another transparent perspective view of an example of a vaporizer cartridge having an air intake flap consistent with implementations of the current subject matter.
FIG. 14C depicts another transparent perspective view of an example of a vaporizer cartridge having an air intake flap consistent with implementations of the current subject matter.
Figure 15A:
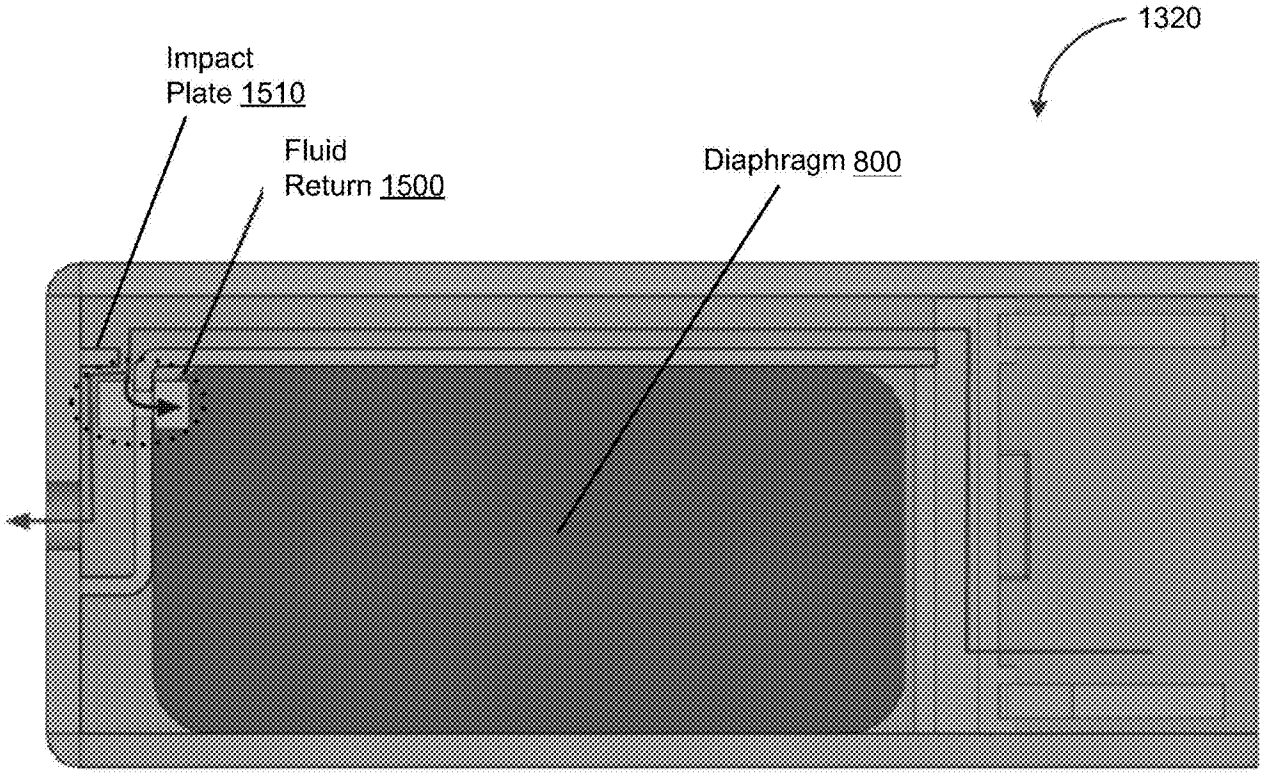
FIG. 15A depicts a planar cross-sectional view of an example of a vaporizer cartridge having a fluid return feature consistent with implementations of the current subject matter.
Figure 15B:
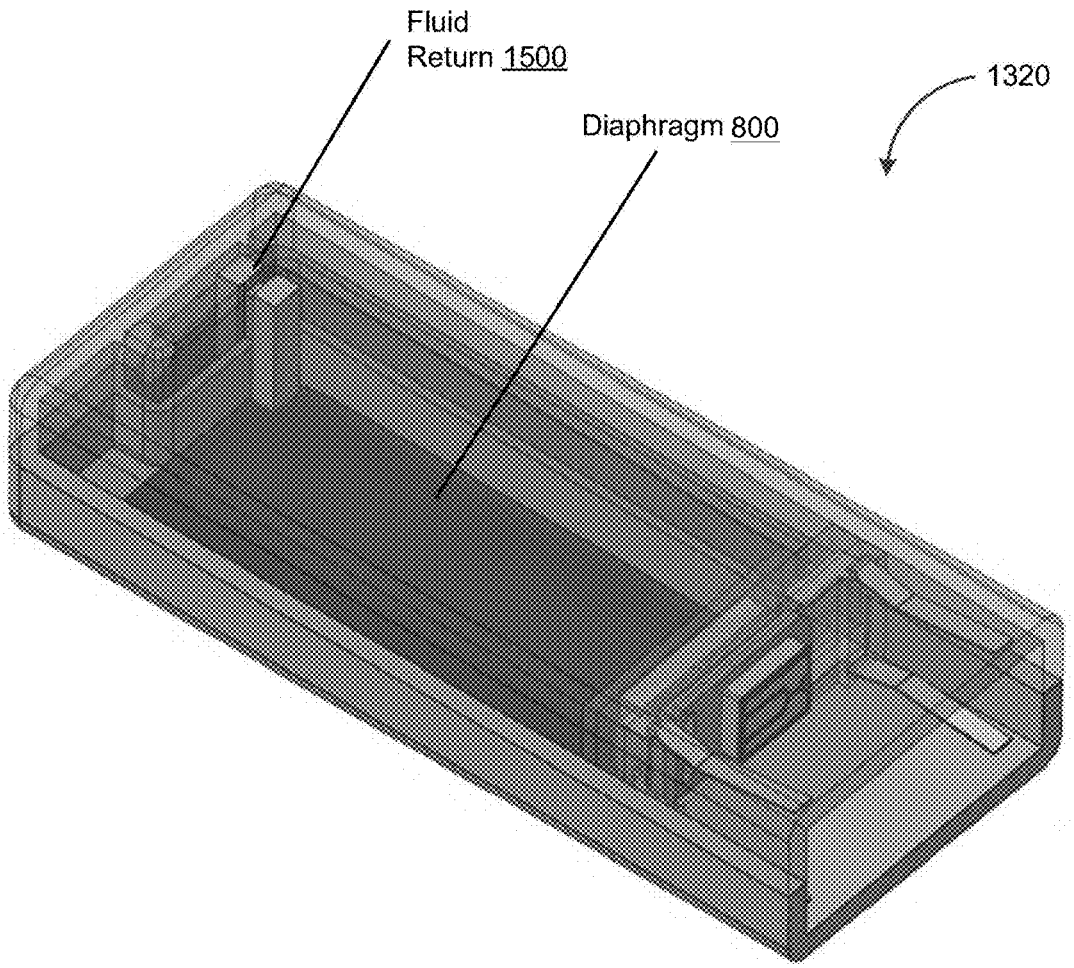
FIG. 15B depicts a transparent perspective view of an example of a vaporizer cartridge having a fluid return feature consistent with implementations of the current subject matter.
Figure 15C:
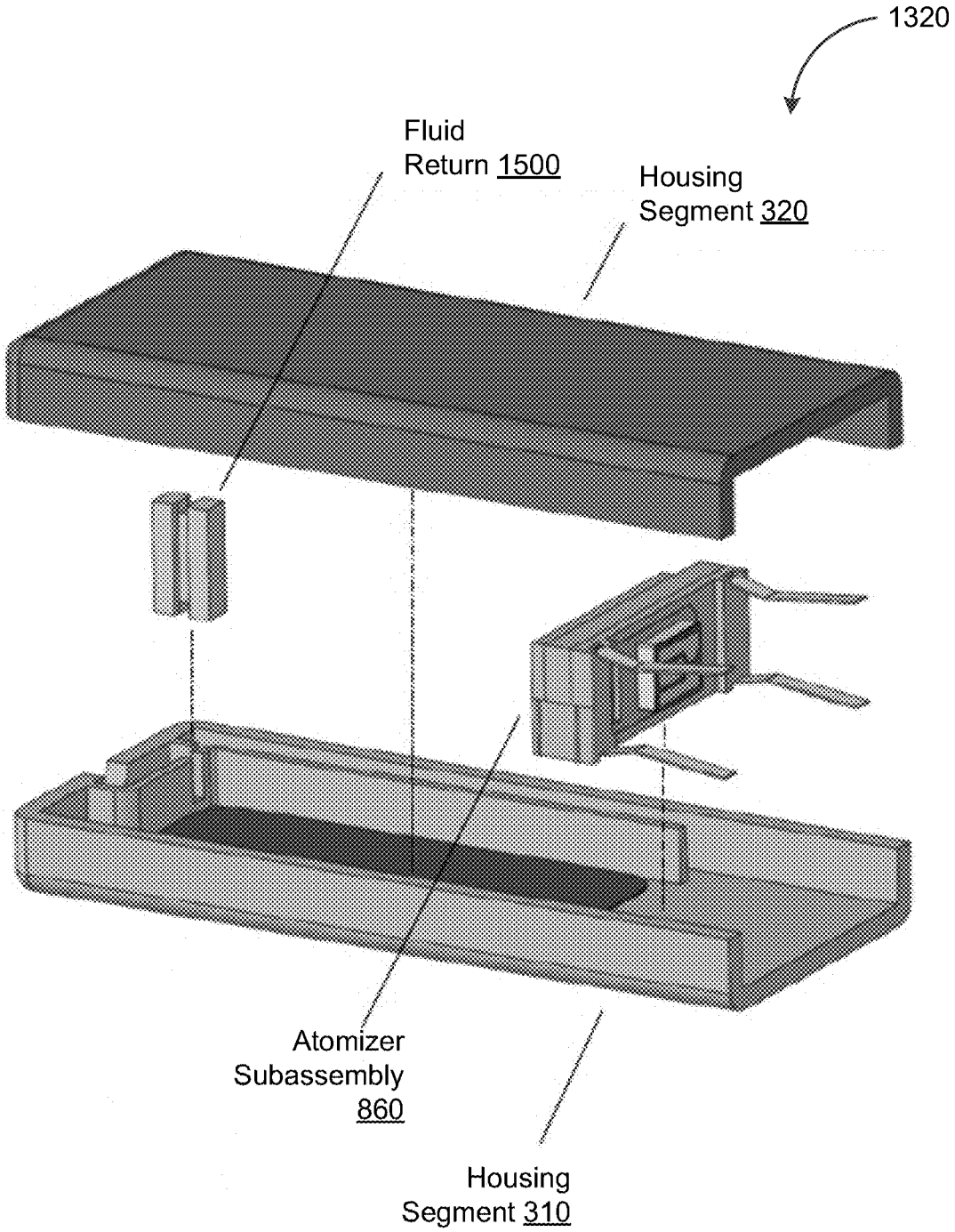
FIG. 15C depicts an exploded view of an example of a vaporizer cartridge having a fluid return feature consistent with implementations of the current subject matter.
Figure 15D:
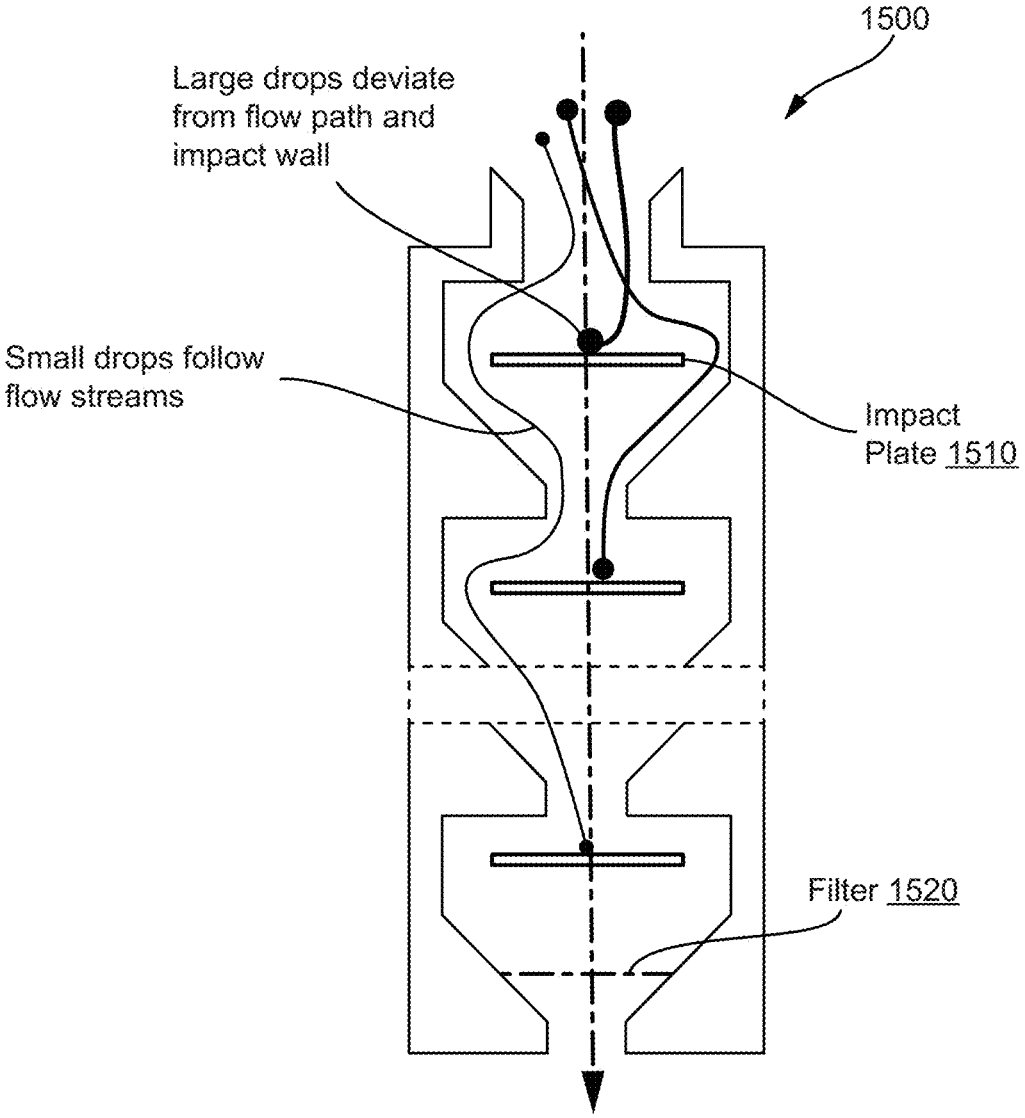
FIG. 15D depicts a schematic diagram illustrating an example of a fluid return feature consistent with implementation of the current subject matter.

In some implementations of the current subject matter, the atomizer subassembly 860 may include an air intake flap 1353 configured to admit air into the vaporizer cartridge 1320 through one or more apertures such as the intake slot 1410 in the cap 864 of the atomizer subassembly 860. The air intake flap 1353 may be further configured to prevent the egress of the vaporizable material 1302 from the vaporizer cartridge 1320. As shown in FIGS. 13B and 14A-C, the air intake flap 1353 may be interposed between the cap 864 and the heating element 1350. Moreover, FIGS. 14B-C show that while one end of the air intake flap 1353 remains free, an opposite end of the air intake flap 1353 may be joined to the frame 862 by adhesives, ultrasonic welding, electron beam welding, laser beam welding, and/or the like. As such, the intake of air through the intake slot 1410, which may occur when air is drawn into the vaporizer cartridge 1320 by a user puffing on the vaporizer device 100, may cause the air intake flap 1353 to deflect.

Figure 13D:
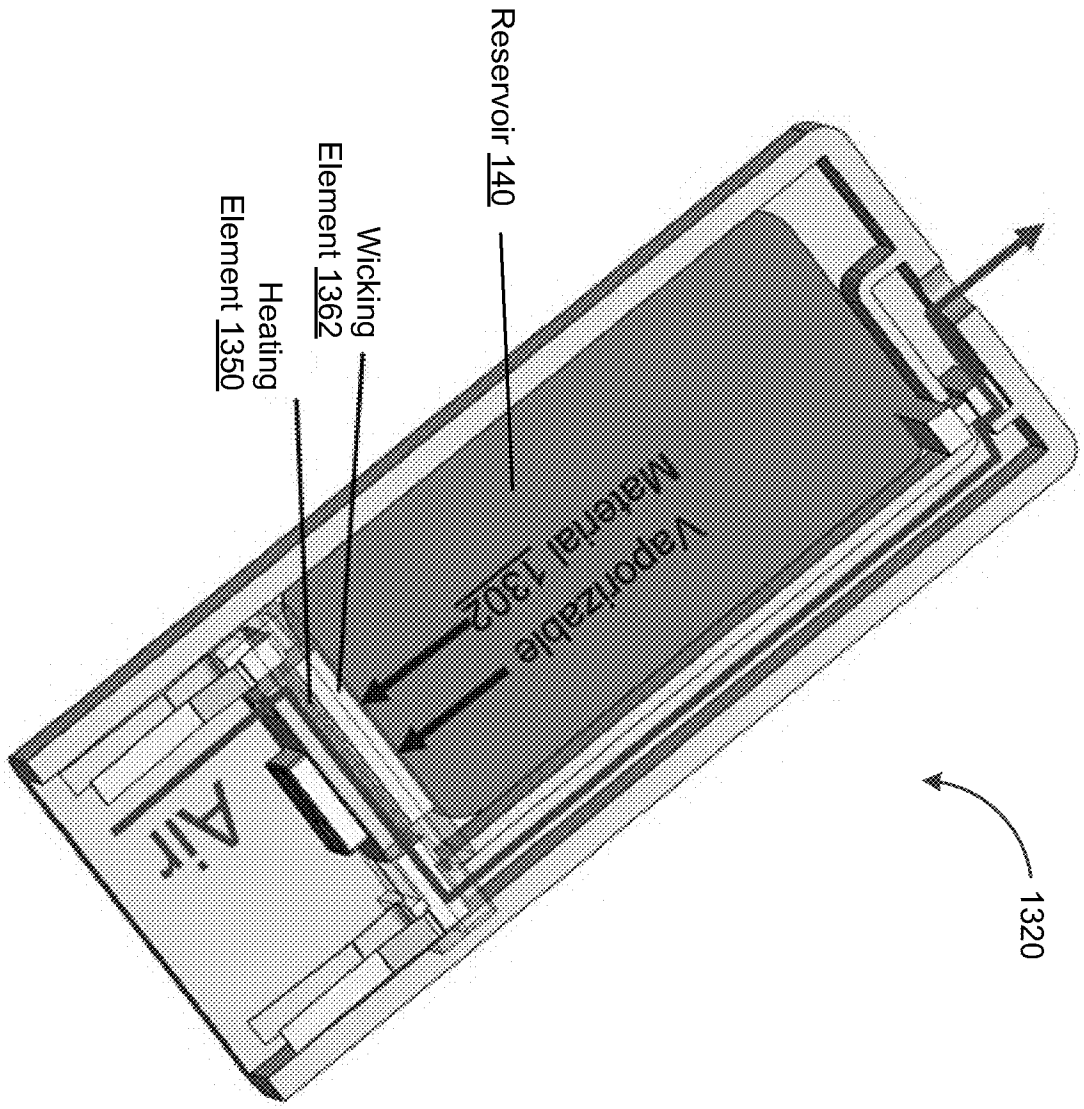
FIG. 13D depicts a planar cross-sectional view of an example of a vaporizer cartridge having an atomizer subassembly consistent with implementations of the current subject matter.
Figure 13E:
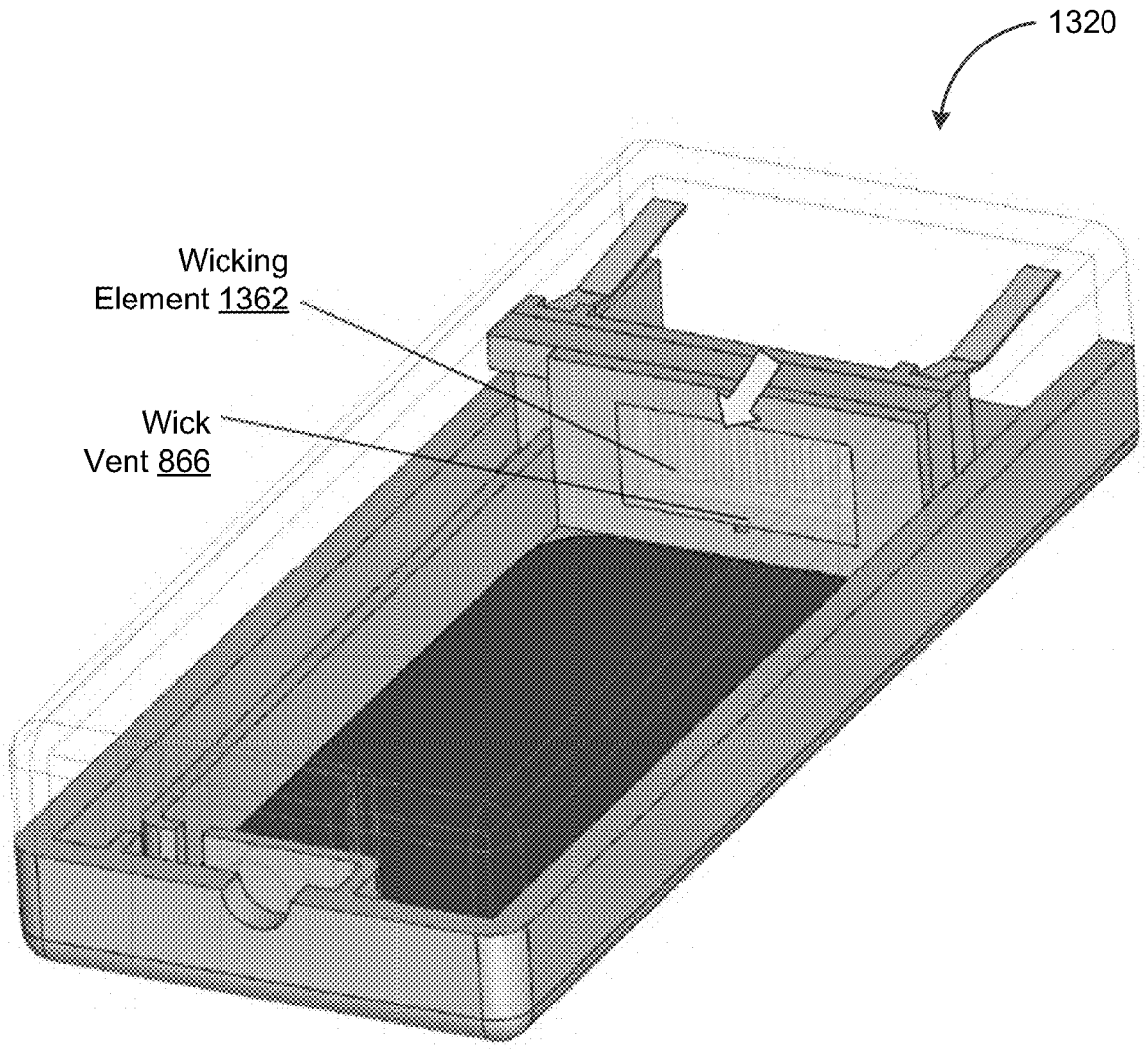
FIG. 13E depicts another transparent perspective view of an example of a vaporizer cartridge having an atomizer subassembly consistent with implementations of the current subject matter.

The deflection of the air intake flap 1353 may admit air into the vaporizer cartridge 1320, for example, through the atomizer subassembly 860 and into the airflow passageway 1338. As shown in FIG. 13D, the intake slot 1410 is at least partially uncovered while the air intake flap 1353 is in a deflected state, thus allowing air to pass through the intake slot 1410. The airflow passageway 1338, which may be defined through or on a side of the reservoir 140, may provide a fluidic coupling between the atomizer subassembly 860, including the heating element 1350 and the wicking element 1362, and the orifice 220 in the mouthpiece 1330 of the vaporizer cartridge 1320. The airflow passageway 1338 may thus provide a route for the vaporized vaporizable material 1302 to travel from the heating element 1350 area and out of the orifice 220 in the mouthpiece 1330. Contrastingly, the air intake flap 1353 in the undeflected position may prevent the egress of the vaporizable material 1302 from the vaporizer cartridge 1320. For example, in the undeflected position, the air intake flap 1353 may cover the intake slot 1410, thereby preventing vapor, which may be laden with the vaporizable material 1302, from exiting the intake slot 1410 in the cap 864 of the atomizer subassembly 860.

In some example embodiments, the vaporizer cartridge 1320 may include a fluid return 1500 and one or more impact plates 1510 configured to prevent the egress of the vaporizable material 1302 from the orifice 220 in the mouthpiece 1330 of the vaporizer cartridge 1320. The egress of the vaporizer material 1302 may occur when large droplets of the vaporizable material 1302, which may be present in the vapor formed by vaporizing the vaporizable material 1302, exits the orifice 220. Vapor that is laden with large droplets of the vaporizable material 1302 may result in an unfavorable user experience. User experience may also be diminished by an accumulation of these droplets of the vaporizable material 1302 in the airflow passageway 1338 at least because the accumulation of the vaporizable material may cause blockages in the airflow passageway 1338 that reduce the longevity of the vaporizer cartridge 1320.

As such, the vaporizer cartridge 1320 may include the one or more impact plates 1510 configured to capture the larger droplets that are present in the vapor formed by vaporizing the vaporizable material 1302. The vaporizer cartridge 1320 may further include the fluid return 1500 configured to return the vaporizable material 1302 to the reservoir 140 for subsequent use. For example, as shown in FIGS. 15A-D, the fluid return feature 1500 and the one or more impact plates 1510 may be disposed at least partially across the airflow passageway 1338 to create one or more obstacles along the airflow passageway 1338.

Smaller droplets of the vaporizable material 1302 in the vapor traveling through the airflow passageway 1338 tend to be lighter and thus more likely to continue the flow stream through the airflow passageway 1338 to exit the orifice 220 in the mouthpiece 1330. Contrastingly, larger droplets of the vaporizable material 1302 in the vapor tend to be heavier and more likely to deviate from the flow stream. Thus, instead of existing the orifice 220 in the mouthpiece 1330, these larger droplets of the vaporizable material 1302 may impact the one or more impact plates 1510. The larger droplets of the vaporizable material 1302 trapped at the one or more impact plates may be returned to the reservoir 140 by the fluid return 1500. For instance, the fluid return 1500 may be formed from a porous material, which may absorb the vaporizable material 1302 and direct the vaporizable material 1302 back to the reservoir 140. Doing so may minimize the quantity of liquid vaporizable material 1302 exiting the orifice 220 of the mouthpiece 1330 while maximizing the quantity of the vaporizable material 1302 available for use. In the example configuration shown in FIG. 15D, the airflow passageway 1338 may further include one or more filters 1520 configured to capture those large droplets of the vaporizable material 1302 that evade the one or more impact plates 1510.

Figure 16:
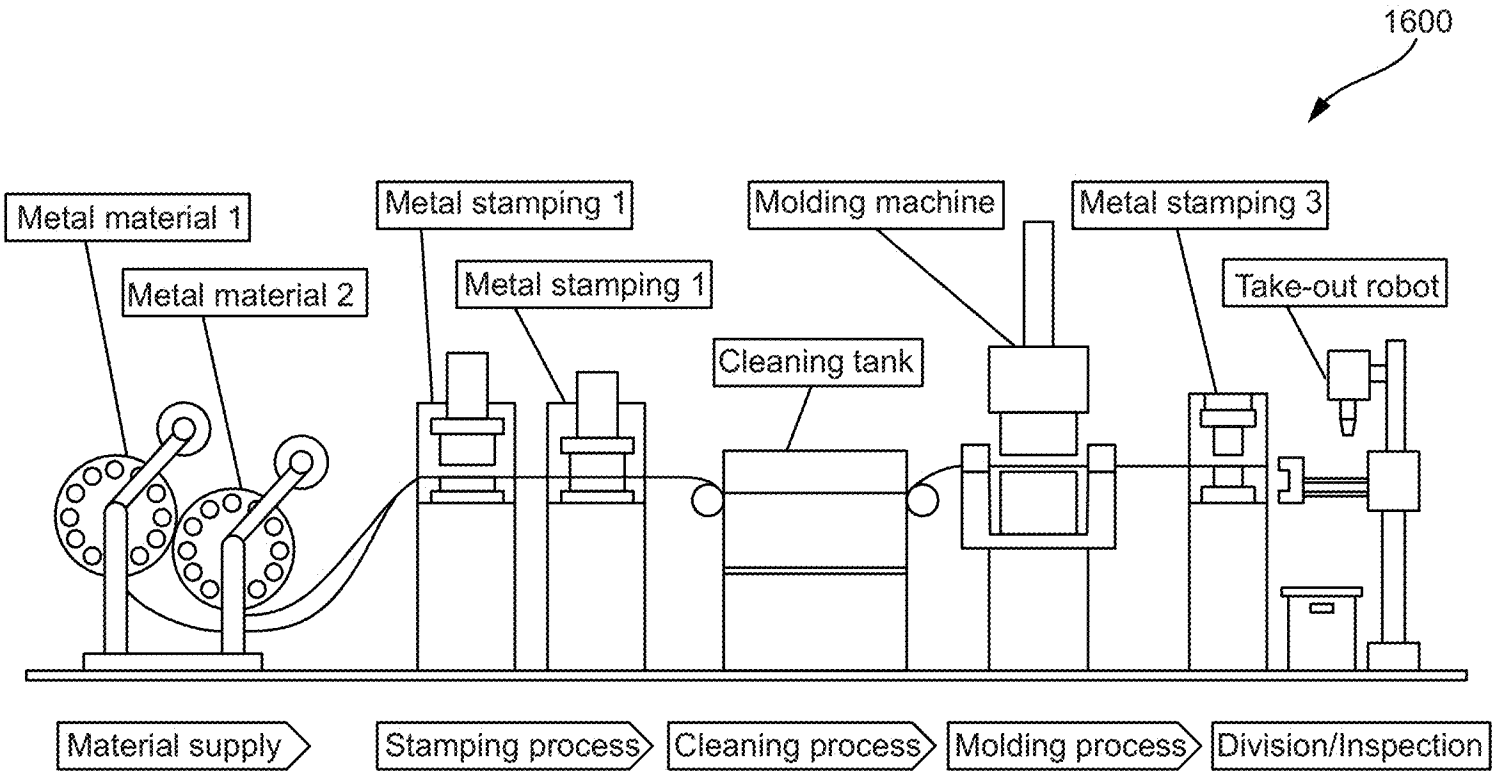
FIG. 16 depicts a schematic diagram illustrating an example of a process for manufacturing an atomizer subassembly consistent with implementation of the current subject matter.

FIG. 16 depicts a schematic diagram illustrating an example of a process 1600 for manufacturing the atomizer subassembly 860 consistent with implementation of the current subject matter. According to some implementations of the current subject matter, the process 1600 may include metal stamping and crimping to form the heating element 1350. Furthermore, the process 1600 may include a plastic over-molding in order to integrate the heating element 1350 into the frame 862. As noted, the frame 862 may be over-molded around the heating element 1350 and the one or more contacts 1326 to enable the formation of a hermetic seal between the resulting atomizer subassembly 860 and the first housing segment 310 and the second housing segment 320 when the atomizer subassembly 860 is joined to the first housing segment 310 and the second housing segment 320.

Figure 17A:
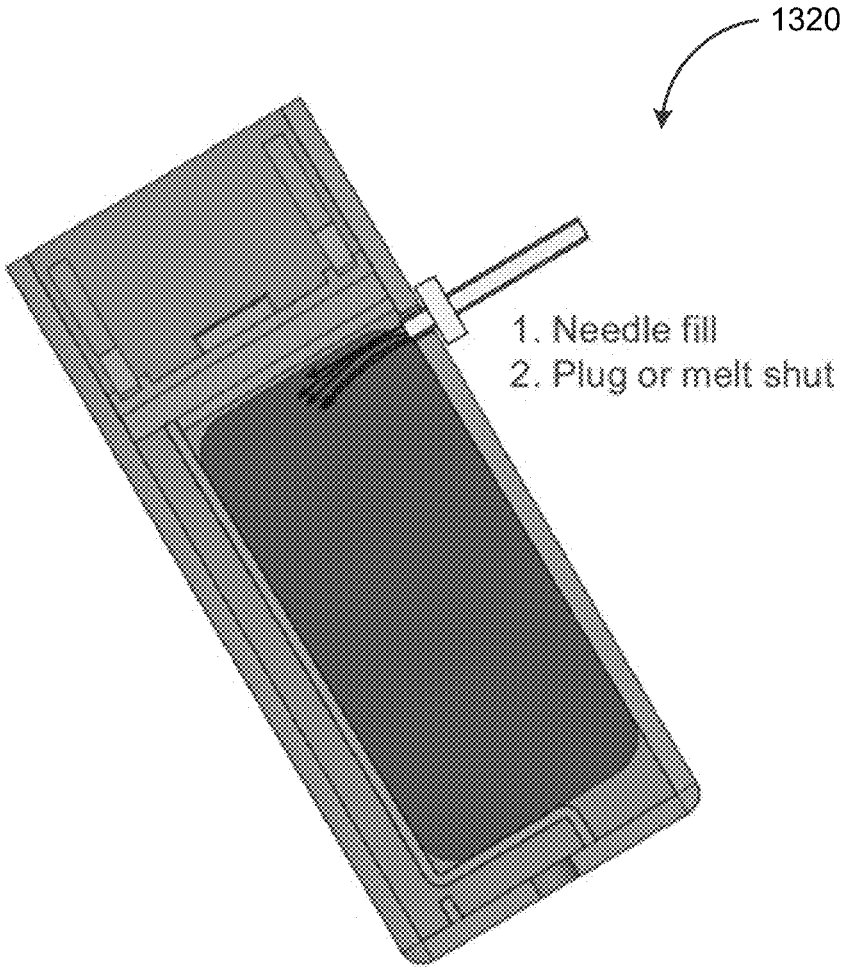
FIG. 17A depicts a schematic diagram illustrating an example of a technique for filling a vaporizer cartridge consistent with implementation of the current subject matter.
Figure 17B:
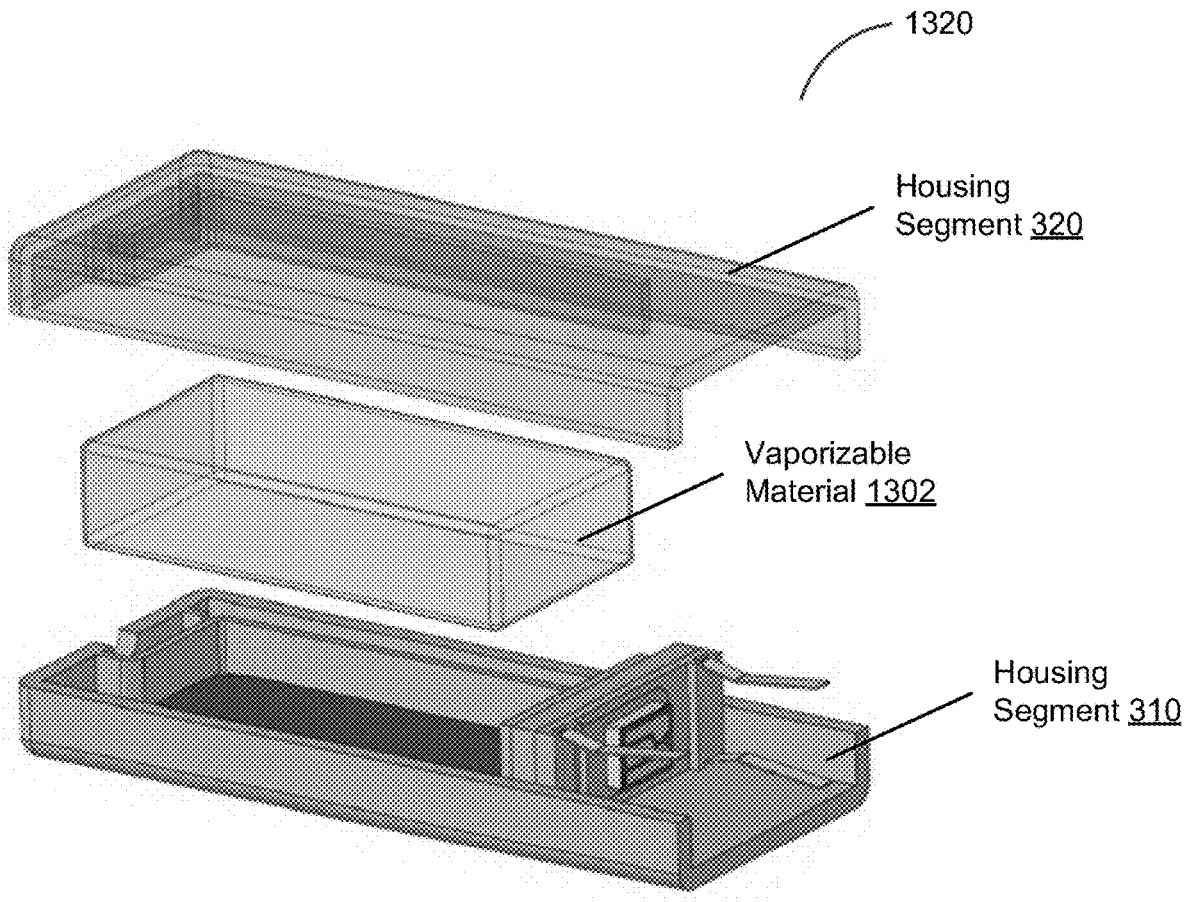
FIG. 17B depicts a schematic diagram illustrating another example of a technique for filling a vaporizer cartridge consistent with implementation of the current subject matter.

FIG. 17A depicts a schematic diagram illustrating an example of a technique for filling the vaporizer cartridge 1320 consistent with implementation of the current subject matter. In some implementations of the current subject matter, the vaporizer cartridge 1320 may be filled by injecting the vaporizable material 1302 through a fill port (or another orifice) in the first housing segment 310 and the second housing segment 320. Once the vaporizer cartridge 1320 is filled, the fill port may be sealed, for example, by plugging the fill port or melting the fill port shut. An alternative technique for filling the vaporizer cartridge 1320 is shown in FIG. 17B. Referring to FIG. 17B, the vaporizer cartridge 1320 may be filled by depositing, between the first housing segment 310 and the second housing segment 320, the vaporizable material 1302 while the vaporizable material 1302 is in a solid phase or semi-solid phase (e.g., a frozen block of the vaporizable material 1302). The first housing segment 310 and the second housing segment 320 may subsequently be joined using a variety of techniques including, for example, adhesives, ultrasonic welding, electron beam welding, laser beam welding, and/or the like.

Figure 17C:
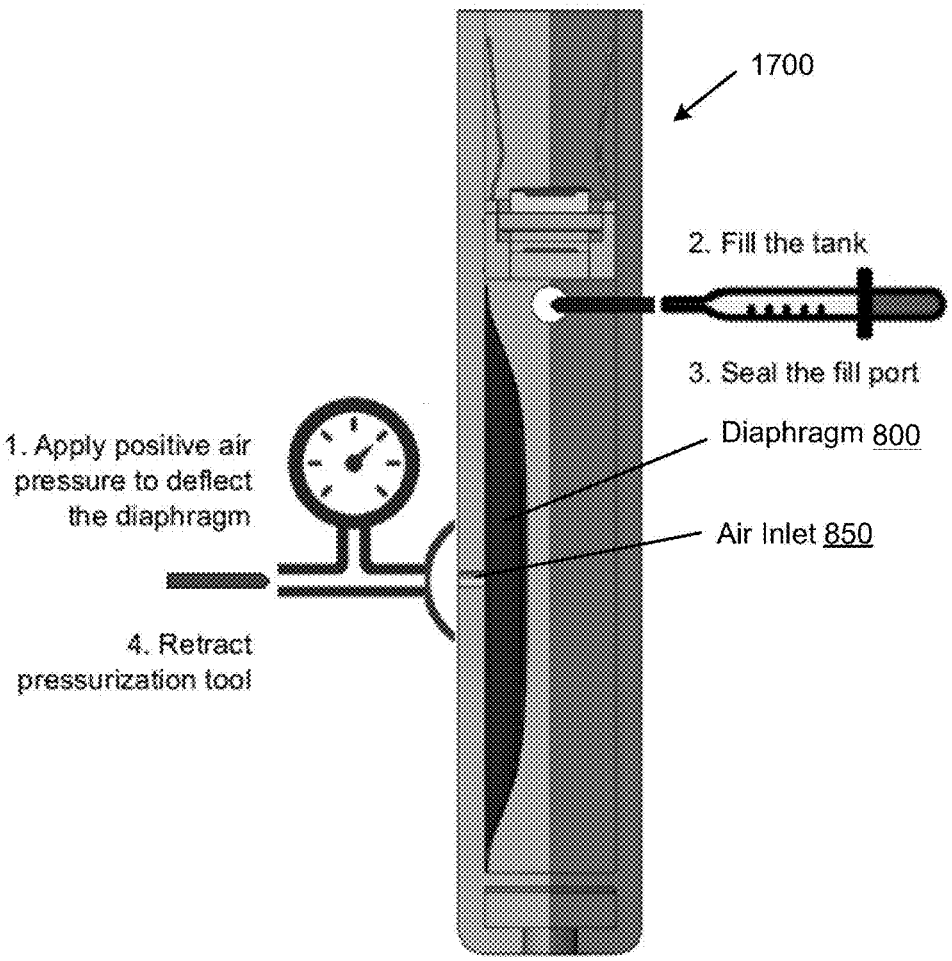
FIG. 17C depicts a schematic diagram illustrating another example of a process for filling a vaporizer cartridge consistent with implementation of the current subject matter.

FIG. 17C depicts a schematic diagram illustrating an example of a process 1700 for filling the vaporizer cartridge 1320 consistent with implementation of the current subject matter. As shown in FIG. 17C, the vaporizer cartridge 1320 may be filled by applying, through the air inlet 850 included in the first housing segment 310, a positive pressure to deflect the diaphragm 800. While the diaphragm 800 is deflected by the application of the positive pressure, the vaporizer cartridge 1320 may be filled by injecting the vaporizable material 1302 through a fill port (or another orifice) in the first housing segment 310 and/or the second housing segment 320. Once the vaporizer cartridge 1320 is filled with the vaporizable material 1302, the fill port may be sealed and the positive pressure may be removed.

Terminology

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present.

Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Terminology used herein is for the purpose of describing particular embodiments and implementations only and is not intended to be limiting. For example, as used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." Use of the term "based on," above and in the claims is intended to mean, "based at least in part on," such that an unrecited feature or element is also permissible.

Spatially relative terms, such as "forward", "rearward", "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings provided herein.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical values given herein should also be understood to include about or approximately that value, unless the context indicates otherwise. For example, if the value "10" is disclosed, then "about 10" is also disclosed. Any numerical range recited herein is intended to include all sub-ranges subsumed therein. It is also understood that when a value is disclosed that "less than or equal to" the value, "greater than or equal to the value" and possible ranges between values are also disclosed, as appropriately understood by the skilled artisan. For example, if the value "X" is disclosed the "less than or equal to X" as well as "greater than or equal to X" (e.g., where X is a numerical value) is also disclosed. It is also understood that the throughout the application, data is provided in a number of different formats, and that this data, represents endpoints and starting points, and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

Although various illustrative embodiments are described above, any of a number of changes may be made to various embodiments without departing from the teachings herein. For example, the order in which various described method steps are performed may often be changed in alternative embodiments, and in other alternative embodiments, one or more method steps may be skipped altogether. Optional features of various device and system embodiments may be included in some embodiments and not in others. Therefore, the foregoing description is provided primarily for exemplary purposes and should not be interpreted to limit the scope of the claims.

One or more aspects or features of the subject matter described herein can be realized in digital electronic circuitry, integrated circuitry, specially designed application specific integrated circuits (ASICs), field programmable gate arrays (FPGAs) computer hardware, firmware, software, and/or combinations thereof. These various aspects or features can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device. The programmable system or computing system may include clients and servers. A client and server are generally remote from each other and typically interact through a communication network. The relationship of client and server arises by virtue of computer programs running on the respective computers and having a client-server relationship to each other.

These computer programs, which can also be referred to programs, software, software applications, applications, components, or code, include machine instructions for a programmable processor, and can be implemented in a high-level procedural language, an object-oriented programming language, a functional programming language, a logical programming language, and/or in assembly/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example, as would a processor cache or other random access memory associated with one or more physical processor cores.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A cartridge for a vaporizer device, the cartridge comprising:

a cartridge housing having a first housing segment coupled with a second housing segment, at least a portion of the cartridge housing forming a wick housing;

a reservoir disposed within the cartridge housing, the reservoir including a storage chamber and a collector, the collector including an overflow channel configured to retain a volume of a vaporizable material in fluid contact with the storage chamber, the overflow channel including one or more microfluidic features configured to provide a constriction point at which a meniscus forms to create a pressure differential between the reservoir and ambient pressure, the meniscus further regulating an exchange of air and the vaporizable material into and out of the reservoir;

a heating element, the heating element including a heating portion disposed at least partially inside the wick housing and a contact portion extending at least partially outside of the wick housing, the contact portion including one or more cartridge contacts configured to form an electric coupling with one or more contacts in the vaporizer device; and a wicking element disposed at least partially inside the wick housing and proximate to the heating portion of the heating element, the wicking element being in fluid communication with the reservoir, and the wicking element configured to draw the vaporizable material from the reservoir for vaporization by the heating element.

2. The cartridge of claim 1, wherein the collector is disposed between the first housing segment and the second housing segment.

3. The cartridge of claim 1, wherein the first housing segment includes a first portion of the collector, and wherein the second housing segments includes a second portion of the collector.

4. The cartridge of claim 1, wherein the first housing segment and the second housing segment are joined by one or more of an adhesive, ultrasonic welding, electron beam welding, and laser beam welding.

5. The cartridge of claim 1, wherein the first housing segment and the second housing segment are joined by a laser beam forming a laser weld between the first housing segment and the second housing segment.

6. The cartridge of claim 5, wherein the first housing segment is formed from a first material that is transparent to the laser beam, wherein the second housing segment is formed from a second material that is opaque to the laser beam, and wherein the laser beam penetrates the first housing segment to form the laser weld by melting the second housing segment.

7. The cartridge of claim 5, wherein the first housing segment and the second housing segment are formed from a first material that is transparent to the laser beam, wherein a film of a second material that is opaque to the laser beam is disposed between the first housing segment and the second housing segment, and wherein the laser beam penetrates the first housing segment or the second housing segment to form the laser weld by melting the film disposed between the first housing segment and the second housing segment.

8. The cartridge of claim 1, wherein a portion of the cartridge comprises a male connector including at least a portion of the wick housing and configured to be disposed at least partially inside a receptacle in a body of the vaporizer device.

9. The cartridge of claim 8, wherein the cartridge includes a sleeve extending at least partially over and/or around the male connector, wherein the sleeve extends below an open top of the receptacle to at least partially enclose the receptacle when the cartridge is coupled with the body of the vaporizer device, wherein a recessed area is formed between the sleeve and the body of the vaporizer device when the cartridge is coupled with the body of the vaporizer device, wherein the receptacle includes one or more air inlets configured to provide airflow to the cartridge coupled with the body of the vaporizer device, and wherein the one or more air inlets in the receptacle are disposed within the recessed area when the cartridge is coupled with the body of the vaporizer device.

10. The cartridge of claim 1, wherein a portion of the cartridge comprises a female connector configured to couple with a protrusion in a body of the vaporizer device.

11. The cartridge of claim 1, wherein the contact portion is further configured to form a mechanical coupling with a receptacle of the vaporizer device, and wherein the mechanical coupling secures the cartridge to the receptacle of the vaporizer device.

12. The cartridge of claim 1, wherein the wick housing includes one or more vents configured to provide airflow to the wicking element.

13. The cartridge of claim 1, further comprising:

an airflow passageway connecting the wick housing to an orifice in the cartridge that provides an outlet for an aerosol that is formed by the heating element vaporizing the vaporizable material, the airflow passageway having an interior surface including one or more features configured to collect a condensate formed by the aerosol and direct at least a portion of the collected condensate towards the wicking element.

14. The cartridge of claim 13, wherein the airflow passageway includes one or more impact plates configured to collect a condensate formed by the aerosol, wherein the airflow passageway further includes a fluid return formed from a porous material, and wherein the fluid return is configured to absorb the condensate collected by the one or more impact plates and direct the condensate to the reservoir.

15. The cartridge of claim 13, further comprising:

a sponge disposed proximate to an interface between the airflow passageway and the orifice, the sponge configured to filter a condensate formed by the aerosol.

16. The cartridge of claim 13, further comprising:

an intake slot through which air enters the airflow passageway in response to air being drawn into the cartridge; and an air intake flap configured to admit the air into the airflow passageway while preventing an egress of the vaporizable material from the intake slot, the air intake flap in an undeflected state covering the intake slot to prevent the egress of the vaporizable material from the intake slot, the air intake flap being configured to deflect in response to the air being drawn into the cartridge through the intake slot, and the intake slot being at least partially uncovered while the air intake flap is in a deflected state to admit air into the airflow passageway.

17. The cartridge of claim 1, wherein the one or more microfluidic features include one or more bumps, raised edges, and/or protrusions extending from an interior surface of the overflow channel.

18. The cartridge of claim 1, wherein the one or more microfluidic features include one or more spirals, curves, bends, tapers, slopes, and/or turns along a length of the overflow channel.

19. The cartridge of claim 1, wherein the heating element comprises a substrate material that is cut and folded to form the heating portion of the heating element and the contact portion of the heating element, and wherein the heating portion of the heating element is configured to receive at least a portion of the wicking element.

20. The cartridge of claim 1, wherein an interior surface of the wicking housing includes at least one channel extending from the storage chamber to the wick housing, and wherein the at least one channel is configured to route the vaporizable material in the storage chamber to one or more portions of the wicking element disposed proximate to the heating portion of the heating element.

21. The cartridge of claim 1, wherein the vaporizable material enters the overflow channel through a first opening at a first end of the overflow channel, wherein the first opening is disposed proximate to the wick element to at least minimize a hydrostatic head between the wicking element and the storage chamber, and wherein air enters the overflow channel through a second opening at a second end of the overflow channel.

22. The cartridge of claim 1, wherein a lip is disposed at least partially around perimeter of the wick housing, and wherein the lip provides a capillary break preventing a contact between the vaporizable material and a body of the vaporizer device by at least forming a gap between the wick housing and the body of the vaporizer device when the cartridge is coupled with the body of the vaporizer device.

* * * * *